US011417274B2

(12) United States Patent
Ueno et al.

(10) Patent No.: US 11,417,274 B2
(45) Date of Patent: Aug. 16, 2022

(54) DISPLAY DEVICE

(71) Applicant: SHARP KABUSHIKI KAISHA, Sakai (JP)

(72) Inventors: Masafumi Ueno, Sakai (JP); Masaaki Moriya, Sakai (JP); Naoki Shiobara, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/040,911

(22) PCT Filed: Mar. 30, 2018

(86) PCT No.: PCT/JP2018/013808
§ 371 (c)(1),
(2) Date: Sep. 23, 2020

(87) PCT Pub. No.: WO2019/187068
PCT Pub. Date: Oct. 3, 2019

(65) Prior Publication Data

US 2021/0012715 A1 Jan. 14, 2021

(51) Int. Cl.
*G09G 3/3233* (2016.01)
*G09G 3/00* (2006.01)

(52) U.S. Cl.
CPC ..... *G09G 3/3233* (2013.01); *G09G 3/035* (2020.08); *G09G 2320/041* (2013.01); *G09G 2320/045* (2013.01); *G09G 2360/141* (2013.01); *G09G 2360/147* (2013.01)

(58) Field of Classification Search
CPC ..... G09G 3/035; G09G 3/3233; G09G 2320/041; G09G 2320/045; G09G 2360/141; G09G 2360/147
See application file for complete search history.

(56) References Cited

U.S. PATENT DOCUMENTS

| | | | | |
|---|---|---|---|---|
| 7,948,392 | B2 * | 5/2011 | Smith | G09G 3/3208 340/815.5 |
| 9,058,769 | B2 * | 6/2015 | Bert | G09G 3/3208 |
| 2003/0201727 | A1 | 10/2003 | Yamazaki et al. | |
| 2004/0070558 | A1 * | 4/2004 | Cok | G09G 3/3258 345/76 |
| 2005/0156831 | A1 | 7/2005 | Yamazaki et al. | |

(Continued)

FOREIGN PATENT DOCUMENTS

| | | | |
|---|---|---|---|
| JP | 2004-145257 | A | 5/2004 |
| JP | 2007-265850 | A | 10/2007 |

(Continued)

*Primary Examiner* — Mihir K Rayan
(74) *Attorney, Agent, or Firm* — ScienBiziP, P.C.

(57) ABSTRACT

A display device according to the disclosure includes a display unit including a plurality of electro-optical elements as display elements, luminance and transmittance of which are controlled by a current, a luminance measurement unit configured to measure luminance of the display elements of the display unit in a blocked state, and a correction value arithmetic operation unit configured to compensate a data signal provided to each of pixels of the display elements on the basis of a measurement result obtained by the luminance measurement unit. This enables accurate compensation in units of pixels.

16 Claims, 40 Drawing Sheets

(56) References Cited

U.S. PATENT DOCUMENTS

2008/0231562 A1* 9/2008 Kwon ..... G09G 3/3233 345/77
2008/0246606 A1 10/2008 Smith et al.
2009/0058772 A1* 3/2009 Lee ..... G09G 3/3233 345/82
2009/0081816 A1 3/2009 Yamazaki et al.
2009/0219521 A1* 9/2009 Shin ..... G02F 1/1309 356/239.2
2011/0075038 A1 3/2011 Yamazaki et al.
2011/0191042 A1 8/2011 Chaji et al.
2012/0120126 A1 5/2012 Yamazaki et al.
2012/0299987 A1 11/2012 Yamazaki et al.
2013/0314762 A1* 11/2013 Kwack ..... G09F 9/30 359/280
2014/0002430 A1* 1/2014 Kwack ..... G09G 3/3225 345/207
2014/0015824 A1 1/2014 Chaji et al.
2014/0292342 A1 10/2014 Chaji
2014/0306868 A1 10/2014 Chaji
2014/0313111 A1 10/2014 Chaji et al.
2015/0103106 A1 4/2015 Chaji et al.
2016/0307498 A1 10/2016 Chaji
2017/0011674 A1 1/2017 Chaji et al.
2017/0196102 A1* 7/2017 Shin ..... G06F 1/1607
2017/0309226 A1* 10/2017 In ..... G06F 1/1652
2017/0365201 A1 12/2017 Chaji et al.
2018/0137795 A1 5/2018 Chaji
2018/0158402 A1 6/2018 Chaji et al.
2018/0308405 A1 10/2018 Chaji et al.
2018/0366060 A1 12/2018 Chaji et al.
2019/0088211 A1 3/2019 Chaji
2019/0096301 A1 3/2019 Chaji
2019/0302851 A1* 10/2019 In ..... G06F 1/1652
2019/0333430 A1 10/2019 Chaji et al.

FOREIGN PATENT DOCUMENTS

JP 2007-333996 A 12/2007
JP 2008-175958 A 7/2008
JP 2009-511973 A 3/2009
JP 2013-519113 A 5/2013
JP 2013-242530 A 12/2013

* cited by examiner

DISPLAY DEVICE

TECHNICAL FIELD

The disclosure relates to a display device.

BACKGROUND ART

PTL 1 discloses techniques regarding a method for compensating degradation of an organic light emitting diode (OLED) panel. According to PTL 1, a decrease in luminous efficiency is predicted from electrical characteristics of the OLED panel by monitoring a current detected by an optical sensor mounted inside the OLED panel, degradation characteristics of display pixels are estimated, and compensation is thus performed.

CITATION LIST

Patent Literature

PTL 1: JP 2013-519113 T (Published on May 23, 2013)

SUMMARY

Technical Problem

However, in the case in which the optical sensor is provided inside the OLED panel, a problem that direct measurement of all pixels cannot be performed and accurate compensation cannot be performed in units of pixels occurs.

An object of an aspect of the disclosure is to realize a display device capable of performing accurate compensation in units of pixels.

Solution to Problem

According to an aspect of the disclosure, there is provided a display device including, a display unit including a plurality of display elements, a detection unit configured to detect characteristics of the display elements of the display unit in a blocked state, and a signal compensation unit configured to compensate a data signal provided to each of pixels of the display elements on the basis of a detection result obtained by the detection unit.

Advantageous Effects of Disclosure

According to the display device of the disclosure, it is possible to perform accurate compensation in units of pixels.

DESCRIPTION OF EMBODIMENTS

First Embodiment

An embodiment of the disclosure will be described below.

Overview of Display Device 1

Figure 1:
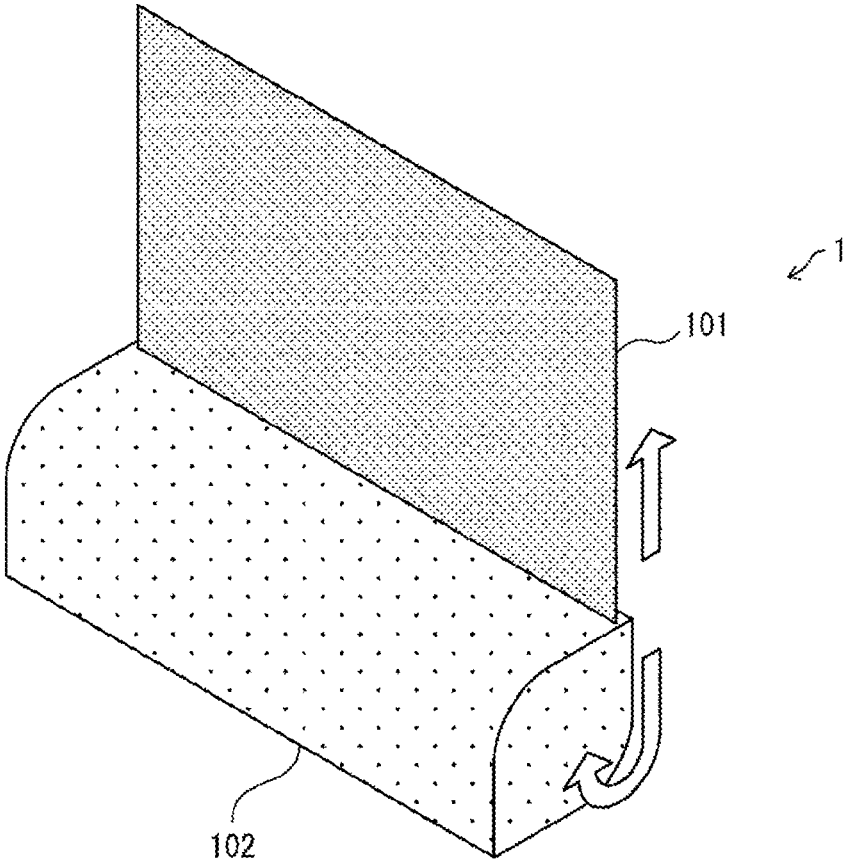
FIG. 1 is a schematic perspective view of a display device according to a first embodiment of the disclosure.

FIG. 1 is a schematic perspective view of a display device 1 according to the present embodiment.

The display device 1 includes a display unit 101 and an accommodation unit 102 configured to accommodate the display unit 101. The display unit 101 is a flexible sheet display (OLED) in which organic light emitting diode (OLED) elements (display elements) are disposed in a matrix shape. In this manner, in the display device 1, the display unit 101 is accommodated in the accommodation unit 102 that is a case body at a lower portion while rolled, and the display unit 101 is pulled (taken) out of the accommodation unit 102 for viewing. In other words, the display device 1 is a roll accommodation-type display device. Also, the accommodation unit 102 is also a blocking mechanism configured to bring a display area of the display unit 101 into a blocked state by rolling the display unit 101, winding a part of the rolled display unit 101 as a rolled area inside the accommodation unit 102, and accommodating the remaining part as an unrolled area.

In the present embodiment, degradation compensation for OLEDs used in the display unit 101 in a roll accommodation-type display device as illustrated in FIG. 1 will be described.

Typically, it is necessary to detect a) the amount of decrease in currents flowing through drive TFTs, b) the amount of decrease in currents flowing through the OLEDs, and c) luminous efficiency of the OLED elements in order to ascertain a state of temporal degradation of the OLEDs.

a) and b) are realized by providing, for the display unit, a configuration applying a certain voltage to a drive TFT and an OLED element of each pixel and monitoring a current value at that time. However, when the OLED elements are monitored, it is necessary to perform detection at a timing at which viewability of a user is not affected since the OLEDs emit light.

Although estimation of a decrease in c) luminous efficiency from b) the amount of decrease in current is also conceivable, measurement of light emission luminance in units of pixels is ideal in order to perform faithful compensation. In the present embodiment, light emission luminance is measured in units of pixels.

Further, monitoring/measurement values in a) to c) are affected by environmental states such as a display temperature. It is also necessary to observe a temperature at monitoring/measuring timings at the same time for comparison with an initial state (before degradation). The temperature sensor may be provided in a back face of the display unit, or a plurality of temperature sensors may be placed at positions at which the temperature sensors face the back face of the display of the accommodation unit such that a temperature can partially be measured.

Luminance Sensor 103, Temperature Sensor 104

Figure 2:
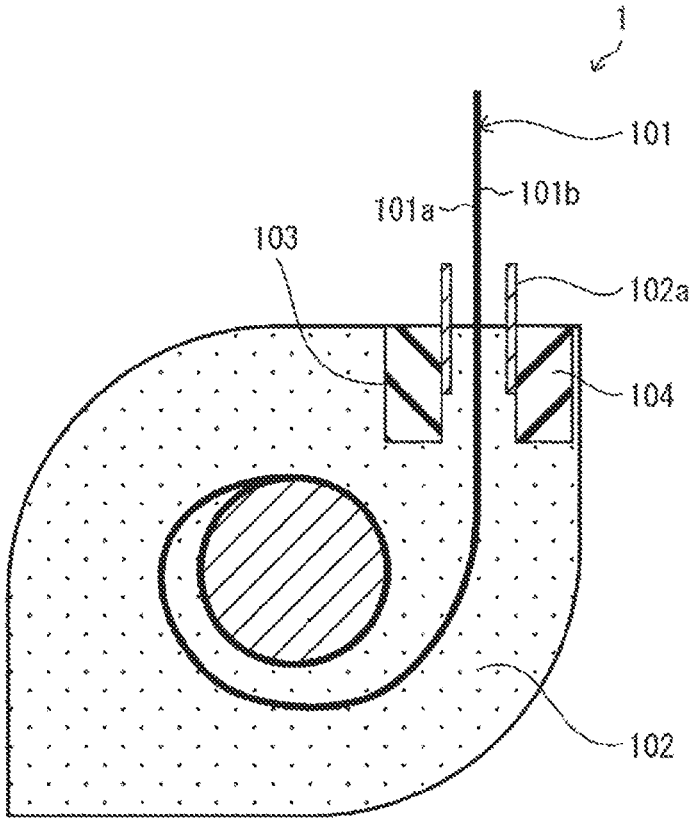
FIG. 2 is a cross-sectional view illustrating an example of an internal configuration of an accommodation unit illustrated in FIG. 1.
Figure 3:
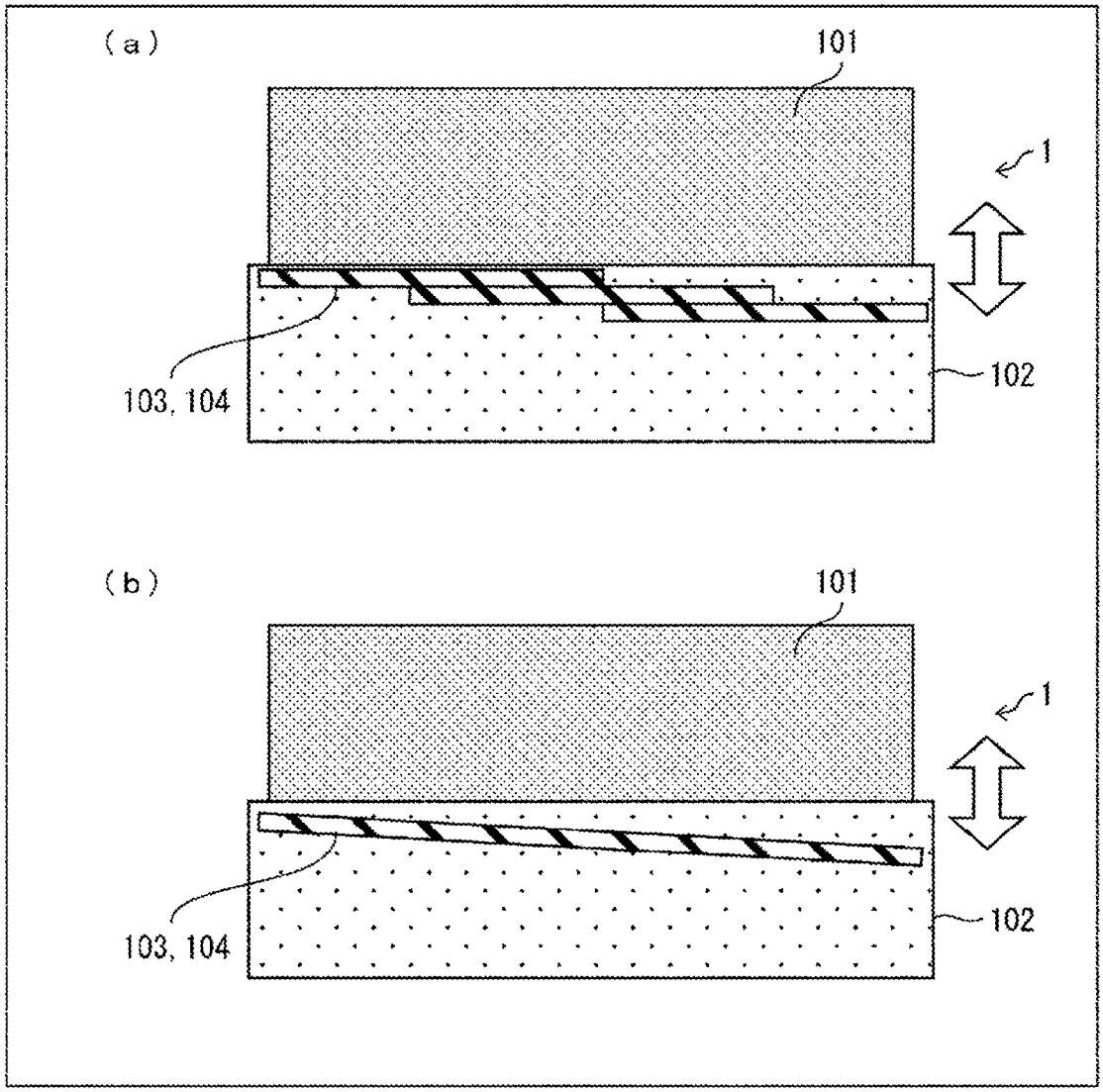
FIG. 3 is a diagram illustrating a position where luminance/temperature sensors are disposed.

FIG. 2 is a cross-sectional view illustrating an example of an internal configuration of the accommodation unit 102 illustrated in FIG. 1. FIG. 3 is a diagram illustrating a position where luminance/temperature sensor are disposed.

As illustrated in FIG. 2, the display device 1 is configured such that a luminance sensor 103 for measuring luminance of one horizontal line in the unrolled area in the accommodation unit 102 of the display unit 101 is placed on the side of a display surface 101*a*, and a temperature sensor 104 for measuring a temperature of one horizontal line of the display unit 101 is placed on the side of a display back face 101*b*, on the display unit accommodation port 102*a* provided at upper portion of the accommodation unit 102. Here, the luminance sensor 103 and the temperature sensor 104 are configured of line sensors corresponding to one horizontal line of pixels.

The luminance and temperature are measured for each pixel in synchronization with a line unit of the display unit 101 when the display unit 101 is accommodated (wound) or when the display unit is activated (pulled out (taken out)).

When the luminance is measured, a freely-selected voltage is sequentially (for each pixel) applied to the OLED element, a value of a current flowing through the OLED element is monitored, and light emission luminance is also measured by the luminance sensor 103 at a timing at which a certain pixel line of the display unit 101 reaches a display unit accommodation port 102*a*. At this time, it is not necessary for the luminance sensor 103 to have a resolution in units of single pixels since pixels emitting light sequentially lights up one by one.

Further, the temperature is also measured by the temperature sensor 104 from the side of the display back face 101*b* at the timing of monitoring the current and measuring the luminance. Although temperature measurement for each pixel is ideal, the measurement may be performed in a slightly larger area including a plurality of pixels since it is expected that no large temperature difference occurs among the pixels.

The aforementioned measurement is performed at a portion where the display unit 101 is located inside the accommodation unit 102, that is, a portion in a blocked state. Thus, it is necessary for the accommodation unit 102 of the winding type to perform the aforementioned measurement when the accommodation/deployment operation of the display unit 101 is being performed. Therefore, in a case in which the measurement cannot be performed in time in terms of the speed, the luminance sensor 103 and the temperature sensor 104 are not limited to one-line sensors, and the luminance sensor 103 (temperature sensor 104) may be configured of a plurality of lines as illustrated in (a) of FIG. 3. Alternatively, the line sensors may be placed in a state in which the line sensors are obliquely inclined in accordance with the accommodation/deployment operation of the display unit 101 as illustrated in (b) of FIG. 3, rather than placing the line sensors horizontally.

Correction value arithmetic operation processing when the display unit 101 is accommodated/deployed may be performed both at the time of the accommodation and at the time of the deployment or may be performed only at one of the time of the accommodation and the time of the deployment.

Here, the temperature is high in the state at the time of the accommodation since the OLED elements of the display unit 101 have been lit up for a while. Alternatively, temporary variations in temperature occur depending on details of display (high/low luminance, stationary image/moving image) of the display unit 101.

On the other hand, the temperature is low, and temporary variations do not occur in the state at the time of the deployment since the OLED elements of the display unit 101 have been turned off for a while in the accommodation unit 102.

Also, the measurement for the correction value arithmetic operation processing is preferably performed at a temperature that is as close as possible to a temperature at the time of ordinary use, but temporary variations thereof due to influences of display are preferably excluded as much as possible.

Thus, although it is preferable to perform the measurement in both the states in consideration of the temporary variations due to influences of display, the measurement may be performed by placing priority on the one with greater influence.

System Configuration

Figure 4:
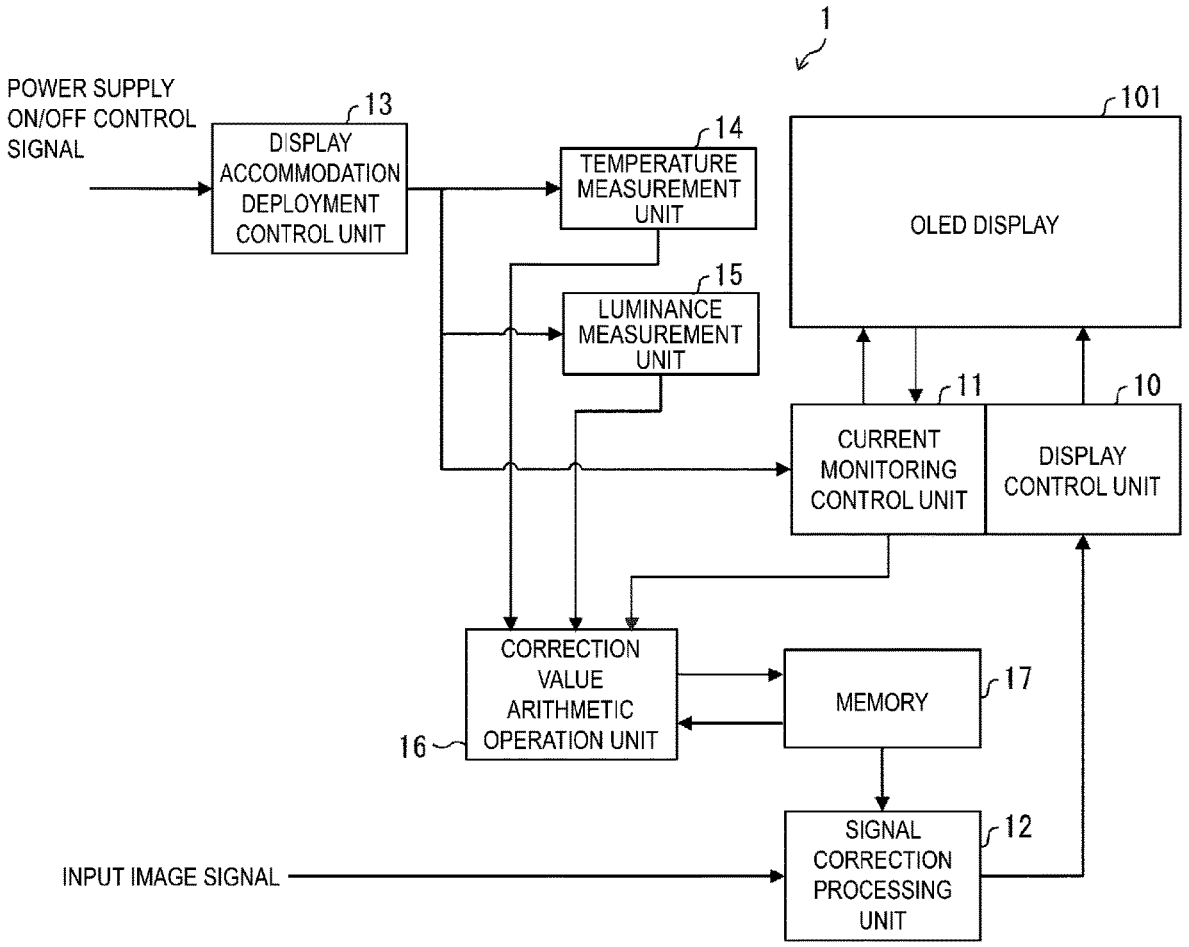
FIG. 4 is a block diagram illustrating an example of a system configuration for realizing OLED degradation compensation in the display device illustrated in FIG. 1.

FIG. 4 is a block diagram illustrating an example of a system configuration for realizing OLED degradation compensation in the display device 1.

The display device 1 includes a display control unit 10, a current monitoring control unit (detection unit) 11, a signal correction processing unit 12, a display accommodation deployment control unit 13, a temperature measurement unit (detection unit) 14, a luminance measurement unit (detection unit) 15, a correction value arithmetic operation unit (signal compensation unit) 16, and a memory (storage unit) 17.

At the time of ordinary image display, an input image signal is corrected into an image signal with degradation compensated by the signal correction processing unit 12, and an image is displayed on the display unit 101 via the display control unit 10. Here, the signal correction processing unit 12 reads a parameter for correction for each pixel saved in the memory 17 and corrects the input image signal on the basis of the parameter. The temperature measurement unit 14 is connected to the temperature sensor 104 and measures the temperature from a detection value obtained by the temperature sensor 104. The luminance measurement unit 15 is connected to the luminance sensor 103 and measures luminance from a detection value obtained by the luminance sensor 103.

In the present embodiment, the OLED elements and a pixel circuit for external compensation including drive TFTs (drive transistors) configured to drive the OLED elements and a monitoring control transistor for monitoring drive states of the OLED elements and the drive TFTs are formed in the display unit 101. The monitoring control transistor is controlled by the current monitoring control unit 11.

Thus, in a case in which a power supply of the display device 1, which is not illustrated, is turned ON/OFF, the display unit 101 is accommodated (wound) or activated (pulled out) by the display accommodation deployment control unit 13, the current monitoring control unit 11 turns on the monitoring control transistor in the pixel circuit in the display unit 101 to measure currents flowing through the drive TFTs and the OLED elements, and measurement of light emission luminance of the OLED elements performed by the luminance measurement unit 15 and measurement of the temperature of the display unit 101 performed by the temperature measurement unit 14 are thus performed. Here, a signal in accordance with a progress status of accommodation/deployment is transmitted from the display accommodation deployment control unit 13 to each measurement unit, and voltage application (light emission) and measurement of the OLED elements are performed in synchronization with the signal.

Note that as monitoring performed by the current monitoring control unit 11, voltage/current monitoring is ideally individually performed for the drive TFTs and the OLED elements. However, the currents flowing through both the drive TFTs and the OLED elements may be collectively monitored.

Also, luminance measurement of the OLED elements performed by the luminance measurement unit 15 is ideally performed at the same time as the voltage/current monitoring of the OLED elements performed by the current monitoring control unit 11.

The correction value arithmetic operation unit 16 acquires a current value, a luminance value, and a temperature value of each pixel from each measurement unit (the temperature measurement unit 14 and the luminance measurement unit 15), acquires measurement values (such as initial data) in the past from the memory 17, and performs an arithmetic operation for a new correction parameter for each pixel on the basis of such data. The data obtained through the arithmetic operation is saved again in the memory 17 and is used as a later correction parameter at the time of ordinary display.

Current Characteristics and Luminance Characteristics of OLEDs

Figure 5:
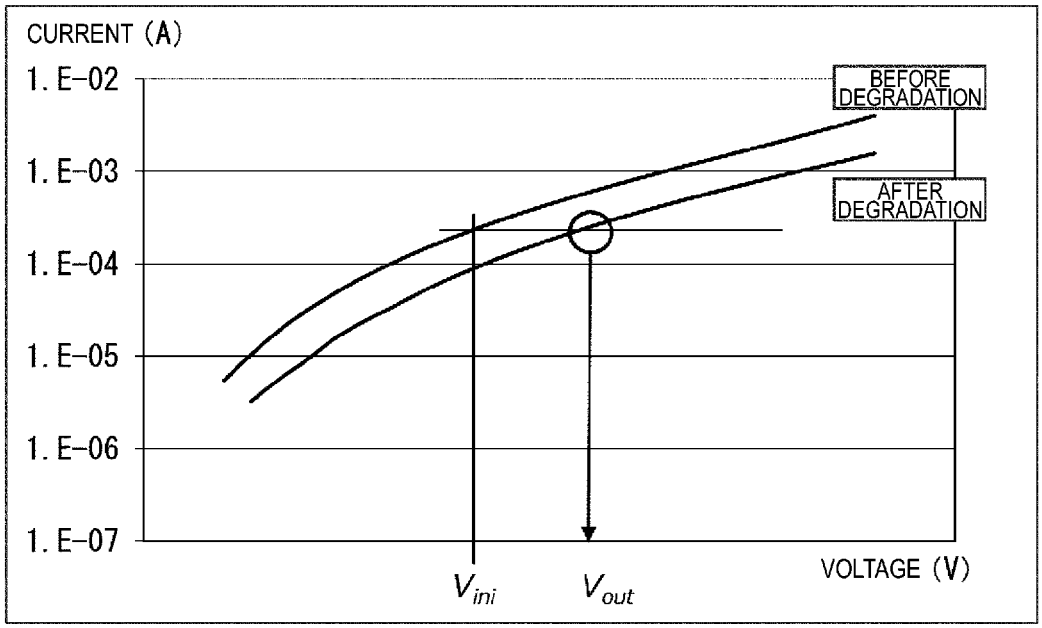
FIG. 5 is a graph illustrating a data example before and after degradation of voltage-current characteristics of OLED elements.

FIG. 5 is a graph illustrating a data example before and after degradation of voltage-current characteristics of the OLED elements.

Figure 6:
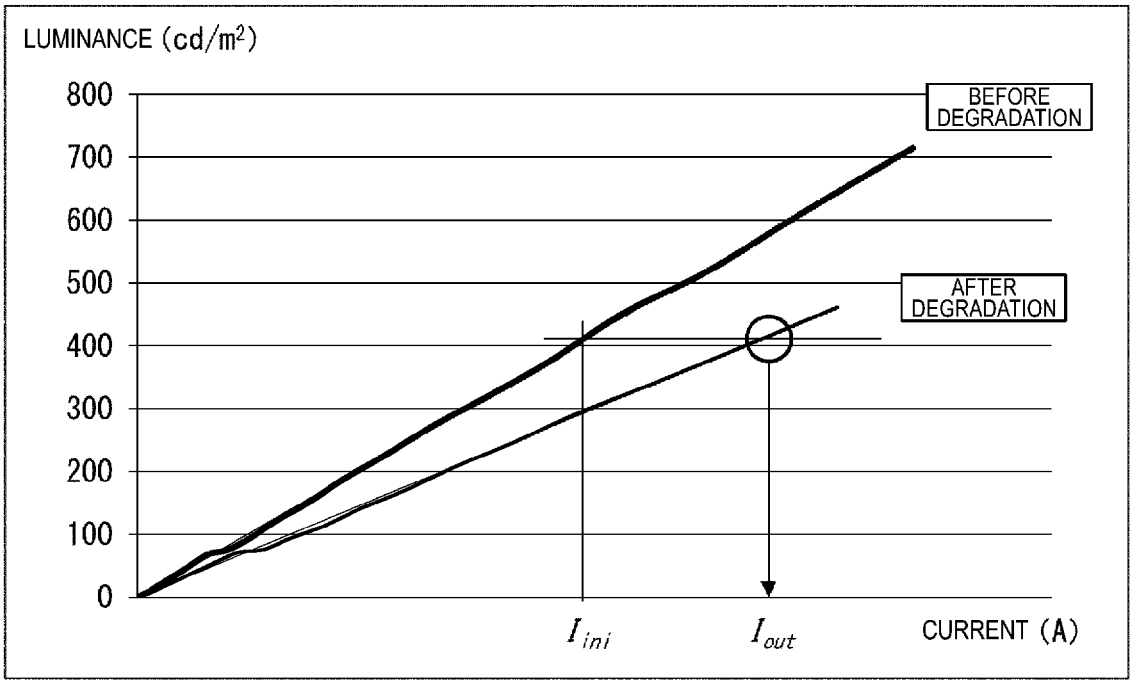
FIG. 6 is a graph illustrating a data example before and after degradation of current-luminance characteristics of the OLED elements.

FIG. 6 is a graph illustrating a data example before and after degradation of current-luminance characteristics of the OLED elements.

The graph illustrated in FIG. 5 is a graph in which the vertical axis is represented by logarithmic notation for clearly showing a difference of low gray scale.

It is possible to ascertain that with degradation of the OLED elements, a current does not flow even if the same voltage is applied from the graph illustrated in FIG. 5 and light emission luminance decreases even if the same current is caused to flow from the graph illustrated in FIG. 6.

For the voltage-current characteristics illustrated in FIG. 5, a current value when a freely-selected voltage is applied is monitored, and a present degradation state is predicted on the basis of this value, thereby calculating a correction voltage value (Vout). A high voltage is set for causing a current in the same level as that in an initial state before degradation to flow.

For the current-luminance characteristics illustrated in FIG. 6, a luminance value when a freely-selected current is caused to flow is acquired from the luminance measurement sensor, and a present degradation state is predicted on the basis of this value, thereby calculating a correction current value (Iout). A high current is set for outputting luminance at the same level as that in the initial state before degradation. Since the correction current value (Iout) is a value before correction of the voltage-current characteristics illustrated in FIG. 5, the correction voltage value (Vout) illustrated in FIG. 5 and the correction current value in FIG. 6 are merged to calculate a voltage setting value as a target in practice. This calculation is performed by the correction value arithmetic operation unit 16.

The correction value may be configured as a look-up table that outputs a corrected voltage in response to an input gray-scale signal (=gray-scale voltage), or an arithmetic expression may be generated, and the corrected voltage may be calculated every time from the input gray-scale signal.

Degradation Compensation Processing (1) for OLED Elements

Figure 7:
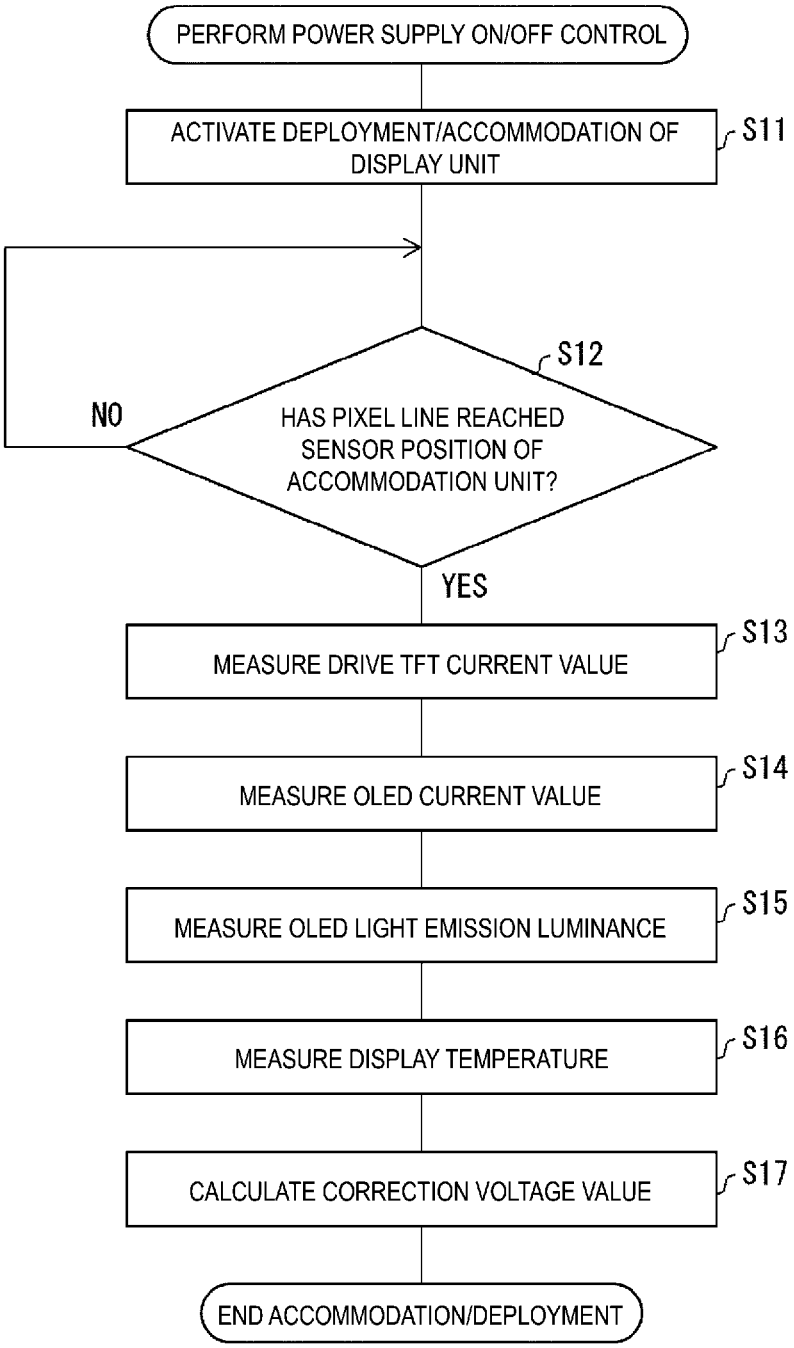
FIG. 7 is a flowchart illustrating an example of a flow of degradation compensation processing for the OLED elements.
Figure 8:
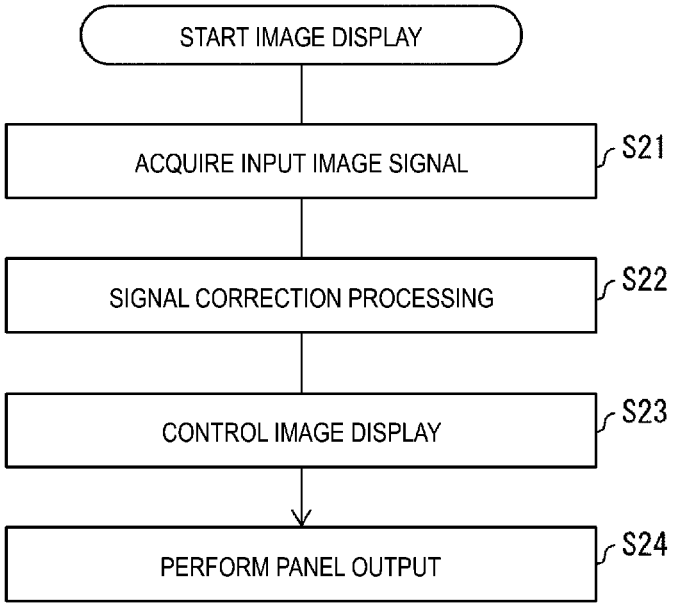
FIG. 8 is a flowchart illustrating a flow of image display processing performed by the display device.

FIG. 7 is a flowchart illustrating an example of a flow of degradation compensation processing for the OLED elements. FIG. 8 is a flowchart illustrating a flow of image display processing performed by the display device 1. Note that a correction voltage value generated by the flowchart illustrated in FIG. 7 is used in image processing illustrated in FIG. 8.

First, when an operation of turning ON/OFF the power supply is performed, deployment/accommodation of the display unit 101 is activated as illustrated in FIG. 7 (Step S11).

Next, whether or not a pixel line of the display unit 101 has reached a detection position in the accommodation unit 102 is determined (Step S12). Here, the position is detected by a position detection sensor configured to detect the position of an object, such as an infrared sensor, inside the accommodation unit 102. In Step S12, the processing proceeds to Step S13 to measure current values of the drive TFTs when the determination is Yes. Subsequently, the current value of the OLED elements is measured (Step S14), luminance of light emitted by the OLED elements is measured (Step S15), and the temperature of the display is measured (Step S16). In other words, the values of the currents flowing through the drive TFTs when a monitoring voltage is applied to the drive TFTs are measured at a timing at which the pixel line of the display unit 101 arrives at (reaches) the position of the detection performed by the luminance or temperature sensor, the value of the currents flowing through the OLED elements when a monitoring voltage is applied to the OLED elements is measured, the luminance of the light emitted by the OLED elements is further measured by the luminance sensor, and the temperature of the back face of the display is measured by the temperature sensor. Although all of these are ideally acquired at the same time, they may be alternately acquired with a time difference in units of lines in a case in which they cannot be acquired at the same time. Also, in a case in which it is difficult to acquire these for each line of pixels, the temperature, for example, may be acquired in a wider area including several lines.

After the aforementioned data is acquired, a correction voltage value is calculated on the basis of the value, measurement data in the past obtained from the memory, and a correction calculation result in the past (Step S17), and a calculation result is then saved in the memory 17.

Thereafter, the deployment/accommodation of the display unit 101 ends.

After the display unit 101 is deployed, display is switched to ordinary image display, an input image signal is acquired (Step S21), signal correction processing is performed on the input image signal (Step S22), the image display control is performed using the correction value obtained through the signal correction processing (Step S23), and the image display control signal is output to a panel, that is, the display unit 101, as illustrated in FIG. 8. Here, in the signal correction processing in Step S22, the correction value is read from the memory 17, and an output signal to be output to the display unit 101 is calculated on the basis of an input signal level of the input image signal and a correction value (parameter) corresponding to each pixel.

Degradation Compensation Processing (2) for OLED Elements

Figure 9:
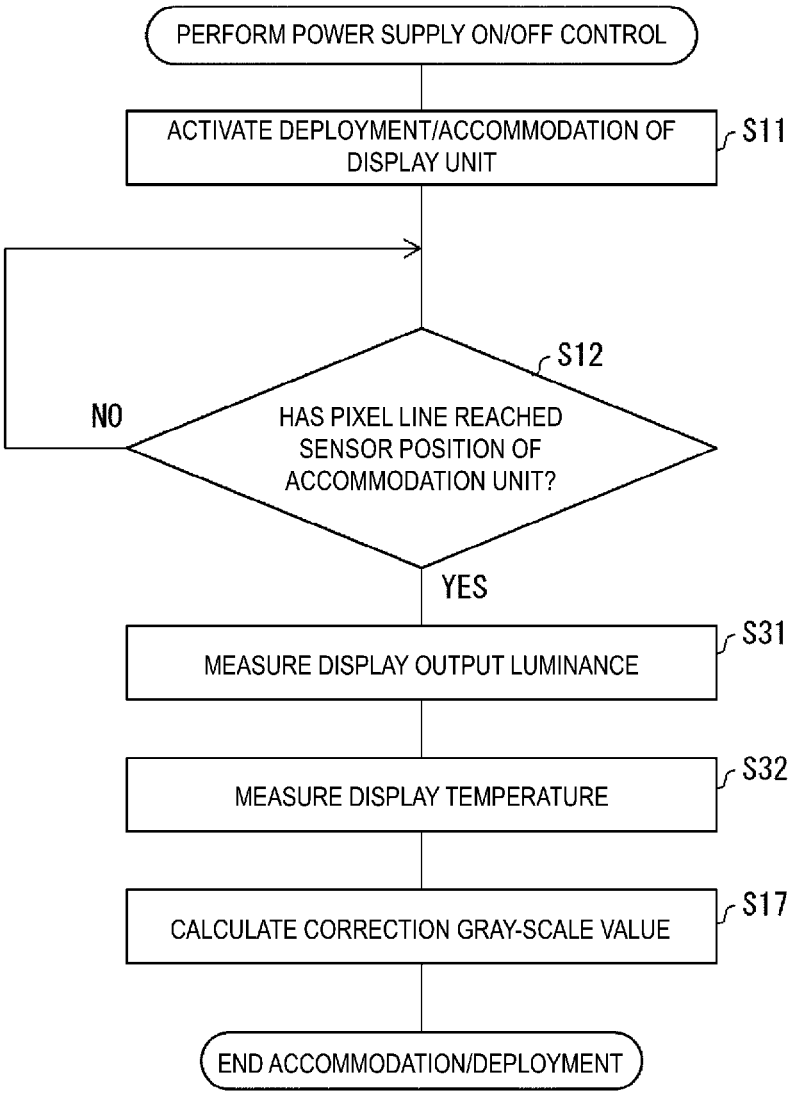
FIG. 9 is a flowchart illustrating another example of a flow of degradation compensation processing for the OLED elements.

FIG. 9 is a flowchart illustrating another example of a flow of degradation compensation processing for the OLED elements. The flowchart illustrated in FIG. 9 is different from the flowchart illustrated in FIG. 7 in that current monitoring for the drive TFTs and the OLED elements is not performed and the correction is performed on the basis of final output luminance obtained by the luminance sensor and a panel temperature. In the flowchart illustrated in FIG. 9, the same step numbers are applied to the same processing as that in the flowchart illustrated in FIG. 7.

First, when an operation of turning ON/OFF the power supply is performed, deployment/accommodation of the display unit 101 is activated as illustrated in FIG. 7 (Step S11).

Next, whether or not a pixel line of the display unit 101 has arrived at the sensor position of the accommodation unit 102 is determined (Step S12). When the determination is Yes here, the processing proceeds to Step S31, and display output luminance is measured. Subsequently, a display temperature is measured (Step S32). In other words, the display output luminance and the display temperature are acquired at the timing at which the pixel line of the display unit 101 arrives at (reaches) the detection position of the luminance or temperature sensor.

The display output luminance is measured by the luminance sensor 103 by sequentially causing each one of pixels of the OLED elements to light up with a freely-selected gray-scale signal.

The display temperature is measured by the temperature sensor 104 in units of pixels or one line of the OLED elements. Note that in a case in which it is difficult to acquire the temperature in units of pixels or one line of the OLED elements, the temperature may be acquired in a wide area including several lines.

After the aforementioned data is acquired, a correction value of the gray-scale signal is calculated to achieve a target luminance by comparing the acquired luminance value with target luminance with a freely-selected gray-scale signal and in consideration of influences of the temperature on the luminance (Step S17), and the calculated correction value is saved in the memory 17.

Thereafter, the deployment/accommodation of the display unit 101 ends.

After the display unit is deployed, the display is switched to ordinary image display, an input image signal is acquired (Step S21), signal correction processing is performed on the input image signal (Step S22), image display control is performed with the correction value obtained through the signal correction processing (Step S23), and an image display control signal is output to the panel, that is, the display unit 101, as illustrated in FIG. 8 described above. Here, in the signal correction processing in Step S22, the correction value is read from the memory 17, and an output signal to be output to the display unit 101 is calculated on the basis of an input signal level of the input image signal and a correction value (parameter) corresponding to each pixel.

Since the processing illustrated in FIG. 9 is processing in which the OLED elements are caused to emit light, the processing is correction including that of the electrical characteristics and the optical characteristics of the drive TFTs and the OLED elements of the display unit 101. The processing can easily be performed without need of any configuration or processing for monitoring each current.

Further, it is possible to correct not only degradation of OLED elements but also chromaticity shift, in-plane variations, and the like.

Advantageous Effects

With the aforementioned configuration, it is possible to more precisely compensate degradation and to improve display quality of the display unit 101 in any utilization state, by measuring the light emission luminance of the OLED elements or measuring the temperature of the display unit 101 while measuring (current monitor) the electrical characteristics of each of the pixels of the OLED elements that are display elements of the display unit 101.

Also, since the luminance sensor and the temperature sensor are not provided directly in the display unit 101, it is possible to curb an increase in manufacturing costs and a decrease in yield of the display as compared with a scheme in which an optical sensor is provided in the pixels of the display to measure light emission luminance in units of pixels as in the prior related art.

Hereinafter, other forms of the display device 1 described in the present embodiment will be described.

Example 1

Figure 10:
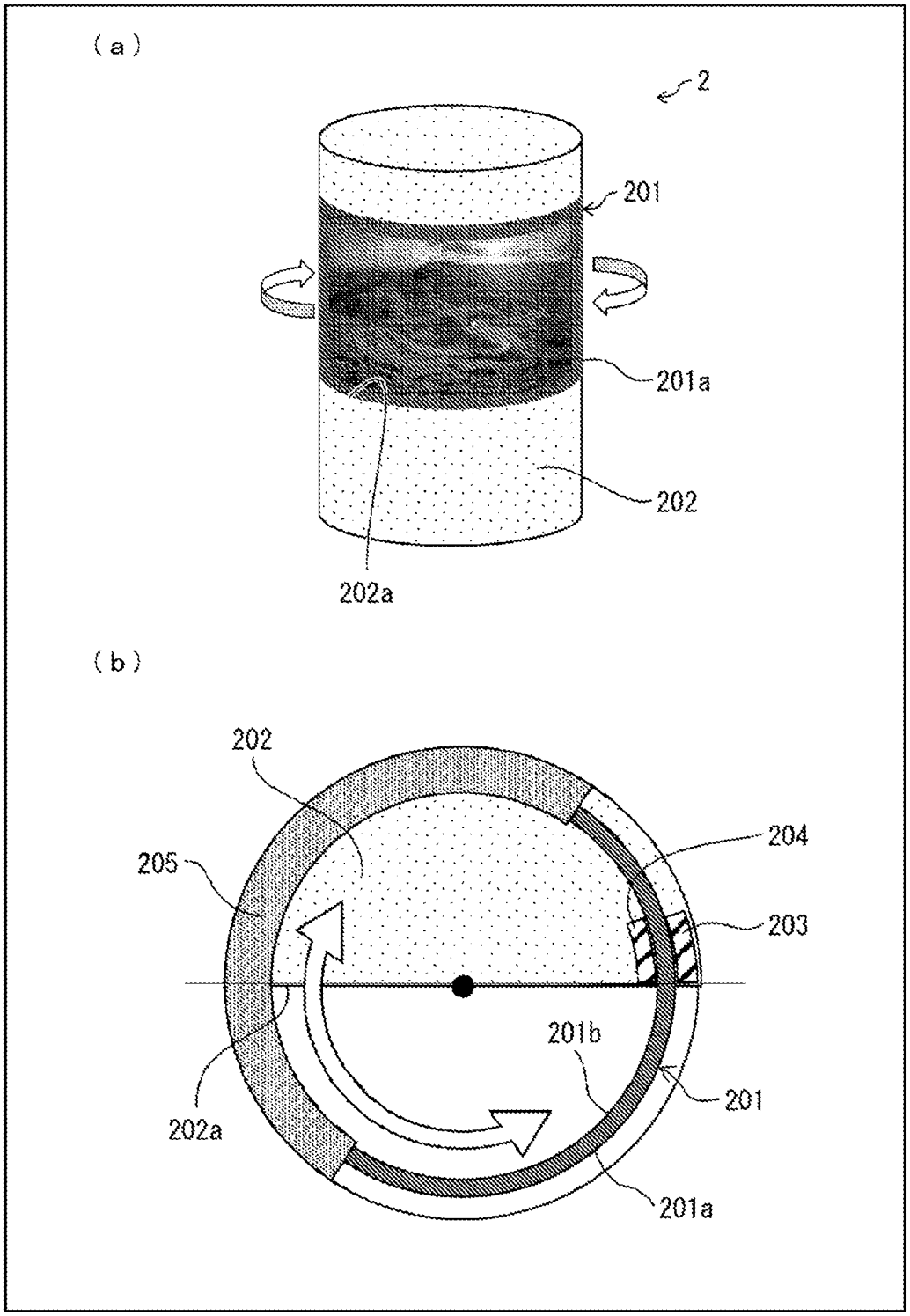
FIG. 10 is a schematic configuration diagram of a display device in Example 1.

FIG. 10 is a schematic configuration diagram of a display device 2 in this example.

The display device 2 is used by turning a display unit 201 that is a curved face and includes OLED elements in a state in which the display unit 201 is accommodated in a columnar accommodation unit 202, as illustrated in (a) of FIG. 10. An opening 202*a* is formed in a front face of the columnar accommodation unit 202 to expose a viewable area 201*a* of the accommodated display unit 201.

The display unit 201 is connected to a movable part 205 configured to freely turn in the columnar accommodation unit 202 as illustrated in (b) of FIG. 10. In other words, the display unit 201 also turns in the columnar accommodation unit 202 by the movable part 205 turning in the columnar accommodation unit 202. In this manner, the display device 2 can expose (deploy) the viewable area 201*a* and accommodate the viewable area 201*a* by turning the display unit 201 inside the columnar accommodation unit 202.

Also, a luminance line sensor 203 and a temperature line sensor 204 are provided at an inlet portion of the columnar accommodation unit 202 in which the display unit 201 is accommodated. The luminance line sensor 203 is placed on the side of the viewable area 201*a* of the display unit 201, and the temperature line sensor 204 is placed on the side of a back face 201*b* of the display unit 201.

In the display device 2 with the aforementioned configuration, light emission luminance in units of pixels of the OLED elements of the display unit 201 and a display temperature at that time are measured respectively by the luminance line sensor 203 placed on the side of the viewable area 201*a* of the display unit 201 near the inlet portion of the columnar accommodation unit 202 and the temperature line sensor 204 placed on the side of the back face 201*b* of the display unit 201 when the display unit 201 is accommodated in or deployed from the columnar accommodation unit 202, thereby calculating a correction parameter for compensating the OLED elements, similarly to the first embodiment.

Example 2

Figure 11:
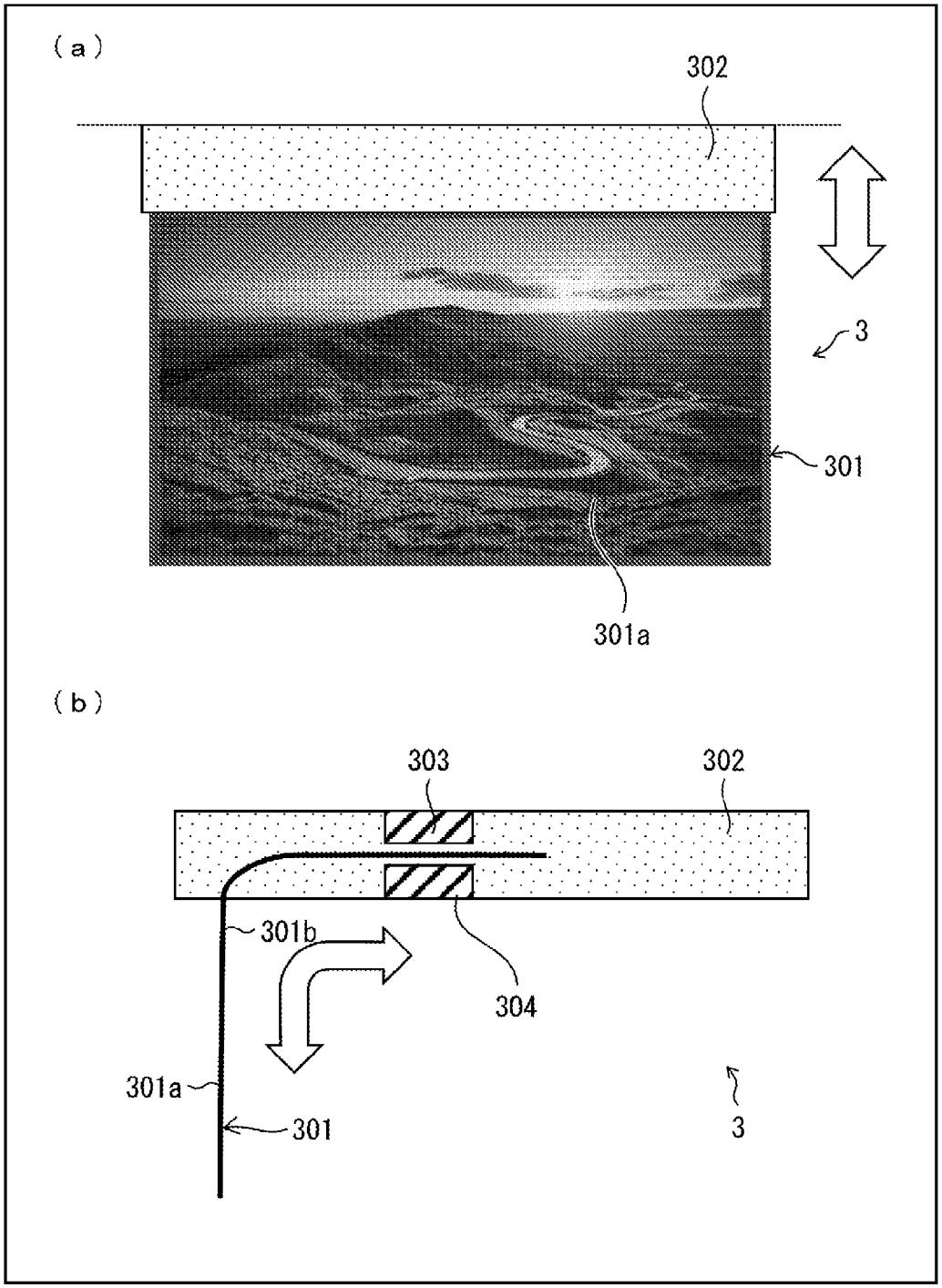
FIG. 11 is a schematic configuration diagram of a display device in Example 2.

FIG. 11 is a schematic configuration diagram of a display device 3 in this example.

In the display device 3, a display unit 301 that is a curved face and includes OLED elements is accommodated in an accommodation unit 302 placed on the ceiling as illustrated in (a) of FIG. 11. The accommodation unit 302 is configured for the display unit 301 to be pulled into and accommodated in it as illustrated in (b) of FIG. 11. A viewable area 301*a* is exposed in a state in which the display unit 301 is pulled out of the accommodation unit 302.

A luminance line sensor 303 and a temperature line sensor 304 are provided near a portion where the display unit 301 is pulled into the accommodation unit 302, as illustrated in (b) of FIG. 11. The luminance line sensor 303 is placed on the side of the viewable area 301*a* of the display unit 301, and the temperature line sensor 304 is placed on the side of a back face 301*b* of the display unit 301.

In the display device 3 with the aforementioned configuration, light emission luminance in units of pixels of the OLED elements of the display unit 301 and a display temperature at that time are measured respectively by the luminance line sensor 303 placed on the side of the viewable area 301*a* of the display unit 301 near the inlet portion of the accommodation unit 302 and the temperature line sensor 304 placed on the side of the back face 301*b* of the display unit 301 when the display unit 301 is accommodated in or deployed from the accommodation unit 302, thereby calculating a correction parameter for compensating the OLED elements, similarly to Example 1.

In the display device 3 with the aforementioned configuration, the display unit 301 is accommodated inside the accommodation unit 302 while being folded horizontally. This form is different from the roll-type accommodation unit described in the first embodiment in that the luminance line sensor 303 and the temperature line sensor 304 do not need to be provided near the inlet of the accommodation unit 302 in which the display unit 301 is accommodated, do not need to have narrow widths, and may be placed at the furthest positions in the accommodation unit 302, and wide sensors may be used.

Example 3

Figure 12:
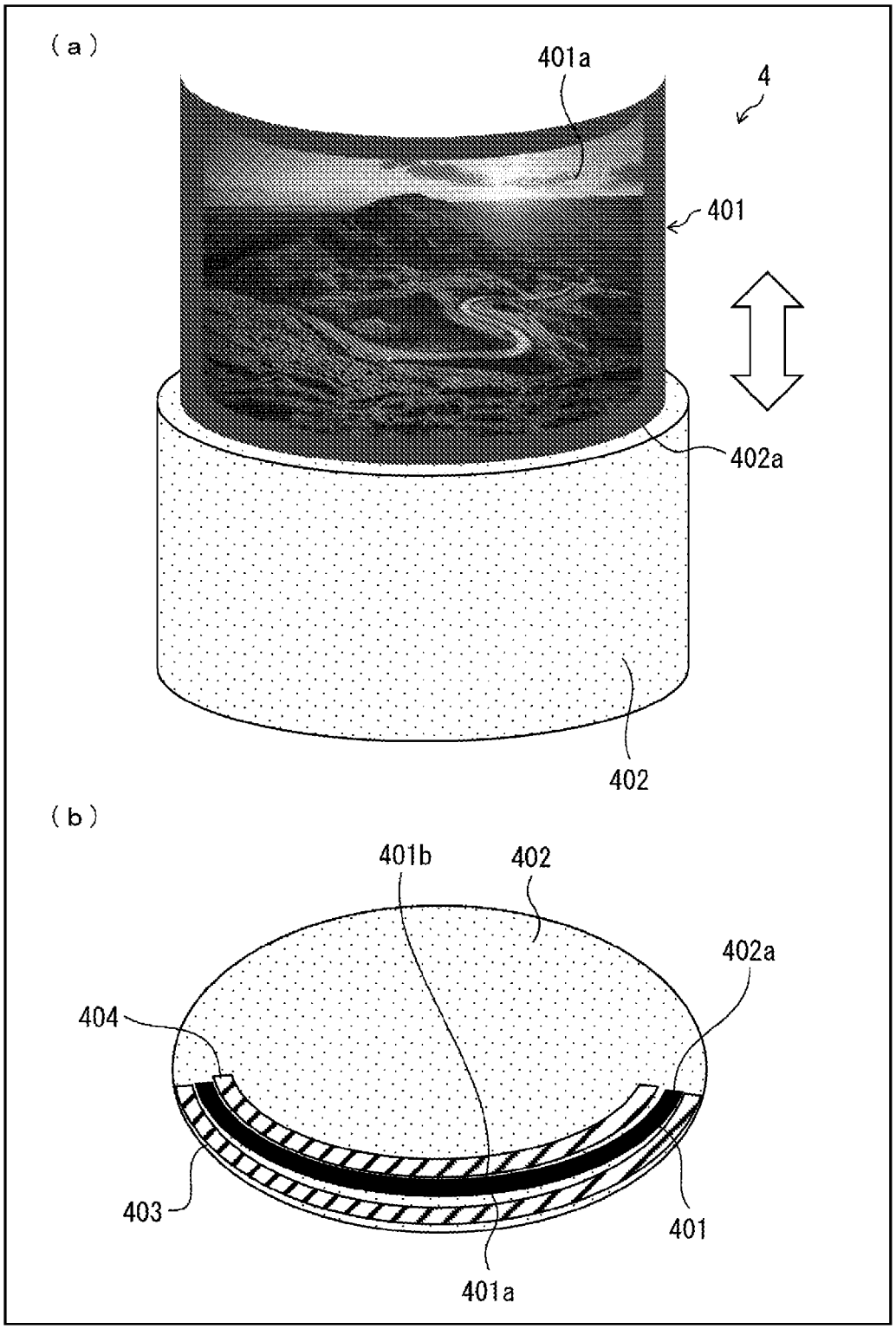
FIG. 12 is a schematic configuration diagram of a display device in Example 3.

FIG. 12 is a schematic configuration diagram of a display device 4 in this example.

The display device 4 is configured such that a display unit 401 that is a curved face and includes OLED elements is accommodated in a columnar accommodation unit 402 as illustrated in (a) and (b) of FIG. 12. The display unit 401 is accommodated inside the accommodation unit 402 from an opening portion 402*a*, and a viewable area 401*a* is exposed in a state in which the display unit 401 is pulled out of the opening portion 402*a* of the accommodation unit 402.

A luminance line sensor 403 and a temperature line sensor 404 are provided in the vicinity of the opening portion 402*a* of the display unit 401 in the accommodation unit 402 as illustrated in (b) of FIG. 12. The luminance line sensor 403 is placed on the side of the viewable area 401*a* of the display unit 401, and the temperature line sensor 404 is placed on the side of a back face 401*b* of the display unit 401.

In the display device 4 with the aforementioned configuration, light emission luminance in units of pixels of OLED elements of the display unit 401 and a display temperature at that time are measured respectively by the luminance line sensor 403 placed on the side of the viewable area 401*a* of the display unit 401 near the opening portion 402*a* of the accommodation unit 402 and the temperature line sensor 404 placed on the side of a back face 401*b* of the display unit 401 when the display unit 401 is accommodated in or deployed from the accommodation unit 402, thereby calculating a correction parameter for compensating the OLED elements, similarly to Example 1.

In the display device 4 with the aforementioned configuration, the display unit 401 that is a curved face moves in the up-down direction relative to the accommodation unit 402 without any change in the form and is then accommodated/deployed. Thus, the positions where the luminance line sensor 403 and the temperature line sensor 404 are placed are not limited to the positions near the opening portion 402*a* of the accommodation unit 402, and the luminance line sensor 403 and the temperature line sensor 404 may be placed at any positions in the vertical direction, similarly to the case of Example 2. In terms of the sizes of the sensors, sensors that are wide in the vertical direction may be used.

Although Example 3 has been described using the display unit 401 that is a curved face, no such limitation is intended, and a planar display unit may be used, or a display with a more complicated shape (a wave shape, for example) may be used.

Advantageous Effects of Examples 1 to 3

In addition to the fact that effects that are similar to those of the first embodiment are obtained, there is also an effect that the positions at which the line sensors for measurement (the luminance line sensor and the temperature line sensor) are placed are not limited to the positions near the accommodation port of the accommodation unit and design with a higher degree of freedom can be employed.

Note that, although the example in which the measurement for an arithmetic operation for correction is performed at the timing of the accommodation or the deployment of the display unit has been described in the first embodiment and Examples 1 to 3, an example in which luminance/temperature line sensors are movable in the accommodation unit while measurement is performed after the display unit is accommodated will be described in Examples 4 to 7 below.

Example 4

Figure 13:
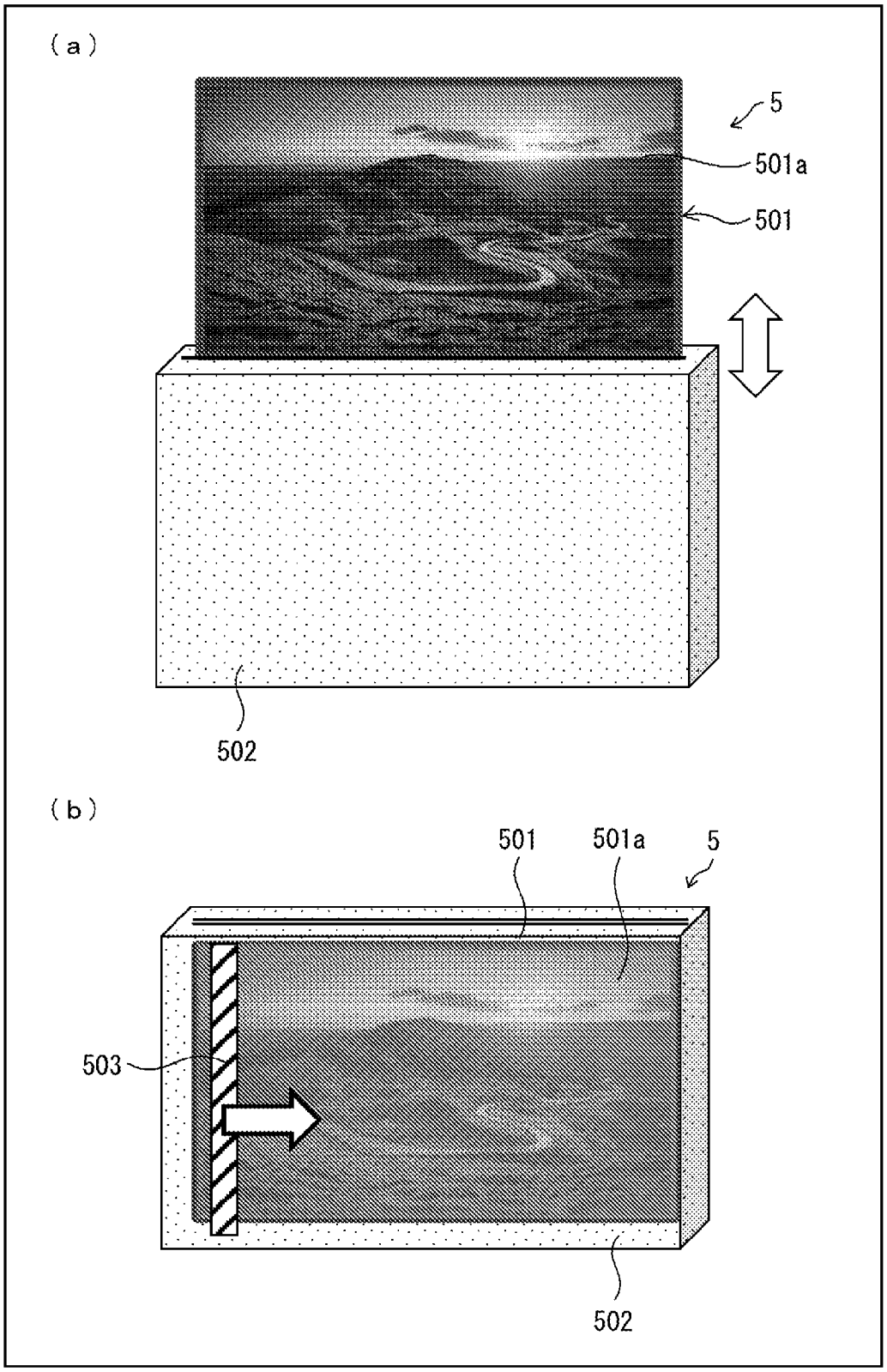
FIG. 13 is a schematic configuration diagram of a display device in Example 4.

FIG. 13 is a schematic configuration diagram of a display device 5 in this example.

The display device 5 is configured such that a display unit 501 is accommodated as a flat face without any change in an accommodation unit 502 at a lower portion, and when the display unit 501 is retracted in an accommodation unit 502, luminance and a temperature are measured in units of pixels of the OLED elements in a viewable area 501*a* of the display unit 501 with a movable luminance line sensor 503 placed inside the accommodation unit 502 moving in the left-right direction or the up-down direction, as illustrated in (a) and (b) of FIG. 13.

In this case, it is not necessary to measure the luminance and the temperature when the display unit 501 is accommodated or deployed, and it is possible to take time to measure the luminance and the temperature after a certain period of time elapses after a power supply of the display device 5 is turned off and the display unit 501 is accommodated in the accommodation unit 502.

Although there is typically a possibility for the display temperature to become high or for temporary degradation variations to occur in each of the pixels depending on details of display immediately after the display is lit up for a while, it is possible to measure the luminance and the temperature after the aforementioned influence is stabilized, such as after the display temperature decreases after the power supply is turned off, and to perform measurement with higher precision.

Specifically, as illustrated in (b) of FIG. 13, the luminance line sensor 503 placed vertically inside the accommodation unit 502 is movable in the left-right direction (the arrow direction in the drawing), and the light emission luminance in units of pixels is measured over the entire screen in synchronization with current monitoring control (light emitted state) of the pixels of the display unit 501.

Although the temperature line sensor is not illustrated, the temperature line sensor may be placed in a movable form similarly to the luminance line sensor 503 on a back face of the display unit 501. However, the temperature line sensor may not be provided as long as the luminance is measured after the temperature of the display unit 501 is sufficiently stabilized. Instead, a temperature sensor for monitoring the temperature inside the accommodation unit 502 may be provided.

Example 5

Figure 14:
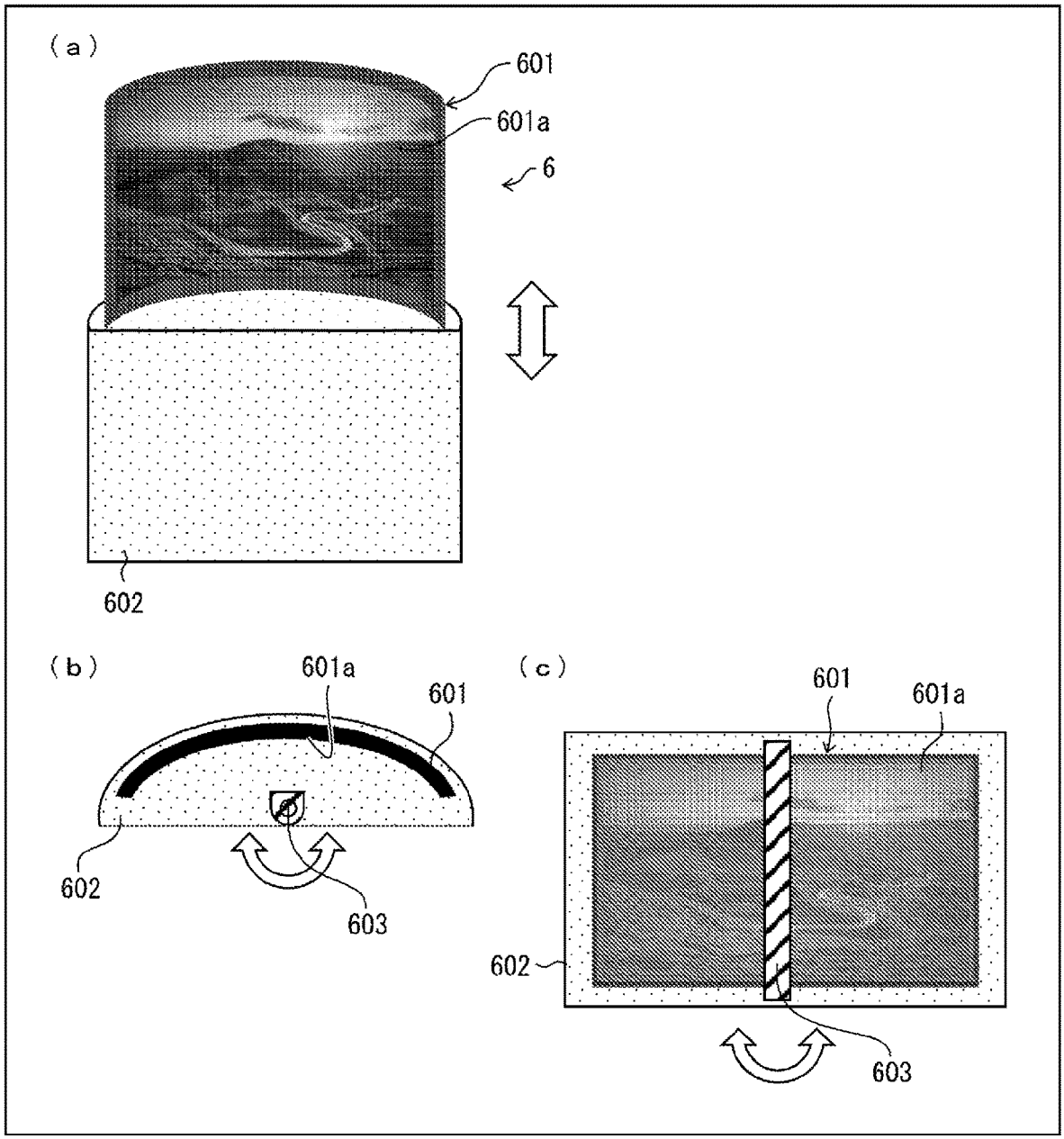
FIG. 14 is a schematic configuration diagram of a display device in Example 5.

FIG. 14 is a schematic configuration diagram of a display device 6 in this example.

The display device 6 is configured such that measurement of luminance and measurement of the temperature of a display unit 601 are performed after the display unit 601 is accommodated in an accommodation unit 602, in the same manner as the display device 5 in Example 4. Note that the display unit 601 of the display device 6 is different from the display unit 501 in Example 4 in that the display unit 601 has a curved shape.

A luminance line sensor 603 of a rotating scheme for measuring the luminance in a state in which the display unit 601 is accommodated is provided in the accommodation unit 602 as illustrated in (b) and (c) of FIG. 14. Here, the luminance line sensor 603 measures light emission luminance in units of pixels of OLED elements in a viewable area 601*a* of the accommodated display unit 601 while rotating inside the accommodation unit 602.

Specifically, the curved display unit 601 and a sensor face are controlled to face one another by the luminance line sensor 603 placed vertically inside the accommodation unit 602 rotating in the left-right direction, and the light emission luminance in units of pixels is measured over the entire screen in synchronization with current monitoring control (light emitted state) of each pixel.

Note that although no temperature line sensor is illustrated, a temperature line sensor may be provided. For example, the temperature of the display face may be measured at the same time as the measurement of the luminance using a temperature line sensor capable of performing measurement even at a remote distance in parallel with the luminance line sensor 603.

Also, when the luminance is measured after the temperature of the display unit 601 accommodated in the accommodation unit 602 is sufficiently stabilized, a temperature sensor for monitoring the temperature inside the accommodation unit 602 may be provided instead of the temperature line sensor.

Advantageous Effects of Examples 4 and 5

In addition to the fact that effects that are similar to those of the first embodiment and Examples 1 to 3 are obtained, it is possible to perform the measurement and the correction value arithmetic operation at a freely-selected timing after the display unit is accommodated (after the viewable area 501*a* is brought into the blocked state) and to perform more faithful degradation compensation without influences of the display temperature and temporary degradation (variations).

Also, the display device according to the disclosure can also be applied to a display-mounted device of an opened/closed scheme configured to be opened and closed such that a display unit is covered with a keyboard unit or the like, such as a notebook-size personal computer illustrated in Example 6 below or a display-mounted device configured such that a display unit is covered with a cover or a main body is accommodated in a case, such as smartphones illustrated in Examples 7 and 8.

Example 6

Figure 15:
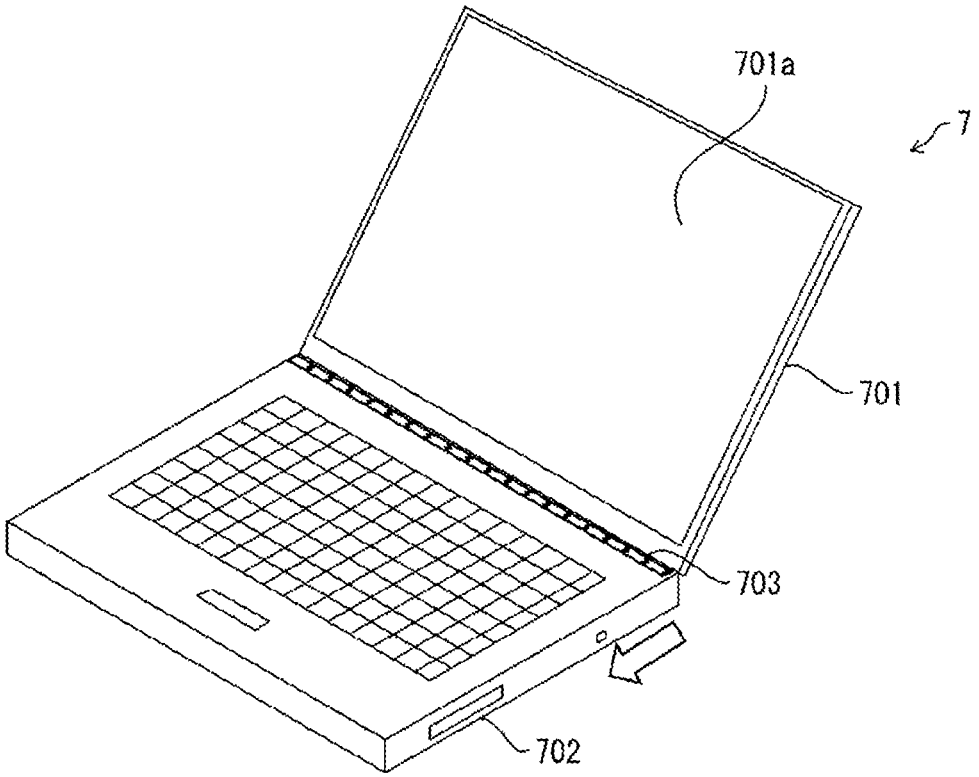
FIG. 15 is a schematic perspective view of a notebook-size personal computer in Example 6.

FIG. 15 is a schematic perspective view of a notebook-size personal computer 7 in this example.

The notebook-size personal computer 7 is configured such that a display unit 701 can be opened and closed relative to a keyboard 702 as illustrated in FIG. 15. A movable luminance line sensor 703 is provided on the side of the keyboard 702, and the luminance line sensor 703 measures display luminance of an entire face of a viewable area 701*a* of the display unit 701 that is located as a facing face while moving toward a front of the surface of the keyboard 702 when the display unit 701 of the notebook-size personal computer 7 is closed on the side of the keyboard 702. In this case as well, the luminance measurement is performed by the luminance line sensor 703 after the viewable area 701*a* is brought into a blocked state similarly to Example 4 and Example 5.

The display unit 701 is calibrated (a correction parameter for a display output signal is generated) on the basis of the luminance measured in this manner.

The calibration method is the same as that in the first embodiment. In other words, a freely-selected gray-scale signal is transmitted (a voltage is applied) to each pixel of the display unit 701, and values of currents flowing through the drive TFTs and the OLED elements and output luminance at that time are measured. The calibration is performed on the basis of the current value and the luminance value.

Alternatively, only the measurement of the output luminance may be performed, and the calibration may be performed such that a predetermined luminance output is obtained.

The measurement of the luminance performed by the luminance line sensor 703 may be automatically operated when the notebook-size personal computer 7 is closed or may be operated in response to an instruction from a user. In a case in which the measurement starts in response to a user's instruction, a message for encouraging the user to close the screen may be displayed, the measurement may start at the timing at which the user closes the screen, and a sound notification may be provided when the measurement ends.

Example 7

Figure 16:
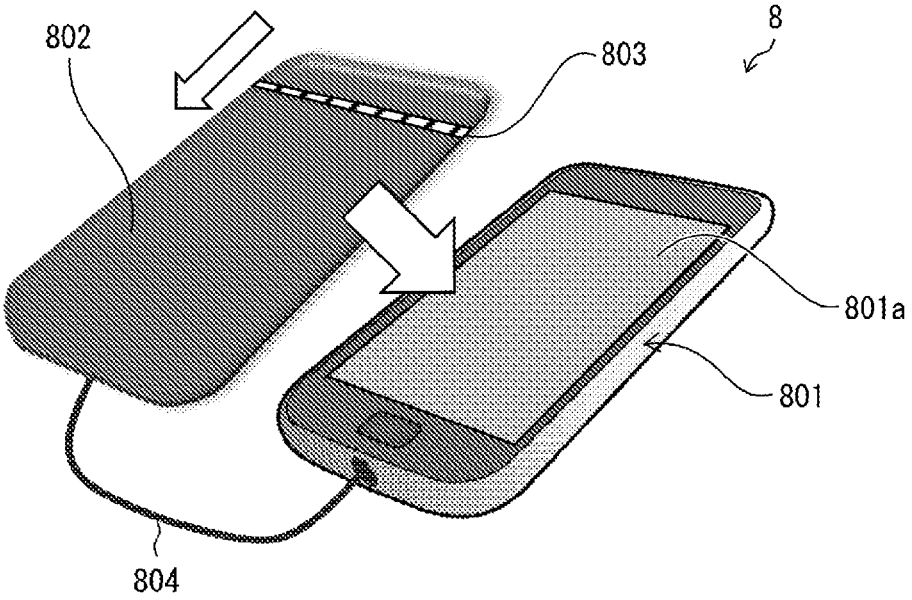
FIG. 16 is a schematic perspective view of a smartphone in Example 7.

FIG. 16 is a schematic perspective view of a smartphone 8 in this example.

In this example, an example in which measurement of luminance and calibration of displayed object are performed in a state in which a display unit 801 of the smartphone 8 is covered with a display cover 802 provided with a movable luminance line sensor 803 will be described.

The smartphone 8 is configured such that a display cover 802 incorporating the movable luminance line sensor 803 covering a viewable area 801*a* of the display unit 801 of a smartphone main body is connected to the smartphone 8 by interposing a USB cable 804 as illustrated in FIG. 16.

The luminance line sensor 803 is provided to be movable on the side of the face facing the viewable area 801*a* when the display cover 802 has covered the viewable area 801*a* of the display unit 801. In other words, the luminance line sensor 803 measures display luminance over the entire face of the viewable area 801*a* by moving along the viewable area 801*a* in a state in which the display cover 802 is attached to cover the viewable area 801*a* of the display unit 801.

The display unit 801 is calibrated (a correction parameter for a display output signal is generated) on the basis of the luminance measured in this manner.

The calibration method is the same as that in the first embodiment. In other words, a freely-selected gray-scale signal is transmitted (a voltage is applied) to each pixel of the display unit 801, and values of currents flowing through the drive TFTs and the OLED elements and output luminance at that time are measured. The calibration is performed on the basis of the current value and the luminance value.

Alternatively, only the measurement of the output luminance may be performed, and the calibration may be performed such that a predetermined luminance output is obtained.

Power supply for driving and measurement of the luminance line sensor 803, and transmission of the measurement value from the luminance line sensor 803 to the smartphone main body are achieved by the USB cable 804 connecting the smartphone main body to the display cover 802. Note that the power supply and the transmission of measurement data are not required to be performed through the USB cable 804 and wireless power supply and wireless connection (such as Bluetooth (trade name) or Wifi (trade name)) may be used. The smartphone main body calibrates the display quality on the basis of the measurement data from the luminance line sensor 803.

Example 8

Figure 17:
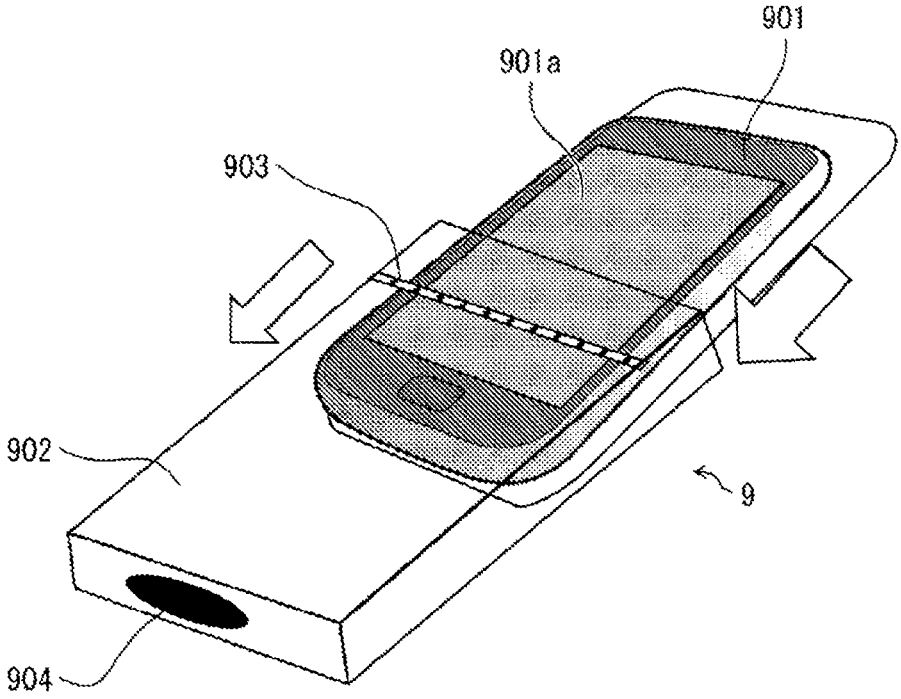
FIG. 17 is a schematic perspective view of a smartphone in Example 8.

FIG. 17 is a schematic perspective view of a smartphone 9 in this example.

In this example, an example in which measurement of luminance by a movable luminance line sensor 903 provided in an accommodation case 902 and calibration of a displayed object are performed in a state in which a smartphone main body including a display unit 901 is accommodated in the accommodation case 902 will be described.

The accommodation of the smartphone main body in the accommodation case 902 may be achieved by manually inserting the smartphone main body into the accommodation case 902 or may be achieved such that the smartphone main body is automatically accommodated into the accommodation case 902 when the smartphone main body is placed on a tray.

The movable luminance line sensor 903 is provided inside the accommodation case 902 (on a face facing the display unit 901 of the smartphone 9). In other words, the luminance line sensor 903 measures display luminance on an entire face of a viewable area 901*a* by moving along the viewable area 901*a* of the display unit 901 in a state in which the smartphone main body is accommodated in the accommodation case 902.

Here, communication of measurement data or the like between the luminance line sensor 903 and the smartphone main body may be realized by connecting the smartphone main body to the connection connector 904 provided at a bottom portion of the accommodation case 902, or communication may be performed by a wireless connection (such as Bluetooth (trade name) or Wifi (trade name)).

In the case of a configuration in which the smartphone main body is automatically accommodated in the accommodation case 902, the luminance line sensor 903 may be fixedly placed near an inlet of the accommodation case 902 to scan the viewable area 901*a* at the same time as the accommodation of the smartphone main body.

Note that, although the example in which the luminance line sensor is provided at the cover of the smartphone and in the accommodation case of the smartphone has been described above in Examples 7 and 8, a luminance line sensor may be provided at a cover for a stationary-type (vertically placed) display (a TV or a monitor), or the luminance line sensor may be provided at a cover or at an accommodation case for a mobile terminal such as a tablet, a smartwatch, or a mobile game console.

The sensors (the luminance sensor 103 and the temperature sensor 104) configured to compensate the OLED elements detect at least either optical characteristics or electrical characteristics of the OLED elements of the display unit 101 in a state in which there is relative movement between the display unit 101 and the sensor in all of the first embodiment and Examples 1 to 8. In practice, luminance measurement is performed by moving the display unit 101 with the luminance line sensor secured inside the accommodation unit 102.

In a second embodiment described below, an example in which luminance measurement of a display unit is performed in a state in which accommodation of the display unit has been completed without performing luminance measurement and the like while moving the display unit, unlike the first embodiment, will be described.

Second Embodiment

An embodiment of the disclosure will be described below.

Overview of Display Device 1

Figure 18:
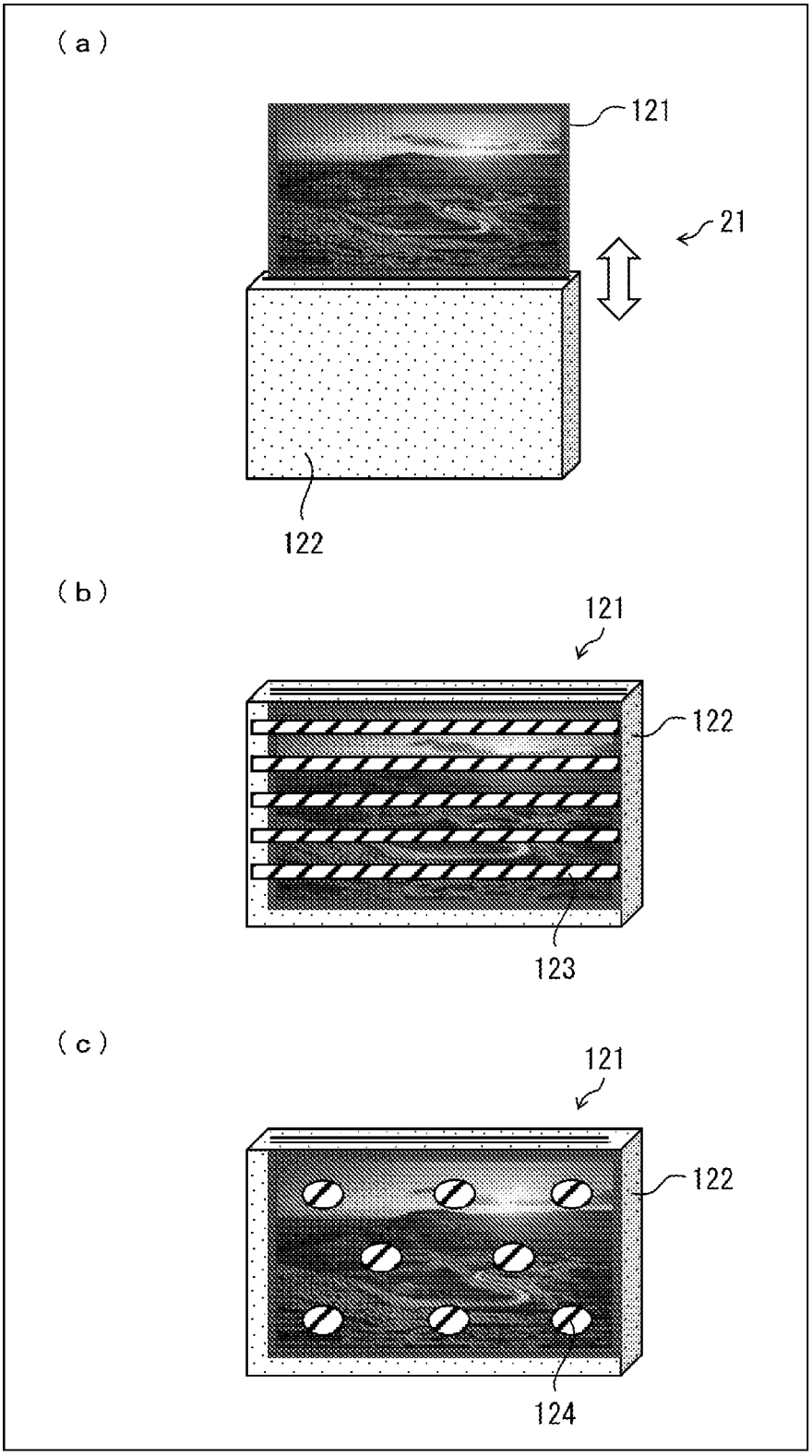
FIG. 18 is a schematic perspective view of a display device according to a second embodiment of the disclosure.

FIG. 18 is a schematic perspective view of a display device 21 according to the present embodiment.

The display device 21 includes a display unit 121 and an accommodation unit 122 configured to accommodate the display unit 121. The display unit 121 is formed of a display (OLED) in which OLED elements (display elements) are disposed in a matrix shape.

The display device 21 measures output luminance of the display unit 121 in a state in which the display unit 121 is accommodated inside the accommodation unit 122. The configuration described hitherto is the same as that of the display device 5 in Example 4 of the first embodiment. However, the display device 21 is different from the display device 5 in that the sensor placed inside the accommodation unit 122 is not movable and measures output luminance of the display unit 121 of the display device 21.

Specifically, the luminance line sensor 123 or a camera sensor (two-dimensional luminance meter) 124 are placed as sensor units capable of partially measuring the output luminance of the display inside the accommodation unit 122, the sensor units are controlled in accordance with display of a specific image signal on the display unit 121, and luminance measurement is also performed in units of pixels, as illustrated in (b) and (c) of FIG. 18.

Typically, it is necessary to detect a) the amount of decrease in currents flowing through drive TFTs, b) the amount of decrease in currents flowing through the OLEDs, and c) luminous efficiency of the OLED elements in order to ascertain a state of temporal degradation of the OLEDs.

a) and b) are realized by providing, for the display unit, a configuration applying a certain voltage to a drive TFT and an OLED element of each pixel and monitoring a current value at that time. However, it is necessary to perform the detection at a timing at which viewability of the user is not affected since the OLED elements emit light when the monitoring of the OLED elements is performed.

Although estimation of a decrease in c) luminous efficiency from b) the amount of decrease in current is also conceivable, measurement of light emission luminance in units of pixels is ideal in order to perform faithful compensation. In the present embodiment, light emission luminance is measured in units of pixels.

Further, monitoring/measurement values in a) to c) are affected by environmental states such as a display temperature. It is also necessary to observe a temperature at monitoring/measuring timings at the same time for comparison with an initial state (before degradation). The temperature sensor may be provided in a back face of the display unit, or a plurality of temperature sensors may be placed at positions at which the temperature sensors face the back face of the display of the accommodation unit such that a temperature can partially be measured.

System Configuration

Figure 19:
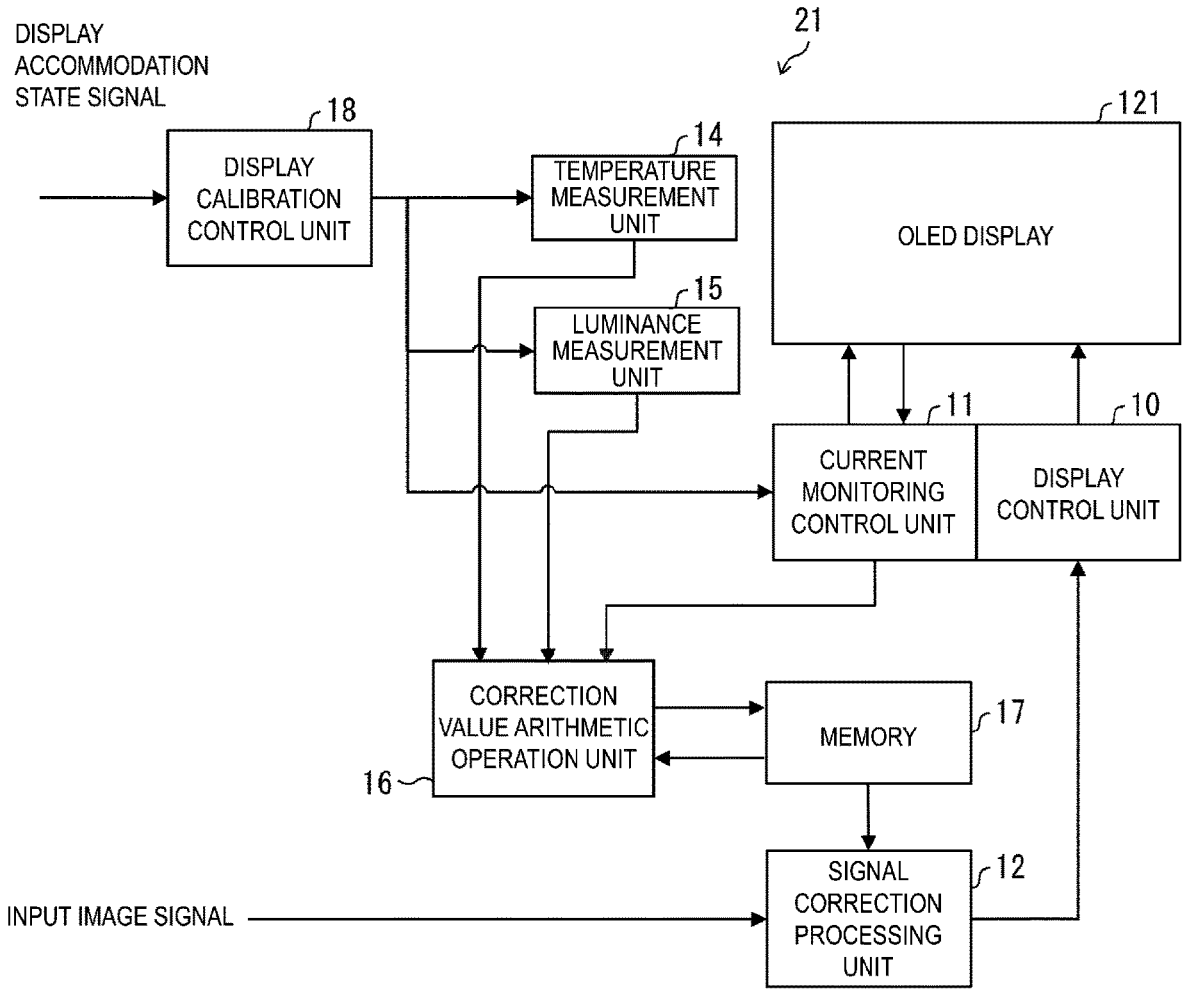
FIG. 19 is a block diagram illustrating an example of a system configuration for realizing OLED degradation compensation in the display device illustrated in FIG. 18.

FIG. 19 is a block diagram illustrating an example of a system configuration for realizing OLED degradation compensation in the display device 21. Note that the same reference signs will be applied to members that have the same functions as those of the system configuration of the display device 1 described in the first embodiment and detailed description thereof will be omitted.

The display device 21 includes a display control unit 10, a current monitoring control unit 11, a signal correction processing unit 12, a display calibration control unit 18, a temperature measurement unit 14, a luminance measurement unit 15, a correction value arithmetic operation unit 16, and a memory 17.

At the time of ordinary image display, an input image signal is corrected into an image signal with degradation compensated by the signal correction processing unit 12, and an image is displayed on the display unit 121 via the display control unit 10. Here, the signal correction processing unit 12 reads a parameter for correction for each pixel saved in the memory 17 and corrects the input image signal on the basis of the parameter.

In a case in which power supply, which is not illustrated, is turned ON/OFF, and the display unit 121 is accommodated in the accommodation unit 122, the display calibration control unit 18 receives a display accommodation state signal illustrating that a display accommodation state has been achieved. Then, the display calibration control unit 18 provides instructions to the temperature measurement unit 14, the luminance measurement unit 15, and the current monitoring control unit 11. The current monitoring control unit 11 transmits a specific display signal (voltage) to the display unit 121 and monitors currents flowing through the drive TFTs and the OLED elements. The luminance measurement unit 15 measures light emission luminance of OLEDs configured to light up at a timing at which the current monitoring control unit 11 sends a display signal to the display unit 121. The temperature measurement unit 14 similarly measures the temperature of the display unit 121 at that time, namely a so-called panel temperature.

The correction value arithmetic operation unit 16 acquires a current value, a luminance value, and a temperature value of each pixel from each measurement unit (the temperature measurement unit 14 and the luminance measurement unit 15), acquires measurement values (such as initial data) in the past from the memory 17, and performs an arithmetic operation for a new correction parameter for each pixel on the basis of such data. The data obtained through the arithmetic operation is saved again in the memory 17 and is used as a later correction parameter at the time of ordinary display.

Since current characteristics and luminance characteristics of the OLEDs have been described above with reference to graphs illustrated in FIGS. 5 and 6 in the first embodiment, description thereof will be omitted in the present embodiment.

Degradation Compensation Processing (1) for OLED Elements

Figure 20:
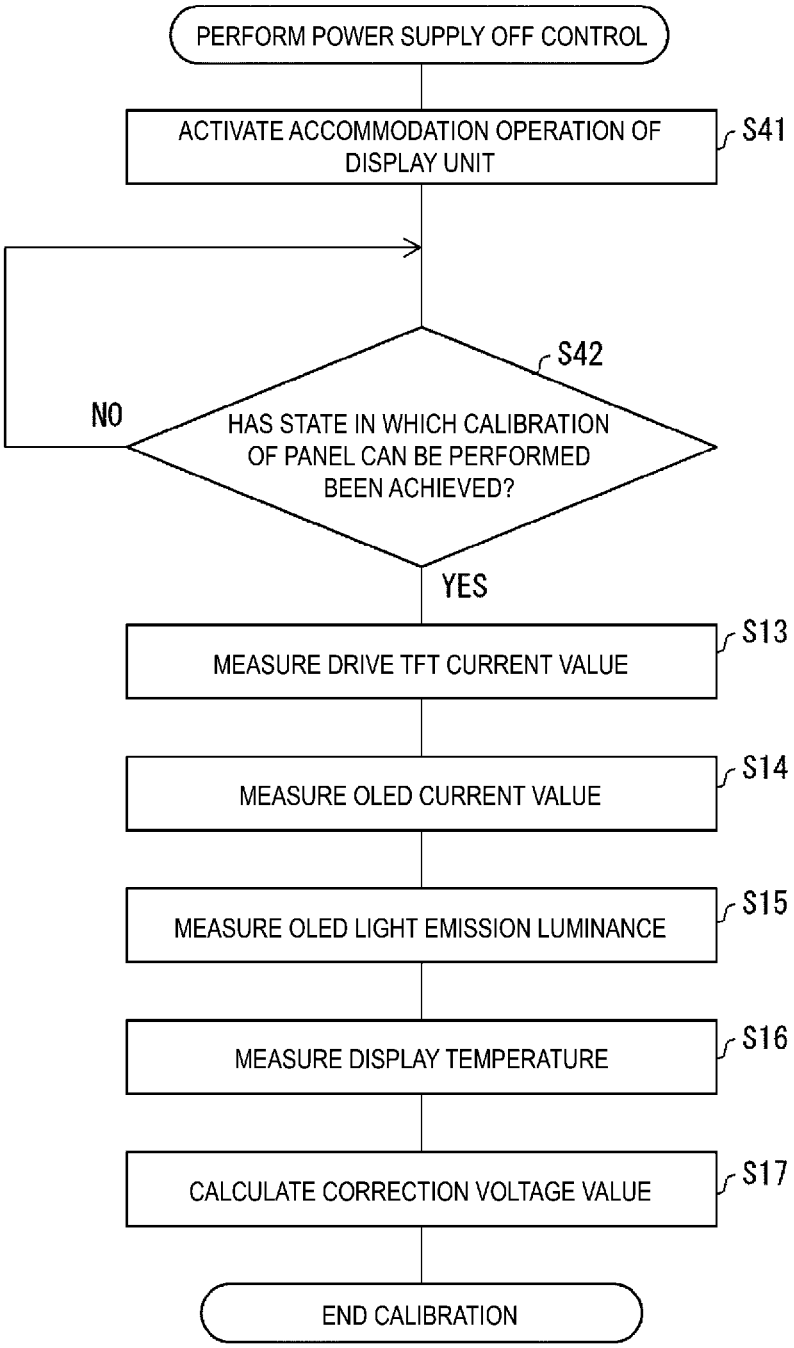
FIG. 20 is a flowchart illustrating an example of a flow of degradation compensation processing for OLED elements.

FIG. 20 is a flowchart illustrating an example of a flow of degradation compensation processing for OLED elements. Note that a correction voltage value generated through the flowchart illustrated in FIG. 20 is used in the image processing illustrated in FIG. 8 described in the first embodiment. Note that the same step numbers will be provided to steps in which the same processing as that in the flowchart illustrated in FIG. 7 in the first embodiment is performed, and detailed description thereof will be omitted.

First, when an operation of turning ON/OFF the power supply is performed, an operation of accommodating the display unit 121 is activated as illustrated in FIG. 20 (Step S41).

Subsequently, whether or not a panel calibration available state has been achieved is determined (Step S42). Here, the panel calibration available state is a state in which the display unit 121 is accommodated at a predetermined position in the accommodation unit 122 and luminance detection can be performed by the sensor.

When the determination is Yes in Step S42, the processing proceeds to Step S13, and current values of the drive TFTs are measured. Subsequently, the current value of the OLED elements is measured (Step S14), luminance of light emitted by the OLED elements is measured (Step S15), and the temperature of the display is measured (Step S16).

After the aforementioned data is acquired, a correction voltage value is calculated on the basis of the value, measurement data in the past obtained from the memory, and a correction calculation result in the past (Step S17), and a calculation result is then saved in the memory 17.

After the calibration, display is switched to ordinary image display, and the image processing illustrated in FIG. 8 is executed. Here, in the signal correction processing in Step S22, the correction value is read from the memory 17, and an output signal to be output to the display unit 121 is calculated on the basis of the input signal level of the input image signal and the correction value (parameter) corresponding to each pixel.

Degradation Compensation Processing (2) for OLED Elements

Figure 21:
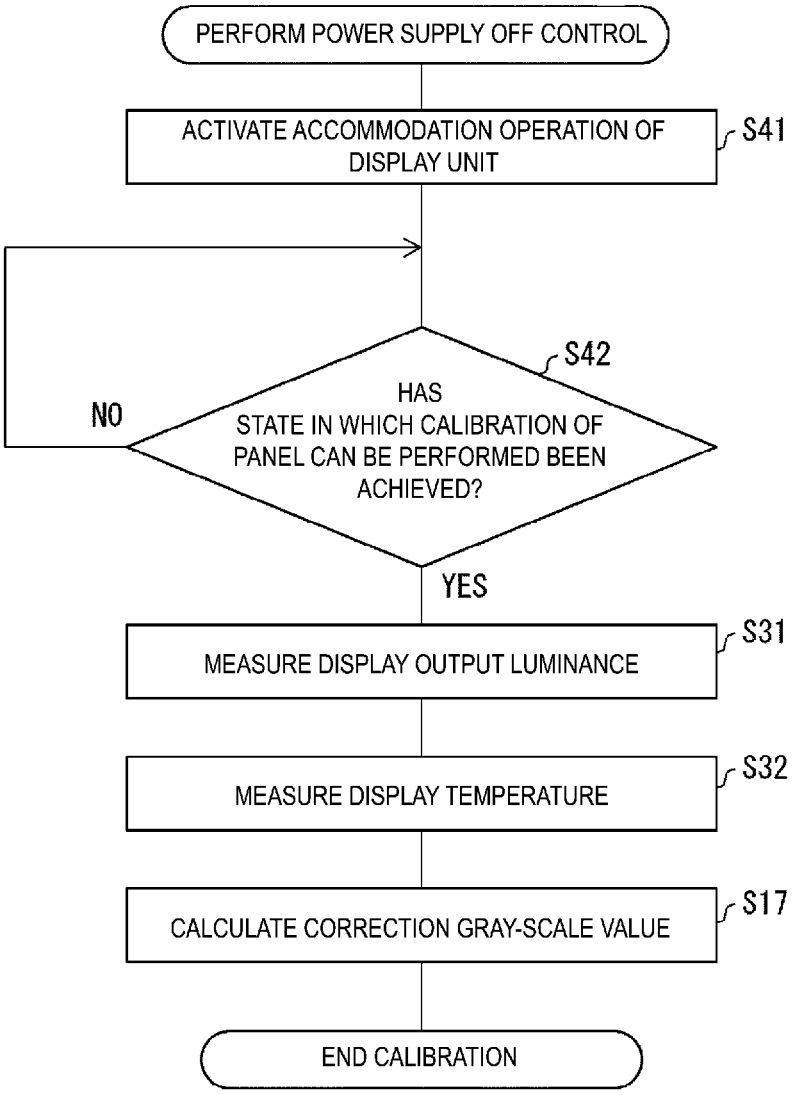
FIG. 21 is a flowchart illustrating another example of a flow of the degradation compensation processing for the OLED elements.

FIG. 21 is a flowchart illustrating another example of a flow of degradation compensation processing of OLED elements. The flowchart illustrating in FIG. 21 is different from the flowchart illustrated in FIG. 20 in that current monitoring of the drive TFTs and the OLED elements is not performed and correction is performed using final output luminance obtained by the luminance sensor and the panel temperature. In the flowchart illustrated in FIG. 21, the same step numbers are applied to the same processing as that in the flowchart illustrated in FIG. 20.

First, when an operation of turning ON/OFF the power supply is performed, an operation of accommodating the display unit 121 is activated as illustrated in FIG. 20 (Step S41).

Subsequently, whether or not a panel calibration available state has been achieved is determined (Step S42). Here, the panel calibration available state is a state in which the display unit 121 is accommodated at a predetermined position in the accommodation unit 122 and luminance detection can be performed by the sensor.

When the determination is Yes in Step S42, the processing proceeds to Step S31, display output luminance is measured (Step S31), and a display temperature is measured (Step S32).

The display output luminance is measured by the luminance line sensor 123 or the camera line sensor 124 by causing each of the pixels of the OLED elements to sequentially light up with a freely-selected gray-scale signal.

The display temperature is measured by the temperature sensor 104 in units of pixels or one line of the OLED elements. Note that in a case in which it is difficult to acquire the temperature in units of pixels or one line of the OLED elements, the temperature may be acquired in a wide area including several lines.

After the aforementioned data is acquired, a correction value of the gray-scale signal is calculated to achieve a target luminance by comparing the acquired luminance value with target luminance with a freely-selected gray-scale signal and in consideration of influences of the temperature on the luminance (Step S17), and the calculated correction value is saved in the memory 17.

After the calibration, display is switched to ordinary image display, and the image processing illustrated in FIG. 8 is executed. Here, in the signal correction processing in Step S22, the correction value is read from the memory 17, and an output signal to be output to the display unit 121 is calculated on the basis of the input signal level of the input image signal and the correction value (parameter) corresponding to each pixel.

Since the processing illustrated in FIG. 21 is the processing performed with the OLED elements caused to emit light, correction including electrical characteristics and optical characteristics of the drive TFTs and OLED elements of the display unit 121 is performed. The processing can easily be performed without need of any configuration or processing for monitoring each current.

Further, it is possible to correct not only degradation of OLED elements but also chromaticity shift, in-plane variations, and the like.

Advantageous Effects

With the aforementioned configuration, it is possible to more precisely compensate degradation and to improve display quality of the display unit 121 in any utilization state, by measuring the light emission luminance of the OLED elements or measuring the temperature of the display unit 121 while measuring electrical characteristics (current monitoring) of each of the pixels of the OLED elements that are display elements of the display unit 121.

Also, since the luminance sensor and the temperature sensor are not provided directly in the display unit 101, it is possible to curb an increase in manufacturing costs and a decrease in yield of the display as compared with a scheme in which an optical sensor is provided in the pixels of the display to measure light emission luminance in units of pixels as in the related art.

Moreover, with the aforementioned configuration, it is possible to minimize influences of light that is unnecessary for the detection of the characteristics of the OLED elements by detecting at least either the optical characteristics or the electrical characteristics of the OLED elements of the display unit 101 in a blocked state, and thereby to accurately detect the characteristics of the OLED elements. Since the compensation for the data signal provided to each of the pixels of the OLED elements is performed on the basis of the characteristics detected in this manner, it is possible to accurately perform the compensation in units of pixels.

Other forms of the display device 21 described in the present embodiment will be described below.

Example 1

Figure 22:
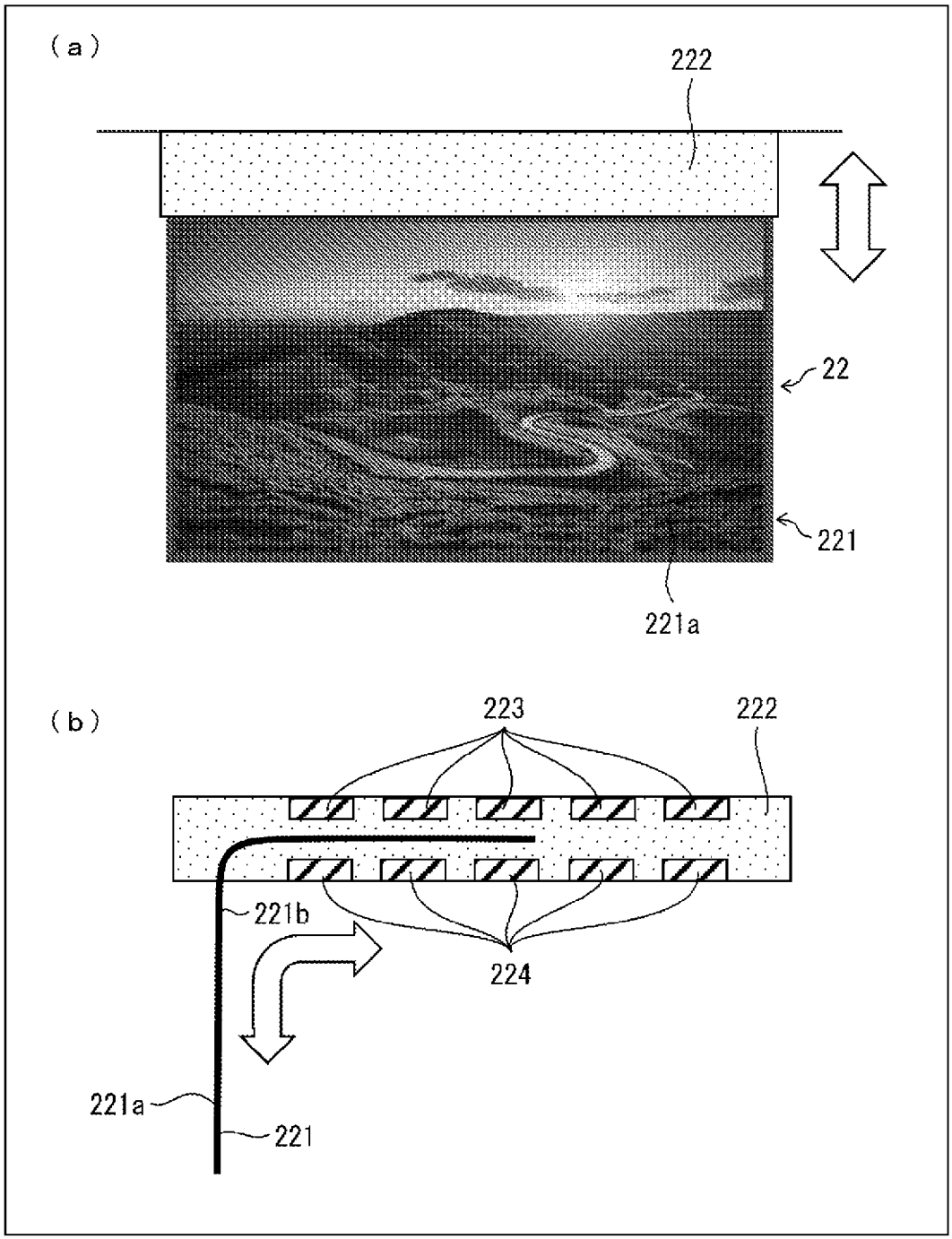
FIG. 22 is a schematic configuration diagram of a display device in Example 1.

FIG. 22 is a schematic configuration diagram of a display device 22 according to this example.

In the display device 22, a display unit 221 that is a curved face and includes OLED elements is accommodated in an accommodation unit 222 placed on a ceiling as illustrated in (a) of FIG. 22. The accommodation unit 222 pulls the display unit 221 thereinto and accommodates the display unit 221 therein as illustrated in (b) of FIG. 22. A viewable area 221*a* is exposed in a state in which the display unit 221 is pulled out of the accommodation unit 222.

A plurality of luminance line sensors 223 and a plurality of temperature line sensors 224 are provided in the accommodation unit 222 in the direction in which the display unit 221 is pulled, as illustrated in (b) of FIG. 22. The luminance line sensors 223 are placed at positions at which the luminance line sensors 223 face the viewable area 221*a* of the display unit 221 accommodated in the accommodation unit 222, and the temperature line sensors 224 are placed at positions at which the temperature line sensors 224 face a back face 221*b* of the display unit 221 accommodated in the accommodation unit 222.

In other words, the display device 22 with the aforementioned configuration is configured such that output luminance of each pixel is measured with the plurality of luminance line sensors 223 placed inside the accommodation unit 222 to calibrate the display (generate a correction parameter for a display output signal) in a state in which the display unit 221 is accommodated in the accommodation unit 222.

The calibration method is the same as that in the first embodiment. In other words, a freely-selected gray-scale signal is transmitted (a voltage is applied) to each pixel of the display unit 221, and values of currents flowing through the drive TFTs and the OLED elements and output luminance at that time are measured. The calibration is performed on the basis of the current value and the luminance value.

Alternatively, only the measurement of the output luminance may be performed, and the calibration may be performed such that a predetermined luminance output is obtained.

Although the configuration in which a plurality of line-shaped sensors are disposed as luminance sensors has been described, the luminance sensors are not limited to line sensors, luminance measurement may be planarly performed with a camera sensor, and a configuration in which one camera sensor is used may be employed in a case in which the entire screen is captured with the one sensor.

Example 2

Figure 23:
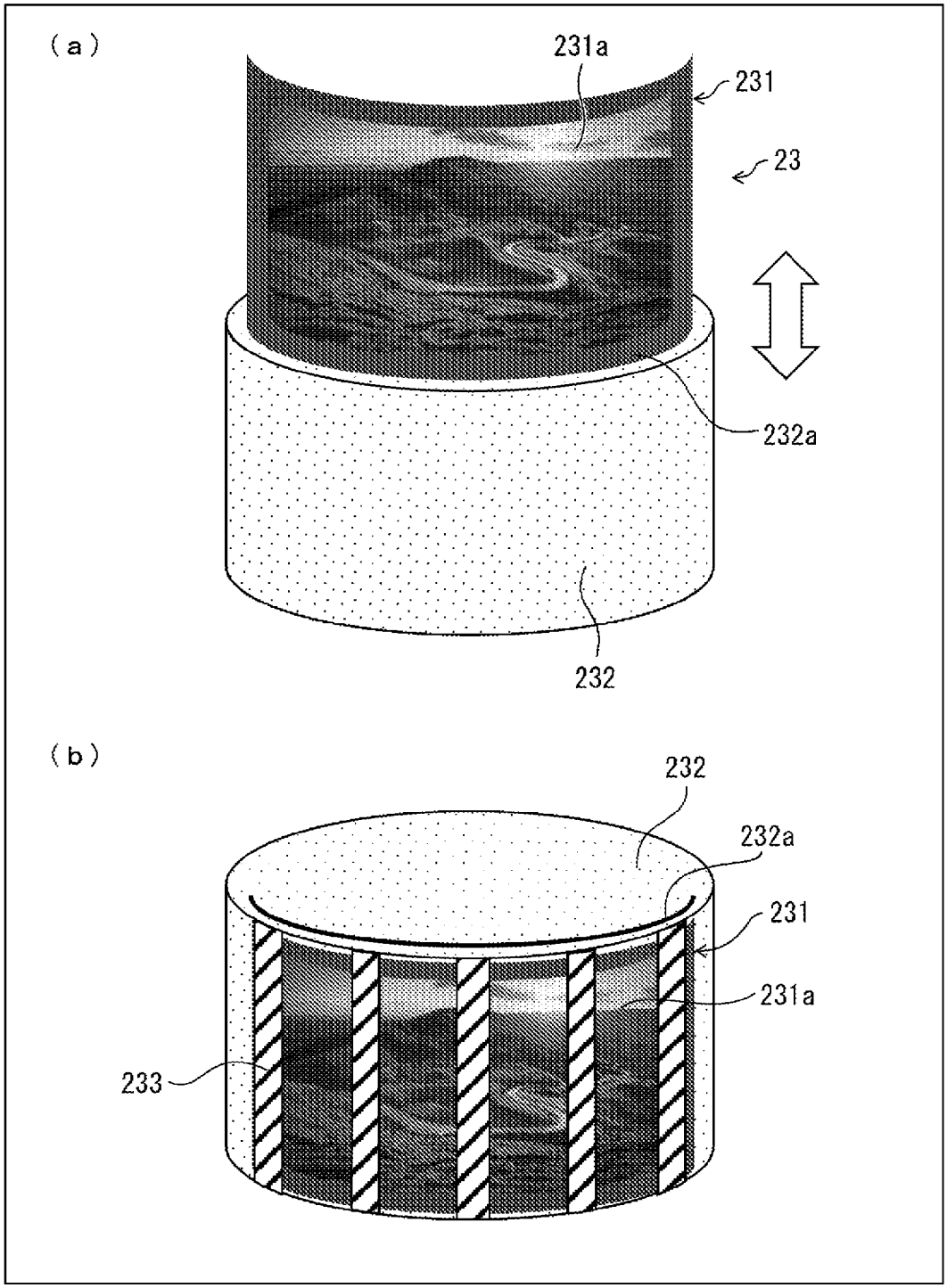
FIG. 23 is a schematic configuration diagram of a display device in Example 2.

FIG. 23 is a schematic configuration diagram of a display device 23 in this example.

The display device 23 is configured such that a display unit 231 that is a curved face and includes OLED elements is accommodated in a columnar accommodation unit 232 as illustrated in (a) and (b) of FIG. 23. The display unit 231 is accommodated inside the accommodation unit 232 from an opening portion 232*a*, and a viewable area 231*a* is exposed in a state in which the display unit 231 is pulled out of the opening portion 232*a* of the accommodation unit 232.

The accommodation unit 232 is provided with a plurality of luminance line sensors 233 disposed in the vertical direction as illustrated in (b) of FIG. 23. The luminance line sensors 233 are placed on the side of the viewable area 231*a* of the display unit 231.

In other words, the display device 23 with the aforementioned configuration measures output luminance of each pixel with the plurality of luminance line sensors 233 placed inside the accommodation unit 232 to calibrate the display (generate a correction parameter for a display output signal) in a state in which the display unit 231 is accommodated in the accommodation unit 232.

The calibration method is the same as that in the first embodiment. In other words, a freely-selected gray-scale signal is transmitted (a voltage is applied) to each pixel of the display unit 231, and values of currents flowing through the drive TFTs and the OLED elements and output luminance at that time are measured. The calibration is performed on the basis of the current value and the luminance value.

Alternatively, only the measurement of the output luminance may be performed, and the calibration may be performed such that a predetermined luminance output is obtained.

Although the configuration in which a plurality of line-shaped sensors are disposed as luminance sensors has been described, the luminance sensors are not limited to line sensors, luminance measurement may be planarly performed with a camera sensor, and a configuration in which one camera sensor is used may be employed in a case in which the entire screen is captured with the one sensor.

Example 3

Figure 24:
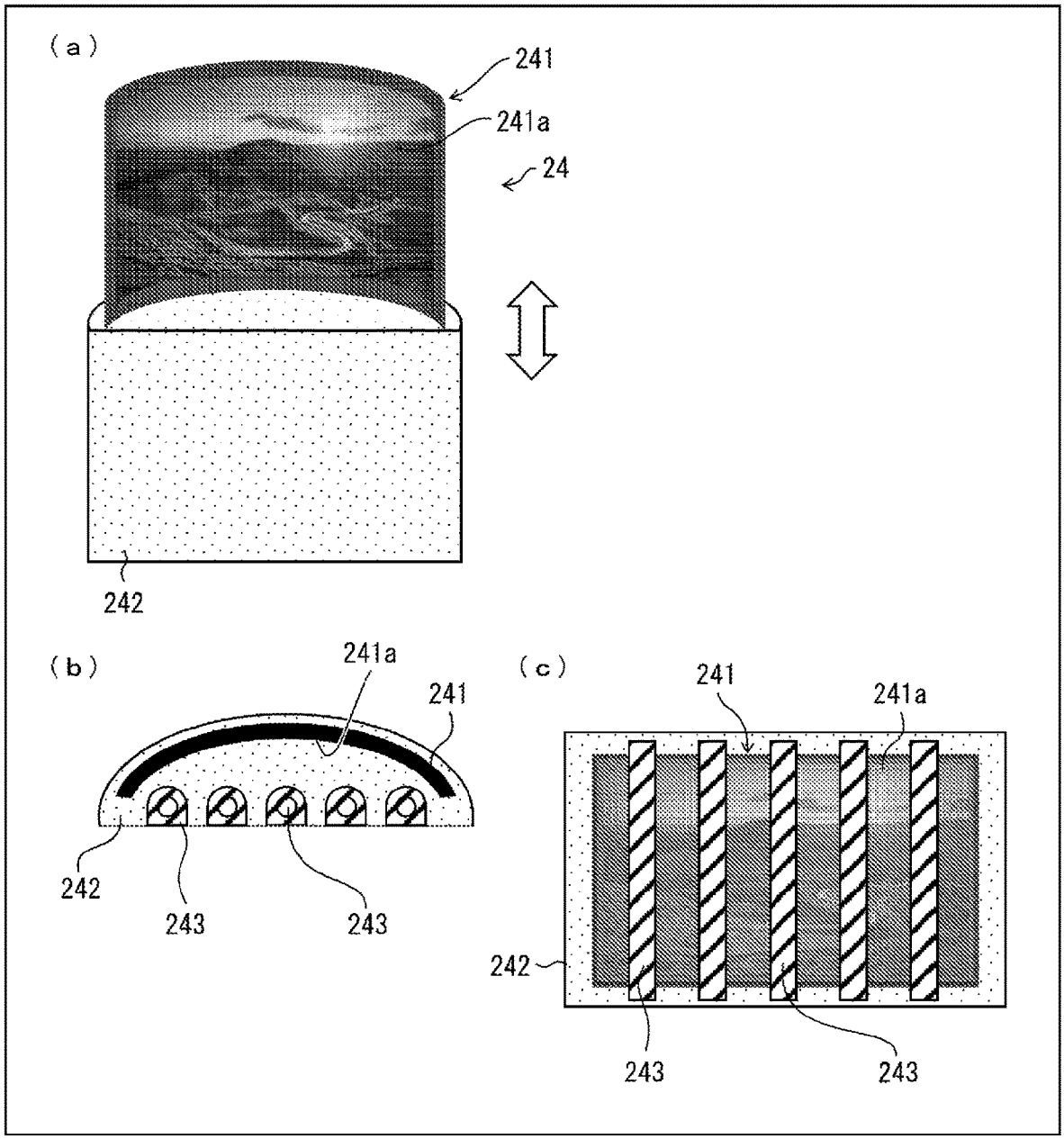
FIG. 24 is a schematic configuration diagram of a display device in Example 3.

FIG. 24 is a schematic configuration diagram of a display device 24 in this example.

The display device 24 is configured such that a display unit 241 is accommodated in an accommodation unit 242 and measurement of the luminance and measurement of the temperature of the display unit 241 are then performed, similarly to the display device 23 in Example 3. Note that the accommodation unit 242 of the display device 24 is different from that in Example 3 in that the accommodation unit 242 has a half columnar shape.

The accommodation unit 242 is provided with a plurality of luminance line sensors 243 for measuring the luminance in a state in which a display unit 241 is accommodated as illustrated in (b) and (c) of FIG. 24. Here, the plurality of luminance line sensors 243 measure light emission luminance in units of pixels of OLED elements in a viewable area 241*a* of the display unit 241 accommodated in an accommodation unit 242 and calibrate (generate a correction parameter for a display output signal) the display.

The calibration method is the same as that in the first embodiment. In other words, a freely-selected gray-scale signal is transmitted (a voltage is applied) to each pixel of the display unit 241, and values of currents flowing through drive TFTs and OLED elements and output luminance at that time are measured. The calibration is performed on the basis of the current value and the luminance value.

Alternatively, only the measurement of the output luminance may be performed, and the calibration may be performed such that a predetermined luminance output is obtained.

Although the configuration in which a plurality of line-shaped sensors are disposed as luminance sensors has been described, the luminance sensors are not limited to line sensors, luminance measurement may be planarly performed with a camera sensor, and a configuration in which one camera sensor is used may be employed in a case in which the entire screen is captured with the one sensor.

Note that although no temperature line sensor is illustrated, a temperature line sensor may be provided. For example, the temperature of the display face may be measured at the same time as luminance measurement using a temperature line sensor capable of performing measurement even at a remote distance in parallel with the luminance line sensors 243.

Also, in a case in which the luminance is measured after the temperature of the display unit 241 accommodated in the accommodation unit 242 is sufficiently stabilized, the temperature line sensor may not be placed, and a temperature sensor for monitoring the temperature inside the accommodation unit 242 may be placed instead.

Example 4

Figure 25:
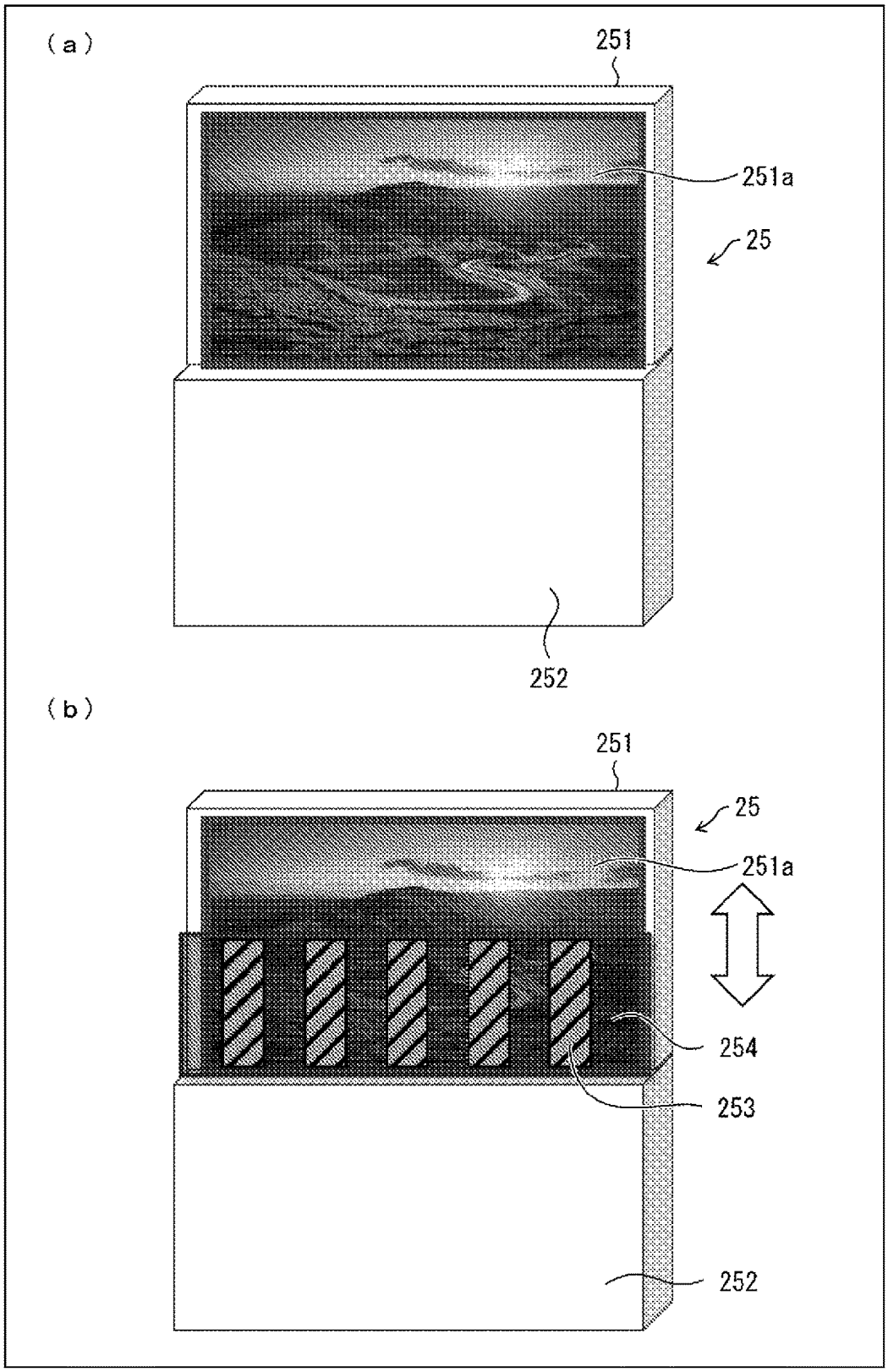
FIG. 25 is a schematic configuration diagram of a display device in Example 4.

FIG. 25 is a schematic configuration diagram of a display device 25 in this example.

The display device 25 includes a display unit 251 and a mounting stand 252 on which the display unit 251 is mounted as illustrated in FIGS. 25(*a*) and (*b*).

The mounting stand 252 includes a mechanism not only for mounting the display unit 251 thereon but also for electrically causing a cover 254 configured to cover a viewable area 251*a* of the mounted display unit 251 to stick out. In other words, the display device 25 in this example is configured to electrically cover the display face at the time other than the time of viewing. Such a display device 25 is designed with an image of an application as a signage display used inside a station or used outdoor.

A plurality of luminance line sensors 253 are provided vertically on a face of the cover 254 that faces the viewable area 251*a* of the display unit 251. In this manner, output luminance of each pixel of the display unit 251 is measured in a state in which the viewable area 251*a* of the display unit 251 is covered with the cover 254, and the display unit 251 is calibrated (a correction parameter for a display output signal is generated) on the basis of this value.

The calibration method is the same as that in the first embodiment. In other words, a freely-selected gray-scale signal is transmitted (a voltage is applied) to each of the pixels of the display unit 251, and values of currents flowing through the drive TFTs and the OLED elements and output luminance at that time are measured. The calibration is performed on the basis of the current value and the luminance value.

Alternatively, only the measurement of the output luminance may be performed, and the calibration may be performed such that a predetermined luminance output is obtained.

Although the configuration in which a plurality of line-shaped sensors are disposed as luminance sensors has been described, the luminance sensors are not limited to line sensors, luminance measurement may be planarly performed with a camera sensor, and a configuration in which one camera sensor is used may be employed in a case in which the entire screen is captured with the one sensor.

Example 5

Figure 26:
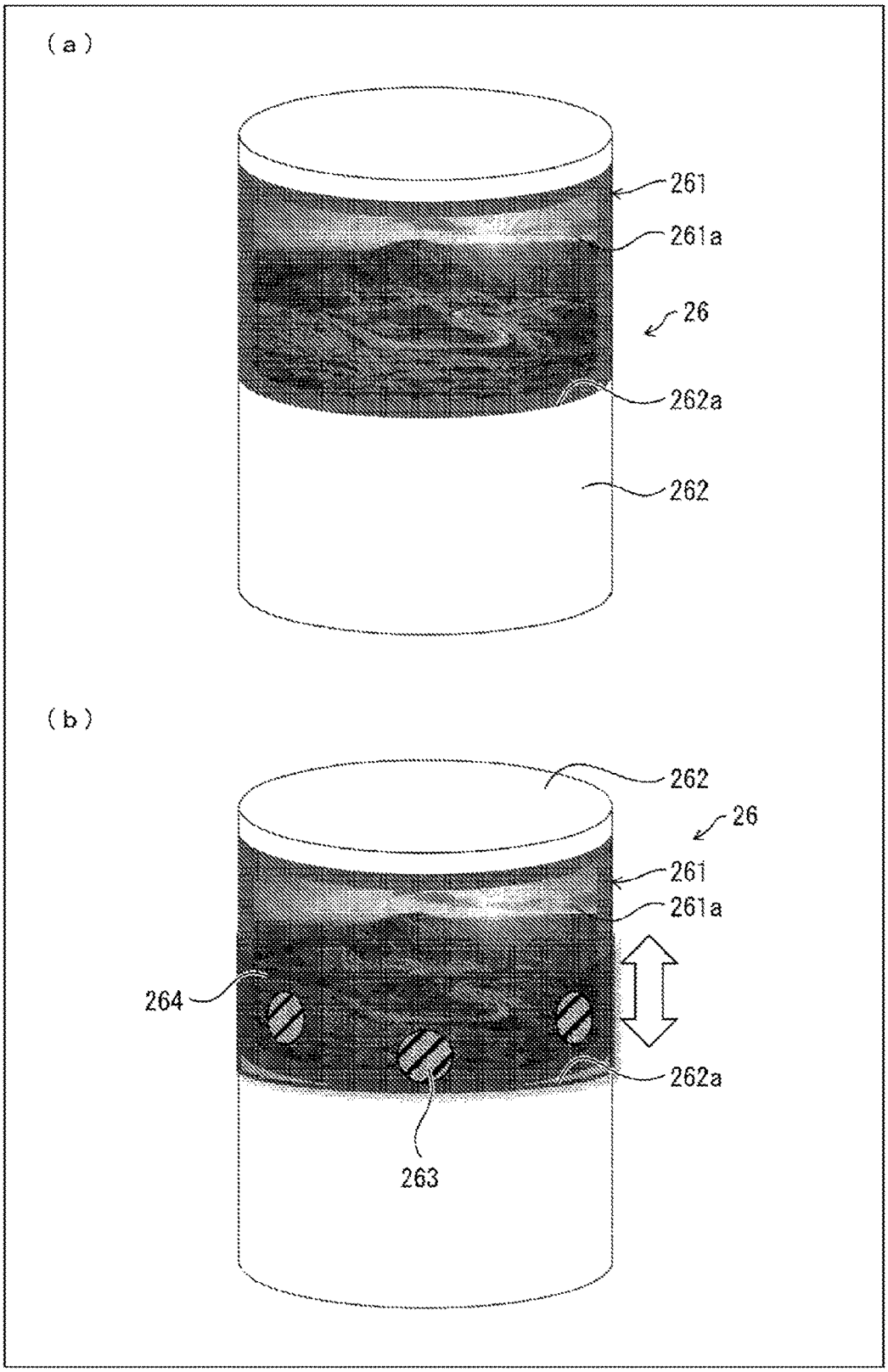
FIG. 26 is a schematic configuration diagram of a display device in Example 5.

FIG. 26 is a schematic configuration diagram of a display device 26 in this example.

The display device 26 is configured such that a display unit 261 that is a curved face and includes OLED elements is accommodated in a columnar accommodation unit 262 and the display can be viewed by a viewable area 261*a* of the accommodated display unit 261 being exposed from an opening 262*a* formed in a front face of the columnar accommodation unit 262 as illustrated in FIGS. 26(*a*) and (*b*).

The display device 26 is different from the display device 2 illustrated in FIGS. 10(*a*) and (*b*) in Example 1 of the first embodiment in that the accommodated display unit 261 does not turn. Thus, in the display device 26, the columnar accommodation unit 262 includes a mechanism for electrically causing a cover 264 configured to cover the viewable area 261*a* of the accommodated display unit 261 to stick out, similarly to the display device 25 in Example 5. In other words, the display device 25 in this example is configured to electrically cover the display face at the time other than the time of viewing.

A plurality of camera line sensors 263 are provided at a plurality of predetermined positions on a face of the cover 264 that faces the viewable area 261*a* of the display unit 261. In this manner, output luminance of each of the pixels of the display unit 261 is measured in a state in which the viewable area 261*a* of the display unit 261 is covered with the cover 264, and the display unit 261 is calibrated (a correction parameter for a display output signal is generated) on the basis of this value.

The calibration method is the same as that in the first embodiment. In other words, a freely-selected gray-scale signal is transmitted (a voltage is applied) to each of the pixels of the display unit 261, and values of currents flowing through the drive TFTs and the OLED elements and output luminance at that time are measured. The calibration is performed on the basis of the current value and the luminance value.

Alternatively, only the measurement of the output luminance may be performed, and the calibration may be performed such that a predetermined luminance output is obtained.

Also, although the configuration in which the plurality of line-shaped sensors are disposed as camera sensors has been described, a configuration in which one camera sensor is used may be employed in a case in which the entire screen can be captured with the one sensor.

Also, the display device according to the disclosure can also be applied to a display-mounted device of an opened/closed scheme configured to be opened and closed such that a display unit is covered with a keyboard unit or the like, such as a notebook-size personal computer illustrated in Example 6 below or a display-mounted device configured such that a display unit is covered with a cover or a main body is accommodated in a case, such as smartphones illustrated in Examples 7 to 10.

Example 6

Figure 27:
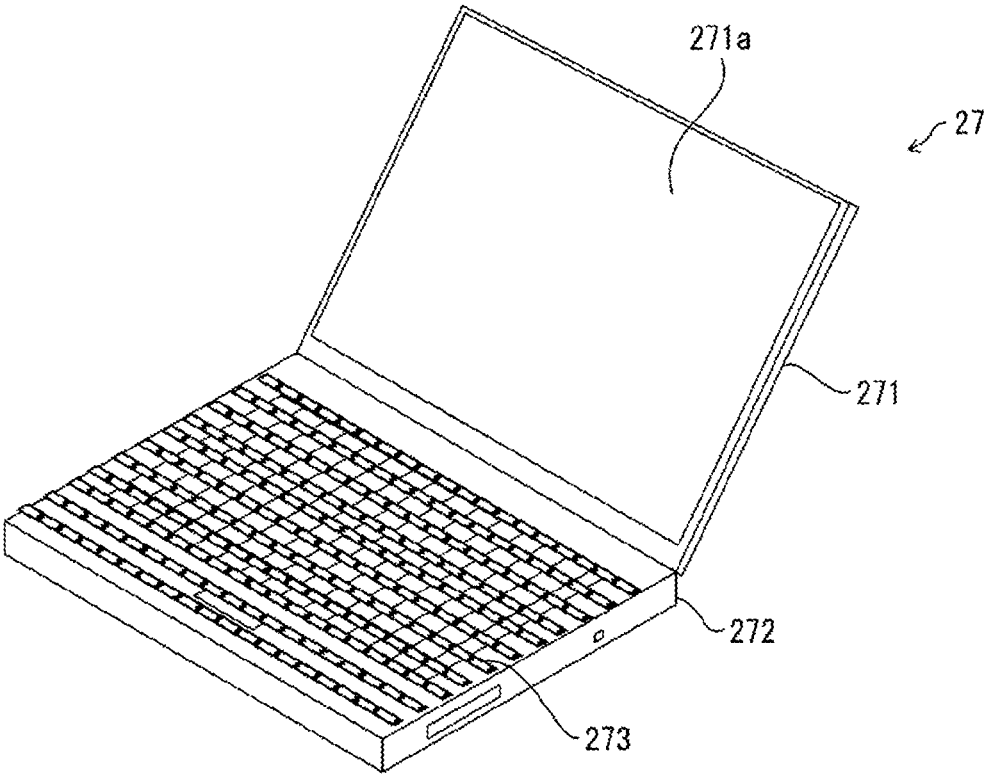
FIG. 27 is a schematic perspective view of a notebook-size personal computer in Example 6.

FIG. 27 is a schematic perspective view of a notebook-size personal computer 27 in this example.

The notebook-size personal computer 27 is configured such that a display unit 271 can be opened and closed relative to a keyboard 272 as illustrated in FIG. 27. A plurality of luminance line sensors 273 are secured on the side of the keyboard 272. When the display unit 271 of the notebook-size personal computer 27 is closed on the side of the keyboard 272, the luminance line sensors 273 measures display luminance of an entire face of a viewable area 271*a* of the display unit 271 located on the facing face.

The display unit 271 is calibrated (a correction parameter for a display output signal is generated) on the basis of the luminance measured in this manner.

The calibration method is the same as that in the first embodiment. In other words, a freely-selected gray-scale signal is transmitted (a voltage is applied) to each of the pixels of the display unit 271, and values of currents flowing through the drive TFT and the OLED elements and output luminance at that time are measured. The calibration is performed on the basis of the current value and the luminance value.

Alternatively, only the measurement of the output luminance may be performed, and the calibration may be performed such that a predetermined luminance output is obtained.

The measurement of the luminance performed by the luminance line sensors 273 may automatically operate when the notebook-size personal computer 27 is closed or may operate in response to an instruction from the user. In a case in which the measurement starts in response to a user's instruction, a message for encouraging the user to close the screen may be displayed, the measurement may start at the timing at which the user closes the screen, and a sound notification may be provided when the measurement ends.

Example 7

Figure 28:
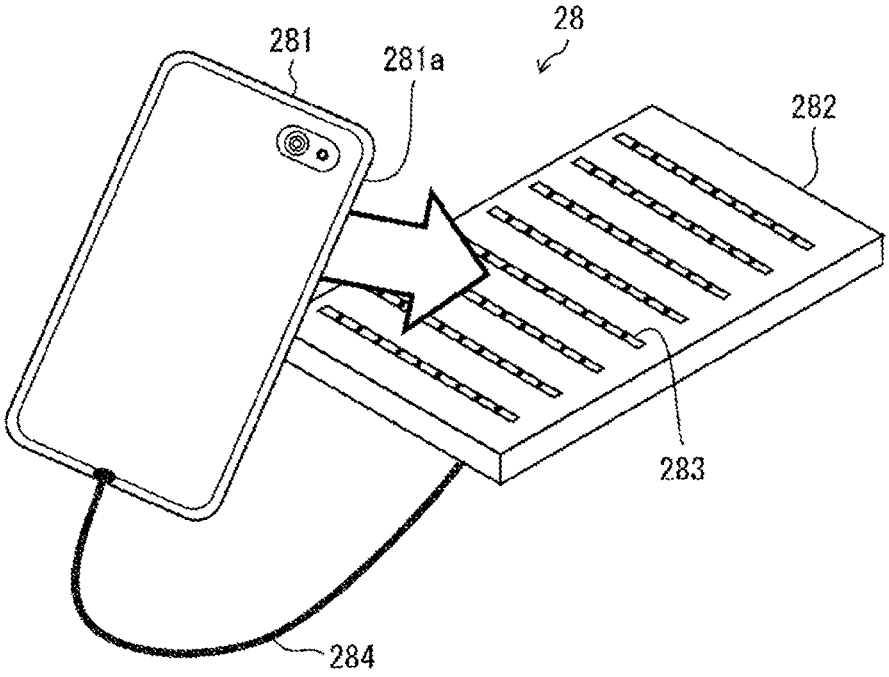
FIG. 28 is a schematic perspective view of a smartphone in Example 7.

FIG. 28 is a schematic perspective view of a smartphone 28 in this example.

In this example, an example in which measurement of luminance and calibration of a displayed object are performed by mounting a display unit 281 of the smartphone 28 on a calibration box 282.

A plurality of luminance line sensors 283 are incorporated in the calibration box 282, and output luminance of a viewable area 281*a* of the display unit 281 of the placed smartphone 28 is measured. Communication (transmission and/or reception of display control data and calibration data) between the display unit 281 of the smartphone 28 and the calibration box 282 is performed through a USB cable 284. However, the example is not limited to the USB cable 284 and may employ another wired cable. Further, the example is not limited to a wired cable and may include wireless connection such as Bluetooth (trade name) or Wifi (trade name).

The calibration box 282 generates calibration data for calibrating the display unit 281 (generating a correction parameter for a display output signal) on the basis of the measured luminance.

The calibration method is the same as that in the first embodiment. In other words, a freely-selected gray-scale signal is transmitted (a voltage is applied) to each of pixels of the display unit 281, and values of currents flowing through drive TFTs and OLED elements and output luminance at that time are measured. The calibration is performed on the basis of the current value and the luminance value.

Alternatively, only the measurement of the output luminance may be performed, and the calibration may be performed such that a predetermined luminance output is obtained.

Example 8

Figure 29:
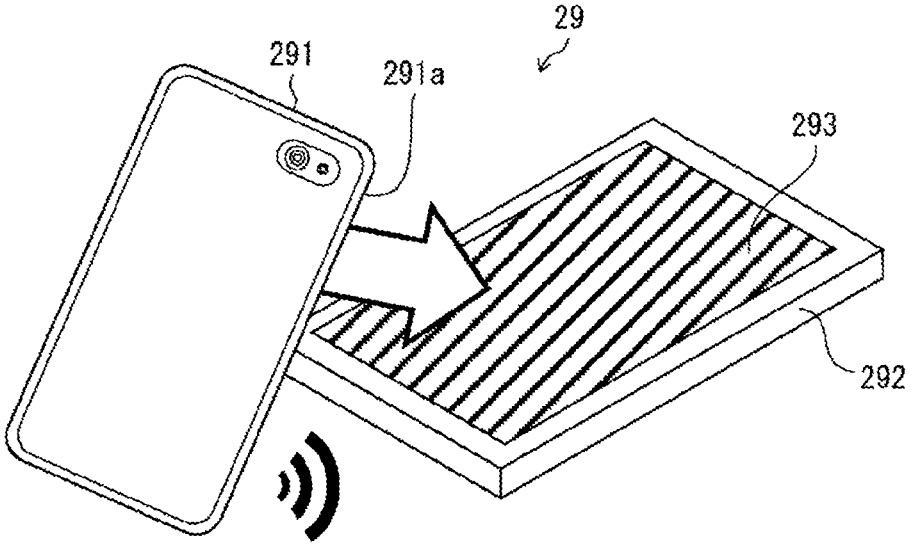
FIG. 29 is a schematic perspective view of a smartphone in Example 8.

FIG. 29 is a schematic perspective view of a smartphone 29 in this example.

In this example, an example in which measurement of luminance and calibration of a displayed object are performed by mounting a display unit 291 of the smartphone 29 on a calibration box 292 similarly to Example 8 will be described.

A plurality of luminance camera sensors 293 are incorporated in the calibration box 292 and measure output luminance of a viewable area 291*a* of the display unit 291 of the placed smartphone 29. Communication (transmission and/or reception of display control data and calibration data) between the display unit 291 of the smartphone 29 and the calibration box 292 is performed by a wireless connection using Bluetooth (trade name), Wifi (trade name), or the like.

The calibration box 292 generates calibration data for calibrating the display unit 291 (generating a correction parameter for a display output signal) on the basis of the measured luminance.

The calibration method is the same as that in the first embodiment. In other words, a freely-selected gray-scale signal is transmitted (a voltage is applied) to each of pixels of the display unit 291, and values of currents flowing through drive TFTs and OLED elements and output luminance at that time are measured. The calibration is performed on the basis of the current value and the luminance value.

Alternatively, only the measurement of the output luminance may be performed, and the calibration may be performed such that a predetermined luminance output is obtained.

Example 9

Figure 30:
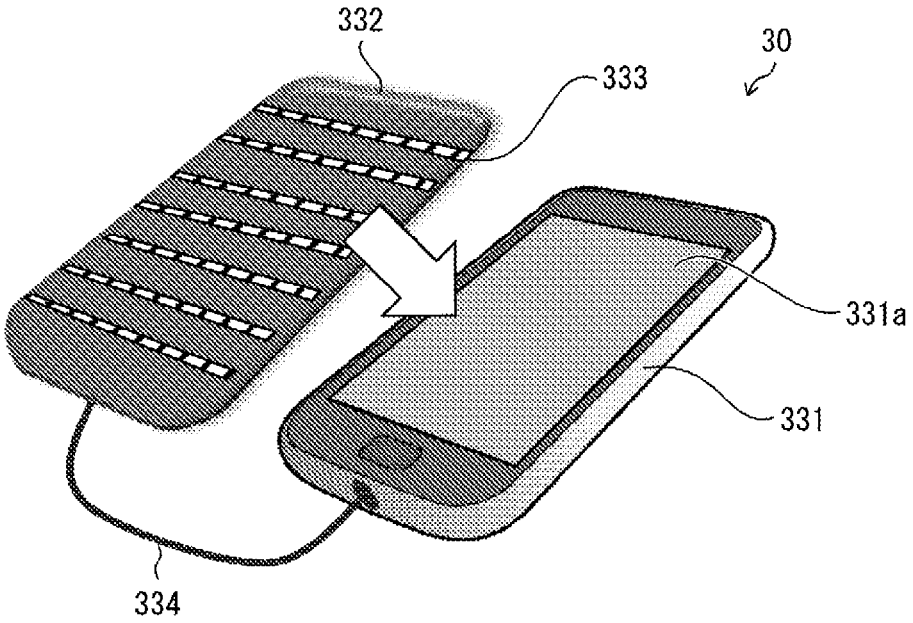
FIG. 30 is a schematic perspective view of a smartphone in Example 9.

FIG. 30 is a schematic perspective view of a smartphone 30 in this example.

In this example, an example in which measurement of luminance and calibration of a displayed object are performed in a state in which a display unit 331 of the smartphone 30 is covered with a display cover 332 provided with a plurality of luminance line sensors 333 will be described.

The display cover 332 incorporating movable luminance line sensors 333 configured to cover a viewable area 331*a* of the display unit 331 of the smartphone main body is connected to the smartphone 30 by interposing a USB cable 334 as illustrated in FIG. 30.

The plurality of luminance line sensors 333 are provided on the side of the face that faces the viewable area 331*a* when the display cover 332 covers the viewable area 331*a* of the display unit 331. In other words, the luminance line sensors 333 measure display luminance of the entire face of the viewable area 331*a* in a state in which the display cover 332 is attached so as to cover the viewable area 331*a* of the display unit 331.

The display unit 331 is calibrated (a correction parameter for a display output signal is generated) on the basis of the luminance measured in this manner.

The calibration method is the same as that in the first embodiment. In other words, a freely-selected gray-scale signal is transmitted (a voltage is applied) to each of pixels of the display unit 331, and values of currents flowing through drive TFTs and OLED elements and output luminance at that time are measured. The calibration is performed on the basis of the current value and the luminance value.

Alternatively, only the measurement of the output luminance may be performed, and the calibration may be performed such that a predetermined luminance output is obtained.

Power supply for driving and measurement of the luminance line sensors 333, and transmission of measurement values from the luminance line sensors 333 to the smartphone main body are achieved by the USB cable 334 connecting the smartphone main body to the display cover 332. Note that the power supply and the transmission of measurement data are not required to be performed through the USB cable 334 and may be performed using wireless power supply and wireless connection (Bluetooth (trade name) or Wifi (trade name)). The smartphone main body calibrates display quality on the basis of measurement data from the luminance line sensors 333.

Example 10

Figure 31:
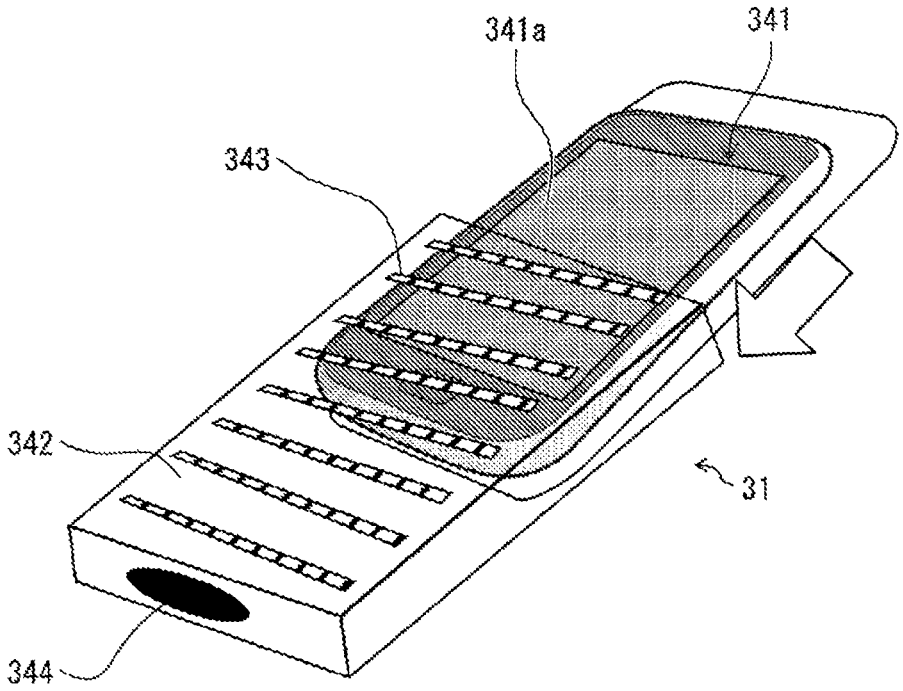
FIG. 31 is a schematic perspective view of a smartphone in Example 10.

FIG. 31 is a schematic perspective view of a smartphone 31 in this example.

In this example, an example in which measurement of luminance and calibration of a displayed object are performed with a plurality of luminance line sensors 343 provided in an accommodation case 342 in a state in which a smartphone main body including a display unit 341 is accommodated in the accommodation case 342 will be described.

The accommodation of the smartphone main body in the accommodation case 342 may be achieved by manually inserting the smartphone main body thereinto, or the smartphone main body may automatically be accommodated by placing the smartphone main body on a tray.

A plurality of luminance line sensors 343 are provided inside the accommodation case 342 (on the face facing the display unit 341 of the smartphone 31). In other words, the luminance line sensors 343 measure display luminance on the entire face of the viewable area 341*a* in a state in which the smartphone main body is accommodated in the accommodation case 342.

The display unit 341 is calibrated (a correction parameter for a display output signal is generated) on the basis of the luminance measured in this manner.

The calibration method is the same as that in the first embodiment. In other words, a freely-selected gray-scale signal is transmitted (a voltage is applied) to each of pixels of the display unit 341, and values of currents flowing through drive TFTs and OLED elements and output luminance at that time are measured. The calibration is performed on the basis of the current value and the luminance value.

Alternatively, only the measurement of the output luminance may be performed, and the calibration may be performed such that a predetermined luminance output is obtained.

Here, communication of measurement data and the like between the luminance line sensors 343 and the smartphone main body may be realized by connecting the smartphone main body to a connection connector 344 provided at a bottom portion of the accommodation case 342, or communication may be performed by a wireless connection (Bluetooth (trade name) or Wifi (trade name)).

In a case of a smartphone main body configured to be automatically accommodated in the accommodation case 342, the luminance line sensors 343 may be fixedly placed near the inlet of the accommodation case 342 to scan the viewable area 341*a* at the same time as the accommodation of the smartphone main body.

Note that although the examples in which the luminance line sensors are provided at the covers of the smartphones and in the accommodation cases of the smartphones have been described in Examples 7 to 10, luminance line sensors may be provided at a cover for a stationary-type (vertically placed) display (a TV or a monitor), or luminance line sensors may be provided at a cover or at an accommodation case for a mobile terminal such as a tablet, a smartwatch, or a mobile game console.

In the first and second embodiments, examples in which the OLED elements of the display unit are caused to emit light, luminance thereof is measured, a correction value (calibration data) for compensating degradation is generated on the basis of the measured luminance, drive currents of the drive TFTs and currents flowing through the OLED elements are further measured for generating accurate calibration data, and the measured currents are used have been described.

In a third embodiment described below, an example in which calibration data is produced from drive currents of the drive TFTs and currents flowing through OLED elements and the like without using light emission luminance of the OLED elements, that is, an example in which calibration data is produced based only on external compensation will be described.

Third Embodiment

An embodiment of the disclosure will be described below. In the present embodiment, a display device configured to produce calibration data based only on external compensation will be described. Note that the display device according to the present embodiment has a configuration obtained by omitting the luminance line sensors (luminance camera sensors) and the temperature line sensors from the display devices described in the first and second embodiments.

First, monitoring control for external compensation will be described.

Relationship between Monitoring Voltage and Current

Figure 32:
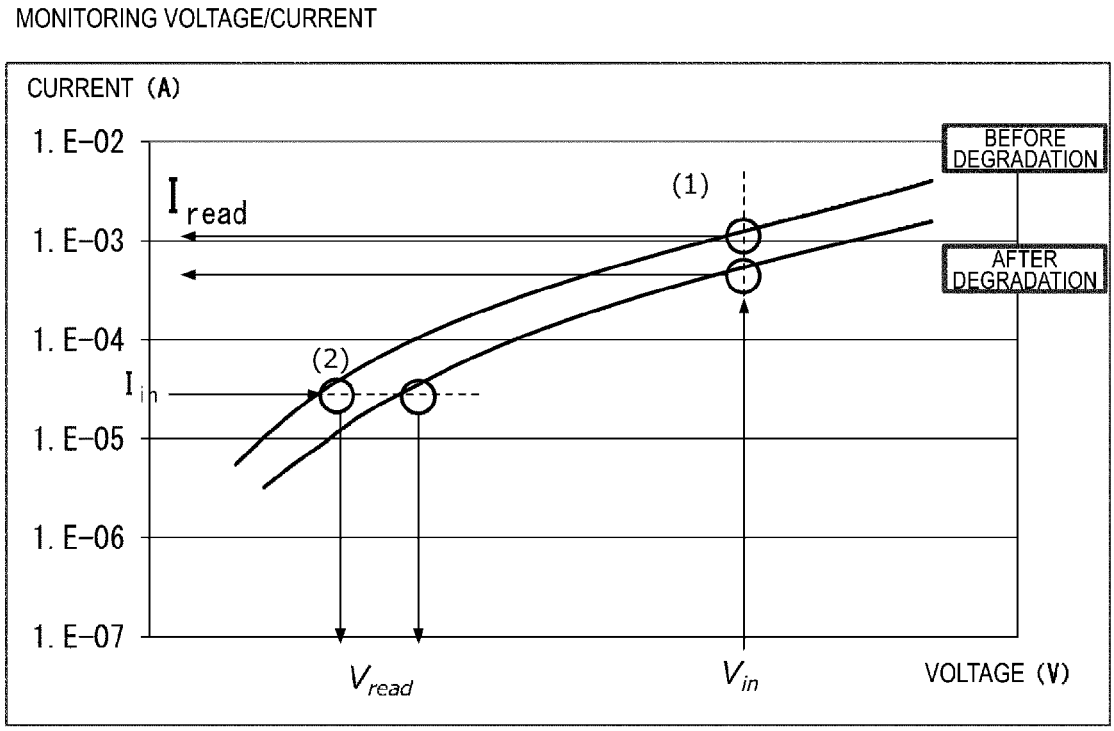
FIG. 32 is a graph illustrating a relationship between monitoring voltages and currents measured before degradation and after degradation of OLED elements in a display device according to a third embodiment of the disclosure.

FIG. 32 is a graph illustrating a relationship between monitoring voltages and currents measured before degradation and after degradation of OLED elements.

In the present embodiment, an applied voltage is controlled to obtain desired luminance (luminance before degradation) in consideration of how much voltage is to be applied after degradation to obtain a current equivalent to that before degradation using the graph illustrated in FIG. 32.

Here, as a method for compensating degradation, performing the following methods (1) and (2) on a drive transistor or an OLED element of each pixel in a panel are conceivable.

(1) A method of applying a voltage for monitoring, and monitoring and detecting a current flowing through the drive transistor/OLED element at that time (2) A method of setting a current for monitoring, and monitoring and detecting a voltage required to cause the current to flow In either of these methods, each degradation state is recognized from the monitored value, and correction/compensation values for the drive transistors and the OLED elements are calculated to obtain desired luminance.

When the aforementioned monitoring processing is performed, the OLED elements emit light since the current also flows to the OLED elements. Moreover, since ordinary image display cannot be performed as well during the monitoring, viewability of the user is problematic.

Further, it takes a significant time to scan the entire screen since the pixels are sequentially monitored.

However, it is also possible to partially perform monitoring processing and to update correction data only in an area in which the monitoring processing is performed.

The following measure is performed against such a problem of viewability during the monitoring for external compensation.

Solution of Viewability Problem

Figure 33:
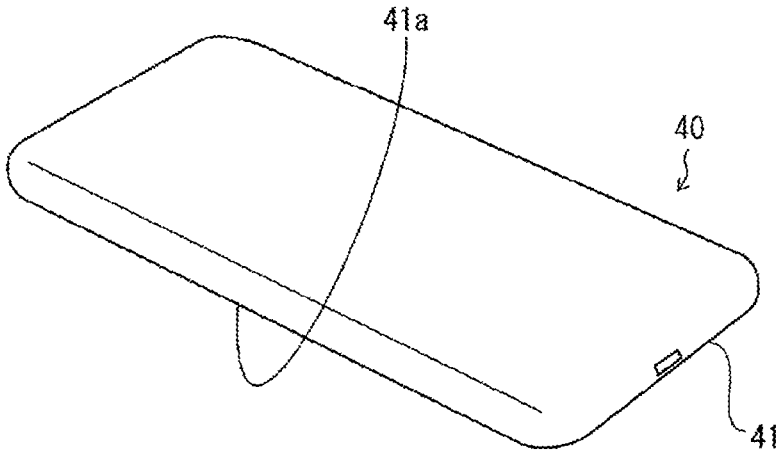
FIG. 33 is a perspective view of a mobile terminal placed with a viewable area of a display unit located to a floor face.

FIG. 33 is a perspective view of a mobile terminal 40 placed with a viewable area 41*a* of a display unit 41 located on a floor face.

Figure 34:
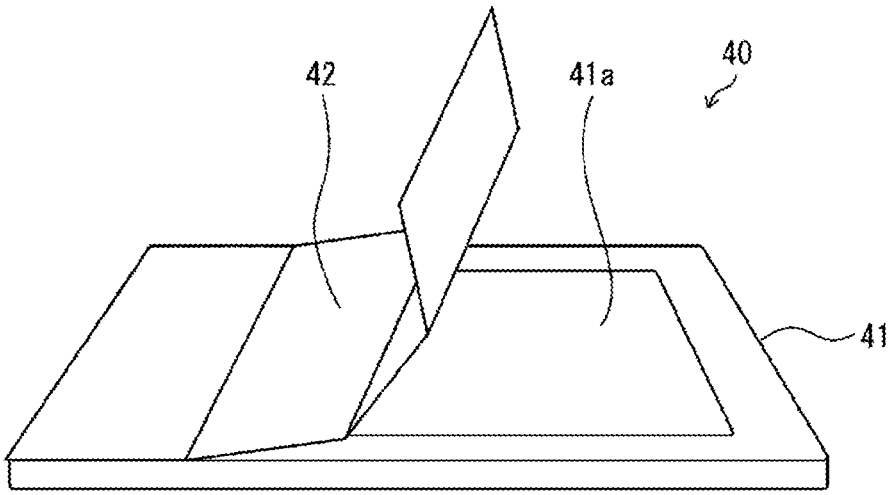
FIG. 34 is a perspective view illustrating an example in which the mobile terminal illustrated in FIG. 33 is provided with a cover configured to cover the viewable area of the display unit.

FIG. 34 is a perspective view illustrating an example in which a cover 42 configured to cover the viewable area 41*a* of the display unit 41 of the mobile terminal 40 illustrated in FIG. 33 is provided.

The mobile terminal 40 is configured such that the viewable area 41*a* of the display unit 41 is hidden, and a state in which the user cannot view the screen is thereby detected, and monitoring processing for external compensation is performed in this period of time.

The mobile terminal detects the case in which the mobile terminal is placed with the viewable area 41*a* of the display unit 41 located on the floor face as illustrated in FIG. 33 and the case in which the viewable area 41*a* of the display unit 41 is covered with the cover 42 as illustrated in FIG. 34, for example.

Specifically, a luminance sensor, a proximity sensor, or the like incorporated in the mobile terminal 40 detects whether the state in which the viewable area 41*a* is hidden has been achieved, and a gyroscope sensor or the like detects whether or not the state in which the mobile terminal 40 is placed/is not held with a hand has been achieved.

Further, a present clock time, a state in which the mobile terminal is being charged, and the like may be taken into consideration for determination of whether or not to execute the monitoring processing.

Note that in a case in which the aforementioned state is solved, the monitoring processing may be immediately interrupted, and correction data obtained until the processing is completed may be reflected. In a case in which the aforementioned state can be detected again, the monitoring processing may be executed from a continuing part from the previous processing.

System Configuration

Figure 35:
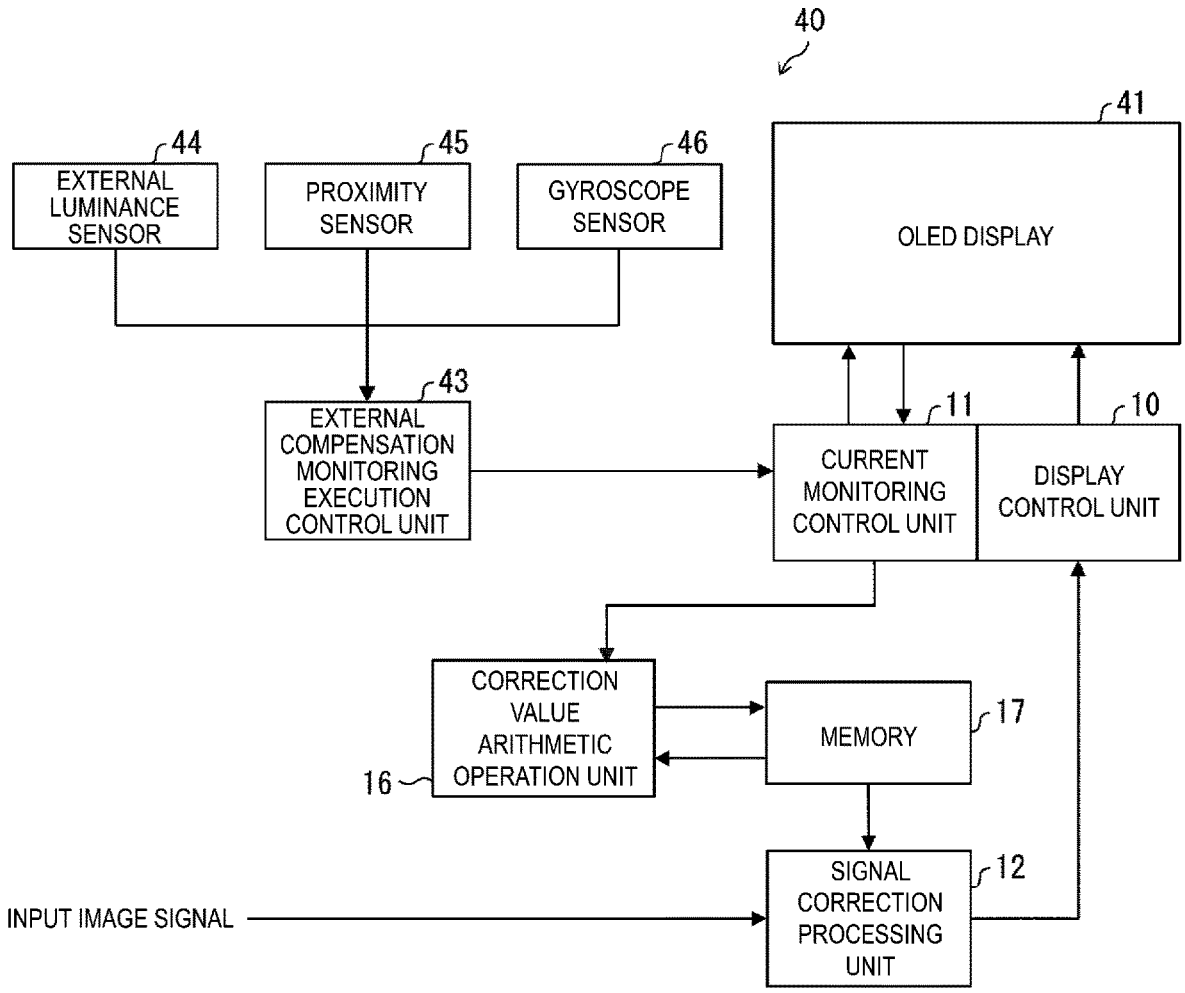
FIG. 35 is a block diagram illustrating an example of a system configuration for realizing OLED degradation compensation in the mobile terminal illustrated in FIG. 33.

FIG. 35 is a block diagram illustrating an example of a system configuration for realizing OLED degradation compensation in the mobile terminal 40.

The mobile terminal 40 includes a display control unit 10, a current monitoring control unit 11, a signal correction processing unit 12, a correction value arithmetic operation unit 16, a memory 17, an external compensation monitoring execution control unit 43, an external luminance sensor 44, a proximity sensor 45, and a gyroscope sensor 46.

At the time of ordinary image display, an input image signal is corrected into an image signal with degradation compensated by the signal correction processing unit 12, and an image is displayed on the display unit 101 via the display control unit 10. Here, the signal correction processing unit 12 reads a parameter for correction for each pixel saved in the memory 17 and corrects the input image signal on the basis of the parameter.

The external compensation monitoring execution control unit 43 determines that the user is not in a viewing state on the basis of detection information from the external luminance sensor 44, the proximity sensor 45, and the gyroscope sensor 46 incorporated in the mobile terminal 40 and transmits an instruction for executing the monitoring processing to the current monitoring control unit 11.

The correction value arithmetic operation unit 16 acquires a monitoring current/voltage value of each pixel from the current monitoring control unit 11, acquires measurement values (initial data and the like) in the past from the memory 17, and performs an arithmetic operation for a new correction parameter of each pixel on the basis of the data. The data obtained through the arithmetic operation is saved again in the memory 17 and is used as a later correction parameter at the time of ordinary display.

Advantageous Effects

According to the mobile terminal 40 with the aforementioned configuration, it is possible to maintain sufficient display quality without making the user view unpleasant display during execution of the monitoring processing and without making the user wait in a non-viewable state until completion of the processing, by periodically performing the monitoring processing for external compensation and update of compensation data in a period of time during which the user does not view any display.

Configurations of producing a period of time during which the user does not view any display will be described in Examples 1 to 5 below.

Example 1

Figure 36:
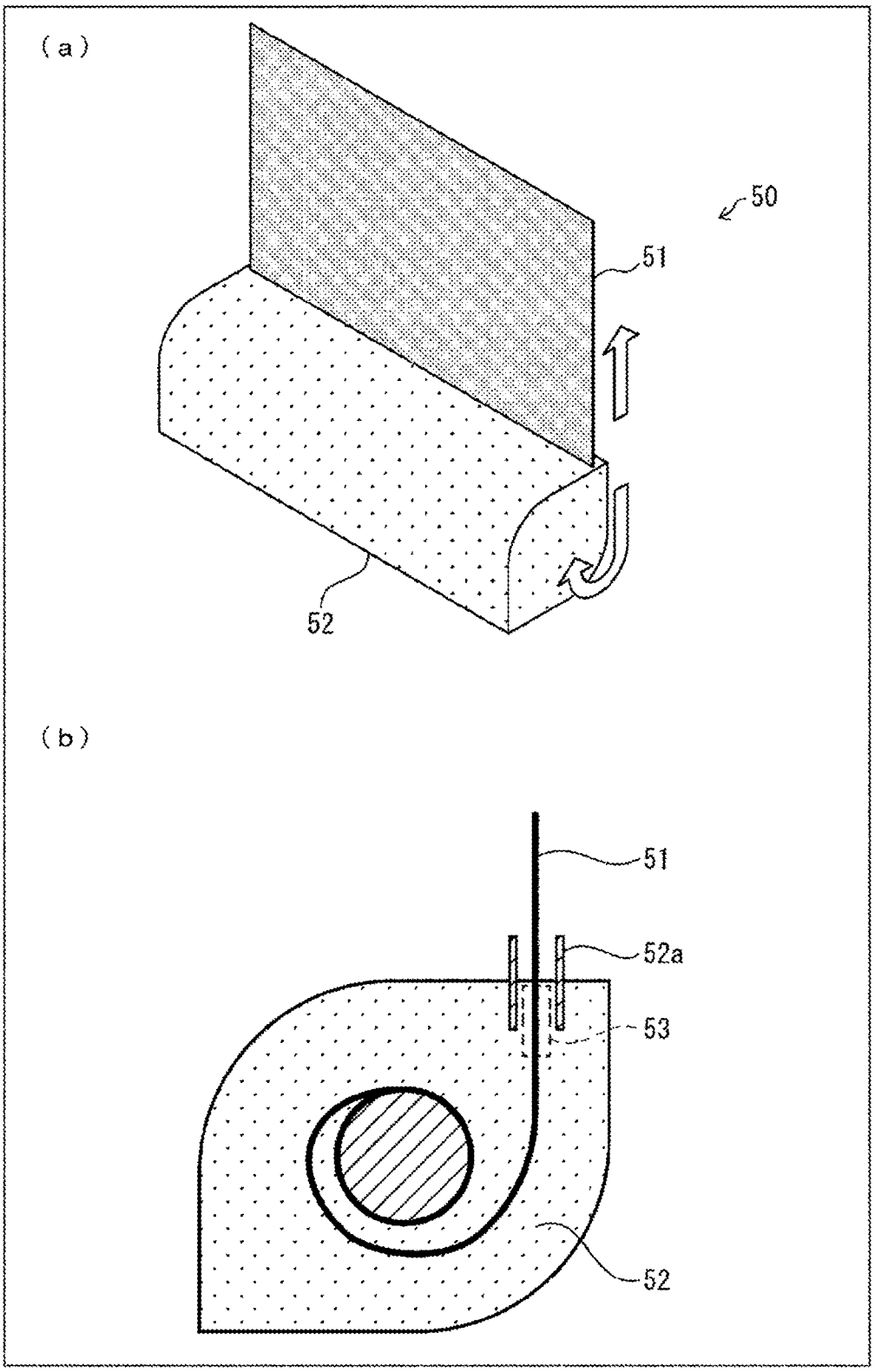
FIG. 36 is a schematic perspective view of a display device in Example 1.

FIG. 36 is a schematic perspective view of a display device 50 in this example.

A display device 50 includes a display unit 51 and an accommodation unit 52 configured to accommodate the display unit 51. The display unit 51 is formed of a flexible sheet display (OLED) in which OLED elements (display elements) are disposed in a matrix shape. In this manner, the display device 50 is configured such that the display unit 51 is accommodated in the accommodation unit 52 that is a case body at a lower portion while rolling the display unit 51 and the display unit 51 is pulled out (taken out) of the accommodation unit 52 at the time of viewing. In other words, the display device 50 is a roll accommodation-type display device.

In the display device 50, a monitoring area 53 is set in the vicinity of an opening 52*a*, which serves as an inlet and outlet of the display unit 51, inside the accommodation unit 52 as illustrated in (b) of FIG. 36. Since the monitoring area 53 is provided at a position through which the display unit 51 passes, the monitoring processing is executed when the display unit 51 passes through the monitoring area 53.

In other words, the display device 50 executes monitoring processing for external compensation when the display unit 51 is accommodated in the accommodation unit 52 and is in a state in which the user is not viewing the display unit 51, similarly to the mobile terminal 40 in the first embodiment.

Note that although the monitoring processing may be executed after the display unit 51 is completely accommodated in the accommodation unit 52, there is a possibility that there are some influences on monitor values when the monitoring processing is performed in a state in which the display unit 51 is wound inside the accommodation unit 52, and a part of lines of the display unit 51 entering the monitoring area 53 immediately after the display unit 51 enters the accommodation unit 52 during the accommodation operation is thus monitored as illustrated in (b) of FIG. 36. The display pixels on the line on which the monitoring processing is performed are inside the accommodation unit 52 such that the display pixels cannot be viewed by the user. Also, the pixels on the line are used in a planar state immediately before the display unit 51 is wound.

Since the display device 50 with the aforementioned configuration is configured such that the display unit 51 is electrically accommodated/deployed, the monitoring position on the display unit 51 is determined in conjunction with position information (a detection value of a position detection sensor) of a winding operation mechanism.

The timing at which the monitoring processing is performed is not limited to the timing when the display unit 51 is accommodated, and the monitoring processing may be performed at a similar position at the time of deployment. A possibility that the temperature and details of display of the display unit 51 affect monitored values during the operation of accommodating the display unit 51 when the power supply is turned off is also conceivable since displaying has been continued until that timing, and there is also a case in which the monitoring processing is preferably performed in a state in which the power supply is turned off for a while at the time of deployment.

Advantageous Effects

According to the display device 50 with the aforementioned configuration, it is possible to maintain sufficient display quality without making the user view unpleasant display during execution of the monitoring processing and without making the user wait in a non-viewable state until completion of the processing, by performing the monitoring processing and update of compensation data at a timing at which the display unit 51 is deployed/accommodated when the power supply is turned on/off and at a position that the user does not view.

Example 2

Figure 37:
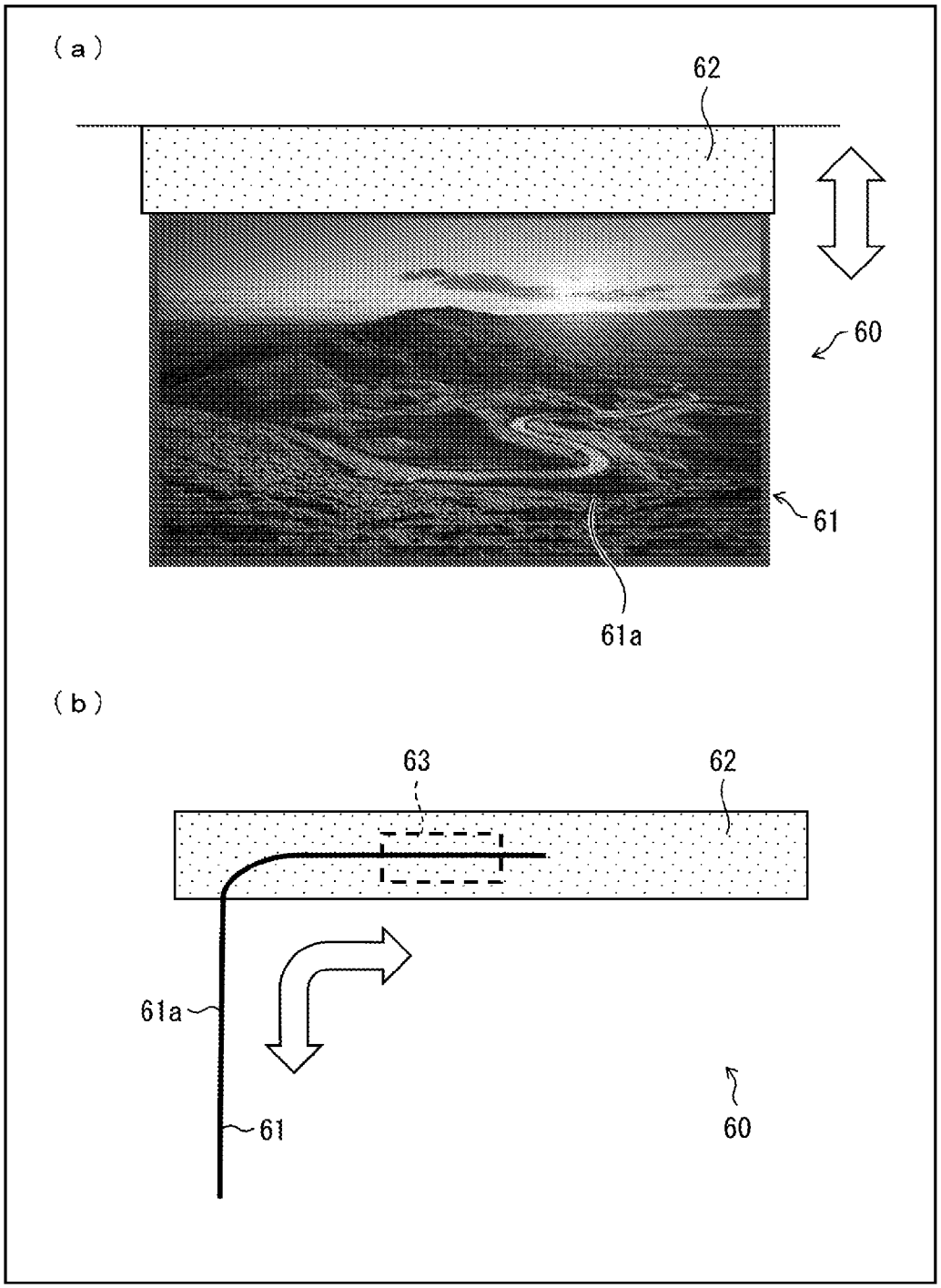
FIG. 37 is a schematic configuration diagram of a display device in Example 2.

FIG. 37 is a schematic configuration diagram of a display device 60 in this example.

The display device 60 is configured such that a display unit 61 that is a curved face and includes OLED elements is accommodated in an accommodation unit 62 placed on the ceiling as illustrated in (a) of FIG. 37. The accommodation unit 62 pulls the display unit 61 thereinto and accommodates the display unit 61 therein as illustrated in (b) of FIG. 37. A viewable area 61*a* is exposed in a state in which the display unit 61 is pulled out of the accommodation unit 62.

Similarly to Example 1, monitoring processing for external compensation is executed at a timing at which the display unit 61 is accommodated/deployed and at a position (the position of the reference sign 63 in (b) of FIG. 37) at which the display unit 61 is in a planar state.

Also, in a case in which the display device 60 with the aforementioned configuration is configured such that the display unit 61 is electrically accommodated/deployed similarly to Example 1, the execution timing of the monitoring processing and the monitoring position on the display may be determined in conjunction with position information of an electric mechanism (a detection value of a position detection sensor), or in a case in which the electric operation is not employed, a luminance sensor, a proximity sensor, or the like may be mounted on the display unit 61 to determine whether or not the display unit 61 is in a state in which it is retracted in the accommodation unit 62, and monitoring processing may thus be executed.

Example 3

Figure 38:
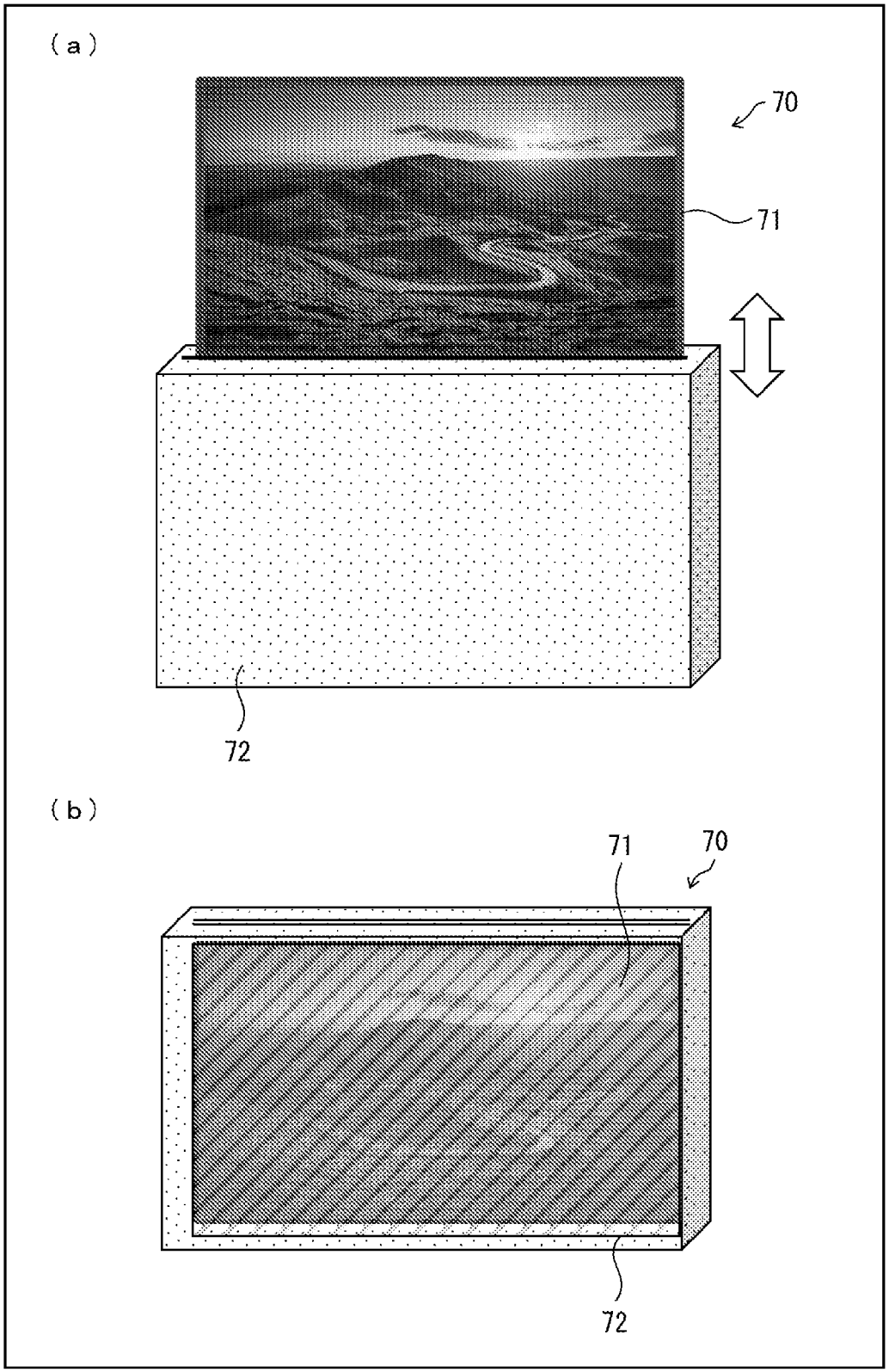
FIG. 38 is a schematic configuration diagram of a display device in Example 3.

FIG. 38 is a schematic configuration diagram of a display device 70 in this example.

The display device 70 is configured such that a display unit 71 is accommodated as a plane in the accommodation unit 72 at a lower portion and monitoring processing is executed in a state in which the display unit 71 is retracted in the accommodation unit 72 as illustrated in (a) and (b) of FIG. 38. In this case, since the display unit 71 is in the planar state even after being accommodated, the monitoring processing may be performed after the display unit 71 is completely accommodated.

Also, the monitoring processing may be executed after a specific time elapses after the display unit 71 is accommodated in the accommodation unit 72. For example, the monitoring processing may be executed after a time during which the display temperature is expected to be lowered or a time during which OLED characteristics are expected to be stabilized (recovered) after displaying is turned off elapses.

In a case of the display unit 71 configured to be electrically accommodated/deployed similarly to Example 1, the execution timing of the monitoring processing and the monitoring position on the display may be determined in conjunction with position information of an electric mechanism (a detection value of a position detection sensor), or in a case in which the electric operation is not employed, a luminance sensor, a proximity sensor, or the like may be mounted on the display unit 71 to determine whether or not a state in which the display unit 71 is retracted in the accommodation unit 72 has been achieved, and the monitoring processing may thus be executed.

Example 4

Figure 39:
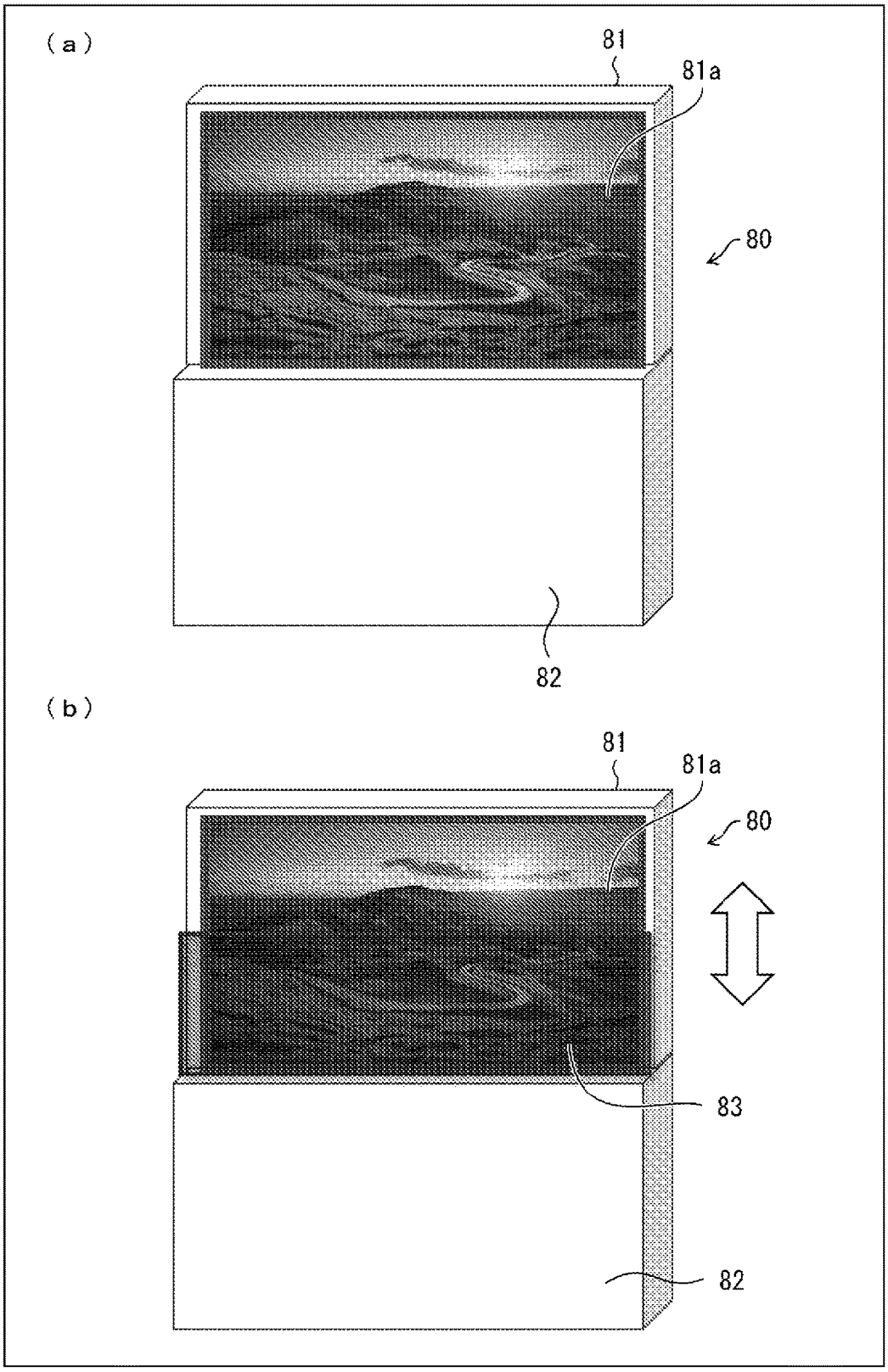
FIG. 39 is a schematic configuration diagram of a display device in Example 4.

FIG. 39 is a schematic configuration diagram of a display device 80 in this example.

The display device 80 includes a display unit 81 and a mounting stand 82 on which the display unit 81 is mounted as illustrated in FIGS. 39(*a*) and (*b*).

The mounting stand 82 includes a mechanism not only for mounting the display unit 81 thereon but also for electrically causing a cover 84 configured to cover a viewable area 81*a* of the mounted display unit 81 to stick out. In other words, the display device 80 in this example is configured to electrically cover the display face at the time other than the time of viewing.

The display device 80 executes monitoring for external compensation in a state/at a position where the display unit 81 is hidden by the cover 83. As for the monitoring execution timing, the monitoring may be performed when the cover 83 is operating or may be performed after the display unit 81 is completely covered with the cover 83 in a case of an electrically movable cover 83.

The monitoring processing may be executed after a specific time elapses as long as it occurs after the display unit 81 is completely covered with the cover 83. For example, the monitoring processing may be executed after a time during which the display temperature is expected to be lowered or a time during which OLED characteristics are expected to be stabilized (recovered) after displaying is turned off elapses.

In the case of the electrically movable cover 83, the execution timing of the monitoring processing and the monitoring position on the display may be determined in conjunction with position information of the electric mechanism (a detection value of a position detection sensor) or the like.

In a case of the cover 83 that is not electrically operated, a luminance sensor, a proximity sensor, or the like may be mounted on the display unit 81 to determine whether or not the display unit 81 is in a state in which it is completely covered with the cover 83, and the monitoring processing may thus be executed.

Example 5

Figure 40:
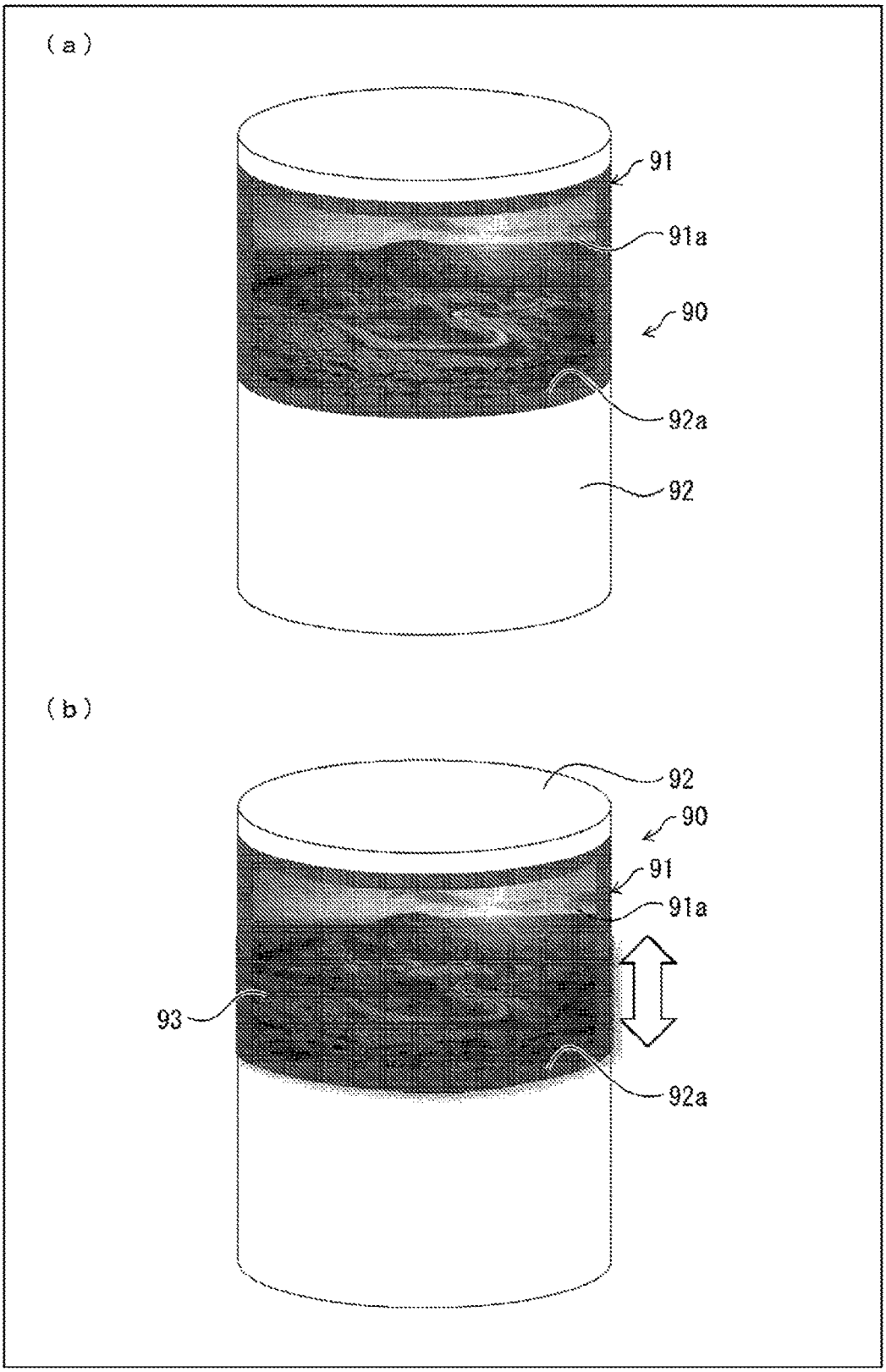
FIG. 40 is a schematic configuration diagram of a display device in Example 5.

FIG. 40 is a schematic configuration diagram of a display device 90 in this example.

The display device 90 is configured such that a display unit 91 that is a curved face and includes OLED elements is accommodated in a columnar accommodation unit 92 and a viewable area 91*a* of the accommodated display unit 91 can be viewed by being exposed from an opening 92*a* formed in a front face of the columnar accommodation unit 92 as illustrated in FIGS. 40(*a*) and (*b*).

In the display device 90, the columnar accommodation unit 92 includes a mechanism for electrically causing a cover 93 configured to cover the viewable area 91*a* of the accommodated display unit 91 to stick out, similarly to the display device 80 in Example 4. In other words, the display device 90 in this example is configured to electrically cover the display face at the time other than the time of viewing.

Similarly to the display device 80 in Example 4, the display device 90 executes monitoring for external compensation in a state/at a position where the display unit 91 is hidden by the cover 93. As for the monitoring execution timing, the monitoring may be performed when the cover 93 is operating or may be performed after the display unit 91 is completely covered with the cover 93 in a case of electrically movable cover 93.

The monitoring processing may be performed after a specific time elapses as long as it occurs after the display unit 91 is completely covered with the cover 93. For example, the monitoring processing may be executed after a time during which the display temperature is expected to be lowered or a time during which OLED characteristics are expected to be stabilized (recovered) after displaying is turned off elapses.

In the case of an electrically movable cover 93, the execution timing of the monitoring processing and the monitoring position on the display may be determined in conjunction with position information of the electric mechanism (a detection value of a position detection sensor) or the like.

In a case of a cover 93 that is not electrically operated, a luminance sensor, a proximity sensor, or the like may be mounted on the display unit 91 to determine whether or not the display unit 91 is in a state in which it is completely covered with the cover 93, and the monitoring processing may thus be executed.

Note that it is only necessary for the compensation for the OLED elements in the disclosure to be performed through at least one of three processes described hitherto, that is, (1) the monitoring processing of the drive TFTs and OLED elements (current value measurement), (2) measurement processing using luminance sensors (light emission luminance measurement), and (3) measurement processing using temperature sensors (temperature measurement). In other words, it is only necessary for the compensation for the OLED elements to be performed by variously combining (1) to (3) in various manners.

Here, in a case in which compensation achieved by executing the processing (1), that is, only compensation for electrical characteristics of the drive TFTs and OLED elements is performed (in a case in which no luminance sensors are provided), the amount of degradation in luminous efficiency of the OLED elements is predicted on the basis of the detection result of the electrical characteristics of the OLED elements, and compensation for luminous efficiency is also performed.

In a case in which compensation achieved by executing the processing (2), namely, only the luminance sensors perform detection (in a case in which compensation for the electrical characteristics of the drive TFTs and the OLED elements is not performed), compensation for a data signal of each pixel is performed so as to obtain desired luminance. As a result, compensation including electrical degradation is performed.

In a case in which the compensation achieved by executing both the processing (1) and the processing (2), that is, both the electrical compensation for the drive TFTs and the OLED elements and the luminous efficiency compensation for the OLED elements performed by the luminance sensors are performed, compensation can be performed with higher precision in a case in which the compensation for the luminous efficiency is performed with the luminance sensors after the compensation for the electrical characteristics of the drive TFTs and the OLED elements is performed. Although the OLED elements emit light when the electrical characteristics of the OLED elements are measured/monitored, the light emission luminance thereof may be measured by the luminance sensors, and the compensation may thus be performed. In this manner, it is possible to efficiently perform the measurement.

Supplement

Although the organic light emitting diode (OLED) elements have been described as the display elements (electro-optical elements, the luminance and the transmittance of which are controlled by currents) included in the display devices in the first to third embodiments, no such limitation is intended. Examples of the display devices in these embodiments include, as well as an organic electroluminescence (EL) display provided with OLEDs as electro-optical elements, an inorganic EL display provided with inorganic light emitting diodes as electro-optical elements, and a quantum dot light emitting diode (QLED) display provided with QLEDs as electro-optical elements.

First Aspect

A display device including a display unit including a plurality of electro-optical elements as display elements, luminance and transmittance of the plurality of electro-optical elements being controlled by a current, a detection unit configured to detect at least either optical characteristics or electrical characteristics of the display elements in the display unit in a blocked state, and a signal compensation unit configured to compensate a data signal provided to each of pixels of the display elements, on the basis of a detection result obtained by the detection unit.

With the aforementioned configuration, since the detection of at least either the optical characteristics or the electrical characteristics of the display elements in the display unit is performed in the blocked state, it is possible to minimize influences of unnecessary light on detection of the characteristics of the display elements and thereby to accurately detect the characteristics of the display elements. Since compensation for the data signal provided to each pixels of the display elements is performed on the basis of the characteristics detected in this manner, it is possible to accurately perform compensation in units of pixels.

Second Aspect

The display device according to the first aspect, further including a blocking mechanism configured to block the display unit.

With the aforementioned configuration, including the blocking mechanism configured to block the display unit makes it possible to easily bring the display unit into the blocked state. Examples of the blocking mechanism include a blocking cap configured to block a display surface by covering the display surface of the display unit and accommodation such that the display surface is blocked by accommodating the display unit.

Third Aspect

The display device according to the second aspect, in which the blocking mechanism is a blocking cap configured to block unnecessary light emission by the display elements occurring when the characteristics of the display unit are detected.

With this configuration, since the blocking mechanism is the blocking cap configured to block unnecessary light emission by the display elements occurring when the characteristics of the display unit are detected, it is possible to bring the display unit into the blocked state with a simple configuration.

Fourth Aspect

The display device according to the third aspect, in which the detection unit detects luminance of the display elements in a state in which the display elements are blocked by the blocking cap, and the signal compensation unit compensates a data signal provided to each of pixels of the display elements on the basis of a detection result obtained by the detection unit.

Fifth Aspect

The display device according to the second aspect, in which the blocking mechanism is an accommodation unit configured to accommodate the display unit such that at least an area where the display elements are formed is blocked, and the detection unit detects at least either optical characteristics and electrical characteristics of the display elements of the display unit in a state in which the display unit is accommodated in the accommodation unit.

With this configuration, since the blocking mechanism is the accommodation unit configured to accommodate the display unit such that at least the area where the display elements are formed is blocked, it is possible to bring the display unit into the blocked state with a simple configuration in which the display unit is accommodated in the accommodation unit.

Sixth Aspect

The display device according to the fifth aspect, in which the detection unit detects luminance of the display elements in a state in which the display elements are accommodated in the accommodation unit, and the signal compensation unit compensates a data signal provided to each of pixels of the display elements on the basis of a detection result obtained by the detection unit.

Seventh Aspect

The display device according to the fifth or sixth aspect, in which the detection unit detects at least either optical characteristics or electrical characteristics of the display elements of the display unit in a state in which there is relative movement between the display unit and the detection unit.

With this configuration, it is not necessary to bring the entire display unit into the blocked state when the characteristics of the display elements are detected, by detecting at least either the optical characteristics or electrical characteristics of the display elements of the display unit in the state in which there is relative movement between the display unit and the detection unit. In other words, since it is only necessary to bring only the area where at least either the optical characteristics or the electrical characteristics of the display elements are detected into the blocked state, the number of sensors required to be used by the detection unit is only the number corresponding to the area that is brought into the blocked state, and it is thus possible to significantly reduce the number of sensors as compared with a case in which the display unit is accommodated in the accommodation unit and the entire display unit is brought into the blocked state.

Eighth Aspect

The display device according to the seventh aspect, in which the detection unit detects at least either the optical characteristics or the electrical characteristics of the display elements in the accommodation unit in a period during which the display unit is accommodated in the accommodation unit or in a period during which the display unit is taken out of the accommodation unit.

With the aforementioned configuration, at least either the optical characteristics or the electrical characteristics of the display elements of the display unit are detected when the display unit is accommodated in the accommodation unit or when the display unit is taken out of the accommodation unit. In other words, at least either the optical characteristics or the electrical characteristics of the display elements of the display unit are detected in the state in which there is relative movement between the display unit and the detection unit. It is thus possible to significantly reduce the number of sensors as compared with the case in which the display unit is accommodated in the accommodation unit and the entire display unit is brought into the blocked state.

Ninth Aspect

The display device according to the first aspect, in which the display unit includes a plurality of pixel circuits including the display elements, drive transistors configured to drive the display elements, and monitoring control transistors configured to monitor drive states of at least either the display elements or the drive transistors, the detection unit measures currents flowing through the drive transistors and the display elements or voltages applied to the display elements, by turning on the monitoring control transistors, and the signal compensation unit compensates a data signal provided to each of pixels of the display elements on the basis of a measurement result obtained by the detection unit.

With the aforementioned configuration, it is possible to compensate electrical characteristics (variations, degradation) of the drive transistors and the display elements configuring the pixel circuits, by measuring voltages or currents applied to the drive transistor and the display element in each pixel circuit of the display unit and compensating the data signal provided to each of the pixels of the display elements on the basis of the measurement result.

Tenth Aspect

The display device according to the ninth aspect, in which the detection unit includes a luminance sensor configured to detect luminance of the display elements of the display unit, and the currents or the voltages related to the drive transistors and the display elements are measured by turning on the monitoring control transistors in a period during which the luminance of the display elements is detected by the luminance sensor.

With the aforementioned configuration, it is possible to perform the detection of the luminance when the display elements actually emit light and the measurement of the currents flowing through the display elements at the same time, to compensate the data signal provided to each of the pixels of the display elements on the basis of the detection result and the measurement result, and thereby to accurately compensate the data signal as compared with a case in which only the detection of the luminance is performed or a case in which only the measurement of the current is performed.

Eleventh Aspect

The display device according to the first aspect, in which the display unit has flexibility such that the display unit is deformable, the display device further includes a rolling mechanism configured to roll the display unit and accommodate a part of the display unit being rolled as a rolled area inside the rolling mechanism, and the detection unit detects at least either optical characteristics and electrical characteristics of the display elements of the display unit when the display unit is accommodated in the rolling mechanism or when the display unit is taken out of the rolling mechanism.

With the aforementioned configuration, since the detection of the characteristics of the display elements of the display unit is performed when the display unit is accommodated in the rolling mechanism or when the display unit is taken out of the rolling mechanism, it is possible to detect at least either the optical characteristics or the electrical characteristics of the display elements of the display unit in the blocked state even in the display device configured such that the display unit is accommodated in a rolled state.

Twelfth Aspect

The display device according to the first aspect, further including an accommodation unit configured to accommodate the display unit such that at least an area where the display elements are formed is blocked, and the detection unit detects at least either optical characteristics or electrical characteristics of the display elements while moving in the accommodation unit in a state in which the display unit is accommodated in the accommodation unit.

With the aforementioned configuration, it is possible to significantly reduce the number of sensors as compared with the case in which the display unit is accommodated in the accommodation unit and the entire display unit is brought into the blocked state, by detecting at least either the optical characteristics or the electrical characteristics of the display elements with the detection unit moving in the accommodation unit in the state in which the display unit is accommodated in the accommodation unit.

Thirteenth Aspect

The display device according to the first aspect, further including a temperature sensor configured to detect a temperature of the display unit, in which the signal compensation unit compensates a data signal provided to each of pixels of the display elements on the basis of at least either the optical characteristics or the electrical characteristics of the display elements detected by the detection unit and the temperature detected by the temperature sensor.

With the aforementioned configuration, since the compensation for the data signal is performed in consideration of the temperature of the display unit in addition to at least either the optical characteristics or the electrical characteristics of the display elements detected by the detection unit, it is possible to more accurately perform compensation in units of pixels than compensation of the data signal using only at least either the optical characteristics or the electrical characteristics of the display elements.

Fourteenth Aspect

The display device according to the first aspect, in which the display unit has flexibility such that the display unit is deformable, the display device further includes a rolling mechanism configured to roll the display unit and accommodate a part of the display unit being rolled as a rolled area inside the rolling mechanism, and a position sensor configured to detect an unrolled area of the display unit inside the rolling mechanism, and the detection unit detects at least either optical characteristics or electrical characteristics of the display elements in the unrolled area of the display unit detected by the position sensor.

With the aforementioned configuration, it is possible to detect characteristics of the display elements in the non-rolled area, namely, at least either the optical characteristics or the electrical characteristics of the display elements of the display unit, in a blocked state, when the display unit is accommodated in the rolling mechanism or when the display unit is taken out of the rolling mechanism.

Fifteenth Aspect

The display device according to the first aspect, further including an accommodation unit configured to accommodate the display unit such that at least an area where the display elements are formed is blocked, in which the detection unit detects at least either optical characteristics or electrical characteristics of the display elements for each of the pixels, for each line, or for each block, of the display unit, inside the accommodation unit.

With the aforementioned configuration, it is not necessary to perform the detection of at least either the optical characteristics and the electrical characteristics of the display elements of the display unit all at the same time when at least either the optical characteristics or electrical characteristics of the display elements are detected, by detecting at least either the optical characteristics or the electrical characteristics of the display elements for each pixel or for each line of the display unit inside the accommodation unit. In other words, only a sensor capable of detecting at least either the optical characteristics or the electrical characteristics of the display elements for each pixel or each line of the display unit is needed, and it is not necessary to provide sensors over the entire accommodation unit.

Sixteenth Aspect

The display device according to any one of the first to fifteenth aspects, in which compensation data obtained by the signal compensation unit is stored in a storage unit, and the signal compensation unit compensates a data signal provided to each of the pixels of the display elements of the display unit with reference to the compensation data stored in the storage unit.

With the aforementioned configuration, it is possible to quickly compensate the data signal provided to each of the pixels of the data signal display elements on the basis only of the detection result by newly compensating the data signal with reference to compensation data that has already been obtained.

Seventeenth Aspect

The display device according to the first aspect, further including an accommodation unit configured to accommodate the display unit such that at least an area where the display elements are formed is blocked, in which the detection unit is secured inside the accommodation unit.

With the aforementioned configuration, it is possible to detect the characteristics of the display elements of the display unit by moving the display unit inside the accommodation unit. In this manner, it is possible to detect the characteristics of the display elements of the display unit with a simple operation of moving the display unit inside the accommodation unit.

Eighteenth Aspect

The display device according to the first aspect, further including an accommodation unit configured to accommodate the display unit such that at least an area where the display elements are formed is blocked, in which the display unit causes the display elements of the display unit to emit light in a state in which the display unit is accommodated in the accommodation unit, and the detection unit detects luminance of the display elements as characteristics of the display elements.

With the aforementioned configuration, it is possible to detect the characteristics of the display elements of the display unit with the simple operation of accommodating the display unit in the accommodation unit.

Nineteenth Aspect

The display device according to the first aspect, in which the display unit includes drive transistors configured to drive the display elements, the detection unit measures currents flowing through or voltages applied to at least either the display elements or the drive transistors, and the signal compensation unit compensates a data signal provided to each of pixels of the display elements on the basis of a current value or a voltage value measured by the detection unit.

With the aforementioned configuration, it is not necessary to take the luminance of the display element into consideration since the compensation for the data signal provided to each of the pixels of the display elements is performed on the basis of the electrical characteristics of the display elements. Thus, it is not necessary to provide a luminance sensor configured to detect the luminance of the display elements.

Further, in a case in which the luminance sensor is used together, it is possible to predict the amount of degradation in luminous efficiency of the display elements on the basis of the electrical characteristics of the display elements and also to compensate the luminous efficiency on the basis of the predicted value.

Twentieth Aspect

The display device according to the first aspect, in which the detection unit detects luminance of the display elements of the display unit, and the signal compensation unit compensates a data signal provided to each of pixels of the display elements on the basis of the luminance detected by the luminance sensor.

With the aforementioned configuration, a decrease in luminance due to electric degradation is also compensated by compensating the data signal provided to each of the pixels such that desired luminance is obtained from the display elements.

Twenty-First Aspect

The display device according to the first aspect, in which the detection unit measures currents flowing through the display elements or a voltage applied to the display elements and detects luminance of the display elements, and the signal compensation unit compensates a data signal provided to each of pixels of the display elements on the basis of current values or voltage values measured by the detection unit and the luminance detected by the detection unit.

With the aforementioned configuration, it is possible to perform both the compensation based on the electrical characteristics of the display elements (electrical compensation) and the compensation based on the luminance of the display elements (luminous efficiency compensation) and thereby to precisely perform compensation for the data signal provided to the pixels of the display elements. It is possible to more precisely perform compensation in a case in which the electrical compensation is performed and then luminous efficiency compensation is performed, in particular. Also, it is possible to efficiently measure the luminance in a case in which the luminance of the display elements that emit light is measured by the luminance sensor when the electrical compensation is performed.

Twenty-Second Aspect

The display device according to the first aspect, in which the display unit includes drive transistors configured to drive the display elements, the detection unit measures currents flowing through the drive transistors and detects luminance of the display elements, and the signal compensation unit compensates a data signal provided to each of pixels of the display elements on the basis of the current value measured by the detection unit and the luminance detected by the detection unit.

With the aforementioned configuration, it is possible to perform both the compensation based on the electrical characteristics of the drive transistors configured to drive the display elements (electrical compensation) and the compensation based on the luminance of the display elements (luminous efficiency compensation) and thereby to precisely compensate the data signal provided to the pixels of the display elements. It is possible to more precisely perform compensation in a case in which the electrical compensation is performed and then luminous efficiency compensation is performed, in particular. Also, it is possible to efficiently measure the luminance in a case in which the luminance of the display elements that emit light is measured by the luminance sensor when the electrical compensation is performed.

Twenty-Third Aspect

The display device according to the first aspect, in which the display unit includes drive transistors configured to drive the display elements, the detection unit measures currents flowing through the drive transistors and the display elements or voltages applied to the drive transistors and the display elements and detects luminance of the display elements, and the signal compensation unit compensates a data signal provided to each of pixels of the display elements on the basis of the current values or the voltage values measured by the detection unit and the luminance detected by the detection unit.

With the aforementioned configuration, it is possible to perform both compensations, namely the compensation based on the electrical characteristics of the display elements and the drive transistors configured to drive the display elements (electrical compensation) and the compensation based on the luminance of the display elements (luminous efficiency compensation) and thereby to precisely compensate the data signal provided to the pixels of the display elements. It is possible to precisely perform the compensation in a case in which the electrical compensation is performed for the display elements and the drive transistors and then the luminous efficiency compensation is performed, in particular. Also, it is possible to efficiently measure the luminance in a case in which the luminance of the display elements that emit light is measured by the luminance sensor when the electrical compensation is performed.

The disclosure is not limited to each of the embodiments described above, and various modifications may be made within the scope of the claims. Embodiments obtained by appropriately combining technical approaches disclosed in each of the different embodiments also fall within the technical scope of the disclosure. Moreover, novel technical features can be formed by combining the technical approaches disclosed in the embodiments.

The invention claimed is:

1. A display device comprising:

a display unit including a plurality of electro-optical elements as display elements, luminance and transmittance of the plurality of electro-optical elements being controlled by a current;

a detection unit configured to detect at least optical characteristics or electrical characteristics of the display elements in a blocked state; and a signal compensation unit configured to compensate a data signal provided to each pixel of the display elements, based on a detection result obtained by the detection unit, wherein:

the display unit further includes a plurality of pixel circuits including the display elements, and drive transistors configured to drive the display elements;

the detection unit includes a luminance sensor configured to detect luminance of the display elements, and a temperature sensor configured to detect a temperature of the display unit;

the detection unit includes a current monitoring control circuit electrically connected to the drive transistors and the display elements, and configured to measure currents flowing through the drive transistors and the display elements or voltages applied to the display elements in a period during which the luminance of the display elements is detected, and a temperature of the display elements is detected; and the signal compensation unit compensates the data signal provided to each pixel of the display elements according to the detected luminance, the measured currents flowing through the drive transistors and the display elements or the measured voltages applied to the display elements, the detected at least the optical characteristics or electrical characteristics, the measured currents flowing through the drive transistors and the display elements or the measured voltages, and the detected temperature.

2. The display device according to claim 1, further comprising:

a blocking mechanism configured to block the display unit.

3. The display device according to claim 2, wherein the blocking mechanism is a blocking cap configured to block unnecessary light emission by the display elements occurring when the optical characteristics of the display elements are detected.

4. The display device according to claim 3, wherein:

the detection unit detects the luminance of the display elements in a state in which the display elements are blocked by the blocking cap; and the signal compensation unit compensates the data signal provided to each pixel of the display elements based on a detection result obtained by the detection unit.

5. The display device according to claim 2, wherein:

the blocking mechanism is an accommodation unit configured to accommodate the display unit such that at least an area where the display elements are formed is blocked; and the detection unit detects characteristics of the display elements in a state in which the display unit is accommodated in the accommodation unit.

6. The display device according to claim 5, wherein:

the detection unit detects the luminance of the display elements in a state in which the display elements are accommodated in the accommodation unit; and the signal compensation unit compensates a data signal provided to each pixel of the display elements based on a detection result obtained by the detection unit.

7. The display device according to claim 5, wherein the detection unit detects the at least the optical characteristics or electrical characteristics of the display elements in a state in which there is relative movement between the display unit and the detection unit.

8. The display device according to claim 7, wherein the detection unit detects at least the optical characteristics or the electrical characteristics of the display elements in the accommodation unit in a period during which the display unit is accommodated in the accommodation unit.

9. The display device according to claim 7, wherein the detection unit detects at least the optical characteristics or the electrical characteristics of the display elements in the accommodation unit in a period during which the display unit is not accommodated in the accommodation unit.

10. The display device according to claim 1, wherein:

the display unit has flexibility such that the display unit is deformable;

the display device further comprises a rolling mechanism configured to roll the display unit and accommodate a portion of the display unit rolled as a rolled area inside the rolling mechanism; and the detection unit detects at least the optical characteristics or electrical characteristics of the display elements when the display unit is accommodated in the rolling mechanism.

11. The display device according to claim 1, further comprising:

an accommodation unit configured to accommodate the display unit such that at least an area where the display elements are formed is blocked, wherein the detection unit detects at least the optical characteristics or electrical characteristics of the display elements while moving in the accommodation unit in a state in which the display unit is accommodated in the accommodation unit.

12. The display device according to claim 1, wherein:

the display unit has flexibility such that the display unit is deformable;

the display device further comprises:

a rolling mechanism configured to roll the display unit and accommodate a portion of the display unit rolled as a rolled area inside the rolling mechanism; and a position sensor configured to detect an unrolled area of the display unit inside the rolling mechanism, and the detection unit detects at least the optical characteristics or electrical characteristics of the display elements in the detected unrolled area of the display unit.

13. The display device according to claim 1, further comprising:

an accommodation unit configured to accommodate the display unit such that at least an area where the display elements are formed is blocked, wherein the detection unit detects at least the optical characteristics or electrical characteristics of the display elements for each pixel, for each line, or for each block, of the display unit, inside the accommodation unit.

14. The display device according to claim 1, further comprising:

an accommodation unit configured to accommodate the display unit such that at least an area where the display elements are formed is blocked, wherein:

the display unit causes the display elements to emit light in a state in which the display unit is accommodated in the accommodation unit; and the luminance detector detects the luminance of the display elements as the optical characteristics of the display elements.

15. The display device according to claim 1, wherein:

the detection unit measures currents flowing through or voltages applied to at least the display elements or the drive transistors; and the signal compensation unit compensates a data signal provided to each pixel of the display elements based on a current value or a voltage value measured by the detection unit.

16. The display device according to claim 1, wherein:

the display unit has flexibility such that the display unit is deformable;

the display device further comprises a rolling mechanism configured to roll the display unit and accommodate a portion of the display unit rolled as a rolled area inside the rolling mechanism; and the detection unit detects at least the optical characteristics or electrical characteristics of the display elements when the display unit is not accommodated in the rolling mechanism.

* * * * *